US010280583B2

(12) United States Patent
Babcock

(10) Patent No.: US 10,280,583 B2
(45) Date of Patent: May 7, 2019

(54) MULTI-WEB COUNTERFORT WALL SYSTEM

(71) Applicant: INSIDE BET LLC, Eden, UT (US)

(72) Inventor: John Babcock, Eden, UT (US)

(73) Assignee: Inside Bet LLC, Eden, UT (US)

( * ) Notice: Subject to any disclaimer, the term of this patent is extended or adjusted under 35 U.S.C. 154(b) by 0 days.

(21) Appl. No.: 16/146,961

(22) Filed: Sep. 28, 2018

(65) Prior Publication Data

US 2019/0093306 A1 Mar. 28, 2019

Related U.S. Application Data

(63) Continuation-in-part of application No. 15/719,397, filed on Sep. 28, 2017, now Pat. No. 10,087,598, and a continuation-in-part of application No. 16/011,486, filed on Jun. 18, 2018.

(51) Int. Cl.
*E02D 29/02* (2006.01)

(52) U.S. Cl.
CPC ..... *E02D 29/025* (2013.01); *E02D 29/0266* (2013.01); *E02D 2300/002* (2013.01); *E02D 2600/20* (2013.01)

(58) Field of Classification Search
CPC combination set(s) only.
See application file for complete search history.

(56) References Cited

U.S. PATENT DOCUMENTS 4,045,965 A 9/1977 Vidal
4,572,711 A 2/1986 Benson et al.
4,668,129 A 5/1987 Babcock et al.
4,671,706 A * 6/1987 Giardini ..... E02D 29/025 405/286
4,684,294 A * 8/1987 O'Neill ..... E02D 29/0266 405/273
5,131,791 A 7/1992 Kitziller
5,163,261 A 11/1992 O'Neill
5,178,493 A 1/1993 Vidal et al.
5,468,098 A 11/1995 Babcock
(Continued)

FOREIGN PATENT DOCUMENTS

RU 2119993 C1 10/1998
WO 2010052806 5/2010
(Continued)

OTHER PUBLICATIONS

U.S. Appl. No. 16/011,486, filed Jun. 18, 2018, Office Action dated Oct. 5, 2018.

(Continued)

*Primary Examiner* — Kyle Armstrong
(74) *Attorney, Agent, or Firm* — Kunzler, PC; Bruce R. Needham

(57) ABSTRACT

A wall system includes a face joint member including a substantially flat face and at least two webs extending orthogonally on an opposite side to the flat face. The wall system further includes a counterfort beam coupled to the face joint member, wherein the counterfort beam includes at least two counterfort webs extending from a counterfort flange that extends between the at least two counterfort webs. The counterfort beam is coupled to the face joint member by coupling the at least two counterfort webs to the at least two webs of the face joint member.

19 Claims, 53 Drawing Sheets

(56) References Cited

U.S. PATENT DOCUMENTS

| | | | | |
|---|---|---|---|---|
| 6,238,144 | B1 | 5/2001 | Babcock | |
| 7,001,110 | B2 | 2/2006 | Lockwood | |
| 7,845,885 | B2 * | 12/2010 | Jaecklin | E02D 29/025 405/273 |
| 2004/0161307 | A1 | 8/2004 | Hammer | |
| 2013/0136544 | A1 | 5/2013 | McKittrick | |
| 2014/0234025 | A1 | 8/2014 | Rainey | |
| 2014/0270990 | A1 * | 9/2014 | Heraty | E02D 29/0266 405/286 |

FOREIGN PATENT DOCUMENTS

| | | | | |
|---|---|---|---|---|
| WO | WO-2010052806 | A1 * | 5/2010 | E02D 29/025 |
| WO | 2014130286 | A1 | 8/2014 | |

OTHER PUBLICATIONS

U.S. Appl. No. 16/146,873, filed Sep. 28, 2018, Notice of Allowance dated Jan. 9, 2019.

PCT/US2018/053596, Notification of Transmittal of the International Search Report and the Written Opinion of the International Searching Authority, or the Declaration, International Searching Authority, Jan. 24, 2019, pp. 1-8.

* cited by examiner

MULTI-WEB COUNTERFORT WALL SYSTEM

CROSS-REFERENCE TO RELATED APPLICATIONS

This application is a continuation-in-part of U.S. patent application Ser. No. 15/719,397 entitled "IMPROVED COUNTERFORT RETAINING WALL" and filed on Sep. 28, 2017 for John Babcock, the entire contents of the above mentioned application is incorporated herein by reference for all purposes. This application is a continuation-in-part of U.S. patent application Ser. No. 16/011,486 entitled "COMBINED COUNTERFORT RETAINING WALL AND MECHANICALLY STABILIZED EARTH WALL" and filed on Jun. 18, 2018 for John Babcock, the entire contents of the above mentioned application is incorporated herein by reference for all purposes.

FIELD

This invention relates to wall systems and more particularly relates to multiple counterfort wall systems.

BACKGROUND

Typical applications for retaining walls are highway, railroad, and seawall structures. Various types of walls have been used for numerous highway and railroad embankment support structures. Such various types of walls may have different advantages including material cost, labor cost, construction time, and ancillary support structures.

SUMMARY

A wall system is disclosed. The wall system includes a face joint member including a substantially flat face and at least two webs extending orthogonally on an opposite side to the flat face. The wall system further includes a counterfort beam coupled to the face joint member, wherein the counterfort beam includes at least two counterfort webs extending from a counterfort flange that extends between the at least two counterfort webs. The counterfort beam is coupled to the face joint member by coupling the at least two counterfort webs to the at least two webs of the face joint member. Other embodiments are also disclosed.

In some embodiments, counterfort beam is formed together with the face joint member using monolithic construction. In some embodiments, counterfort beam further comprises an inclined rear panel. In some embodiments, counterfort beam is coupled to the face joint member by a first connecting threadbar that extends through a first one of the counterfort webs of the counterfort beam and into a first one of the webs of the face joint member and further coupled by a second connecting threadbar that extends through a second one of the counterfort webs of the counterfort beam and into a second one of the webs of the face joint member and wherein the connecting threadbar comprises a grease layer between the inner metal threaded bar and the outer protective sleeve. In some embodiments, the connecting threadbars each comprise a grease layer between the inner metal threaded bar and the outer protective sleeve.

In some embodiments, the wall system further includes a plurality of face joint members and counterfort beams coupled together to form a wall. In some embodiments, the plurality of face joint members are adjacent to one another to form a substantially flat wall. In some embodiments, the plurality of face joint members are spaced apart, and wherein the wall system further comprises wall panels that extend between the face joint members.

In some embodiments, the wall system further includes an intermediate slab that extends from a first web of a first counterfort beam to a second web of a second counterfort beam. In some embodiments, the wall system further includes an upper support slab coupled to the at least two counterfort webs of the counterfort beam. In some embodiments, the intermediate slab is positioned directly below the upper support slab extends through the counterfort beam and into the face joint member, wherein the second connecting threadbar includes a second inner metal threaded bar and a second outer protective sleeve with a grease layer between the second inner metal threaded bar and the second outer protective sleeve. In some embodiments, the plurality of counterfort webs are adjacent to one another.

In some embodiments, the wall system further includes an upper support slab coupled to the at least two counterfort webs of the counterfort beam. In some embodiments, the upper support slab is coupled to the at least two counterfort webs by a corresponding sleeved threadbar.

A wall system is disclosed. The wall system includes a plurality of face joint members each comprising a substantially flat face and at least two webs extending orthogonally on an opposite side to the flat face. The wall system further includes a plurality of counterfort beams respectively coupled to one of the plurality of face joint members, wherein a respective counterfort beam comprises at least two counterfort webs extending from a counterfort flange, the counterfort flange extending between the at least two counterfort webs. The respective counterfort beam is coupled to the face joint member by coupling the at least two counterfort webs to the at least two webs of the face joint member. The wall system further includes an intermediate slab that extends from a first web of a first counterfort beam of the plurality of counterfort beams to a second web of a second counterfort beam of the plurality of counterfort beams. Other embodiments are also disclosed.

In some embodiments, the wall system further includes an upper support slab coupled to the at least two counterfort webs of the counterfort beam. In some embodiments, the intermediate slab is positioned directly below the upper support slab. In some embodiments, the plurality of counterfort beams each further comprises an inclined rear panel.

A wall system is disclosed. The wall system includes a plurality of face joint members each comprising a substantially flat face and at least two webs extending orthogonally on an opposite side to the flat face. The wall system further includes a plurality of counterfort beams respectively coupled to one of the plurality of face joint members, wherein a respective counterfort beam comprises at least two counterfort webs extending from a counterfort flange, the counterfort flange extending between the at least two counterfort webs. The respective counterfort beam is coupled to the face joint member by coupling the at least two counterfort webs to the at least two webs of the face joint member. The wall system further includes an upper support slab coupled to the at least two counterfort webs of the respective counterfort beam. The wall system further includes an intermediate slab that extends from a first web of a first counterfort beam of the plurality of counterfort beams to a second web of a second counterfort beam of the plurality of counterfort beams. The intermediate slab is positioned directly below the upper support slab. Other embodiments are also disclosed.

In some embodiments, the respective counterfort beam is coupled to the respective face joint member by a first connecting threadbar that extends through a first one of the counterfort webs of the counterfort beam and into a first one of the webs of the face joint member and further coupled by a second connecting threadbar that extends through a second one of the counterfort webs of the counterfort beam and into a second one of the webs of the face joint member. In some embodiments, the connecting threadbar comprises a grease layer between the inner metal threaded bar and the outer protective sleeve.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1A:
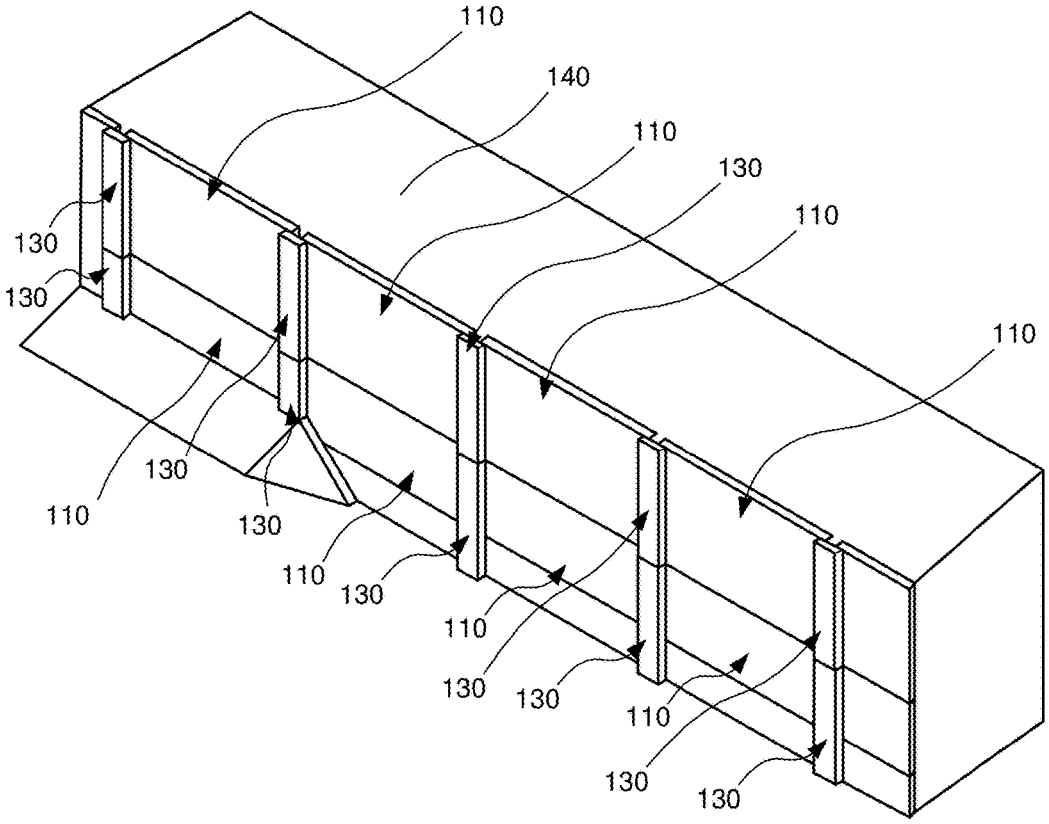
FIG. 1A is a perspective view illustrating one embodiment of a counterfort wall system in accordance with some embodiments of the present invention.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided for a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Various methods have been used to construct precast walls for retaining earth, soil, sand or other fill (generally referred to as soil). Some methods utilize full height panels. That is, the wall panels span the entire height of the retaining wall. Such full height panels have disadvantages. Temporary erection braces are required for these systems to hold the panels in place when the backfill (soil) is placed behind the wall. This requires additional working right-of-way in front of the wall and restricts site access.

For this and other reasons, smaller panels are utilized in many cases for retaining walls. In some instances, the wall panels are not placed directly above or below adjacent wall panels. Such a retaining wall is built with offset tiers, where an upper tier is set back from a lower tier to reduce the load present on the lower tier.

In some instances, counterfort members are utilized which extend back into the backfill to transfer loads back into the backfill soil. However, such counterfort members are placed at the horizontal joint elevations between the wall panels. Although the material costs for these types of wall systems are low, high labor costs for the various stages of wall construction can result in installed price of walls that are substantially higher than the material costs. One reason is because to place the counterfort members requires slot cuts into the backfill. With the counterfort members being placed at the horizontal joint elevations between the wall panels, a deeper slot cut is necessary. Embodiments described herein overcome some or all of these shortcomings.

In addition, counterfort members of such systems have large profiles and utilize L-shaped counterfort members. Embodiments of the invention utilize T-shaped counterfort members which are elevated above the horizontal joint elevations. The use of these elevated base T-shaped counterforts results in a minimal imposed retained soil loading on the foundation material. Due the profile of the elevated base T-shaped counterforts the effective imposed tier soil loads can approach the unit weight of soil times the height of the soil. In contrast, the use of the previously used L-shaped counterforts of comparable height will impose higher loads on the foundation soils at the base of the wall and between subsequent wall tiers. To address this effect, so that the soil bearing capacity is not exceeded, with the L-shaped counterforts either a much wider base section or other additional foundation enhancement means would be required to consider the L-shaped counterforts of comparable height.

Embodiments of the invention allow for reduction in labor costs in conjunction with low material costs. Some embodiments allow for shallower slot cuts into the in situ existing material for the base and/or upper tiers, while maintaining the structural soundness of the retaining wall. Some embodiments allow for an upper tier of wall panels to be placed directly above a lower tier of wall panels without excessive transfer of loads from the upper tier to the lower tier. Some embodiments allow for smaller profile counterfort members to be utilized so that the base tier of the wall can closely correspond to the proposed slope intercept.

Some embodiments of the invention allow for the bottom elevation of the slot cut to be approximately between one-third and one-half higher than the elevation the elevation of the bottom of a slot that would be required for the L-shaped counterfort. The optimum elevation of the counterfort beam depends on the resultant force location, which ultimately influences the soil loading due to the induced moment magnitude imposed on the counterfort beam. As a result of the elevated base T-shaped counterfort profile the excavation is reduced compared to the slot cut depth that would be needed for the L-shaped counterfort. Some embodiments may be less than one-third the elevation of the bottom of a slot that would be required for the L-shaped counterfort. Some embodiments may be greater than one-half the elevation of the bottom of a slot that would be required for the L-shaped counterfort. Some embodiments may be greater than one-third the elevation of the bottom of a slot that would be required for the L-shaped counterfort.

FIG. 1A depicts a perspective view illustrating a counterfort retaining wall 100 in accordance with one embodiment of the present invention. Although the counterfort retaining wall 100 is shown and described with certain components and functionality, other embodiments of the counterfort retaining wall 100 may include fewer or more components to implement less or more functionality.

FIG. 1A depicts a plurality of wall panels 110. The wall panels 110 form an array in a two-dimensional plane. In the depicted embodiment, the wall panels 110 are located one above another. That is, as depicted, a first tier of wall panels 110 is shown placed across a base of the wall and a second tier of wall panels 110 are directly above the first tier of wall panels 110 as opposed to set back or horizontally offset slightly behind the first tier of wall panels 110.

Located between the wall panels 110 are face joint members 130. The face joint members 130 are coupled to counterfort beams (not visible) which extend back behind the wall. Also depicted is backfill 140 which may include earth, soil, sand, and/or other fill types.

Figure 1B:
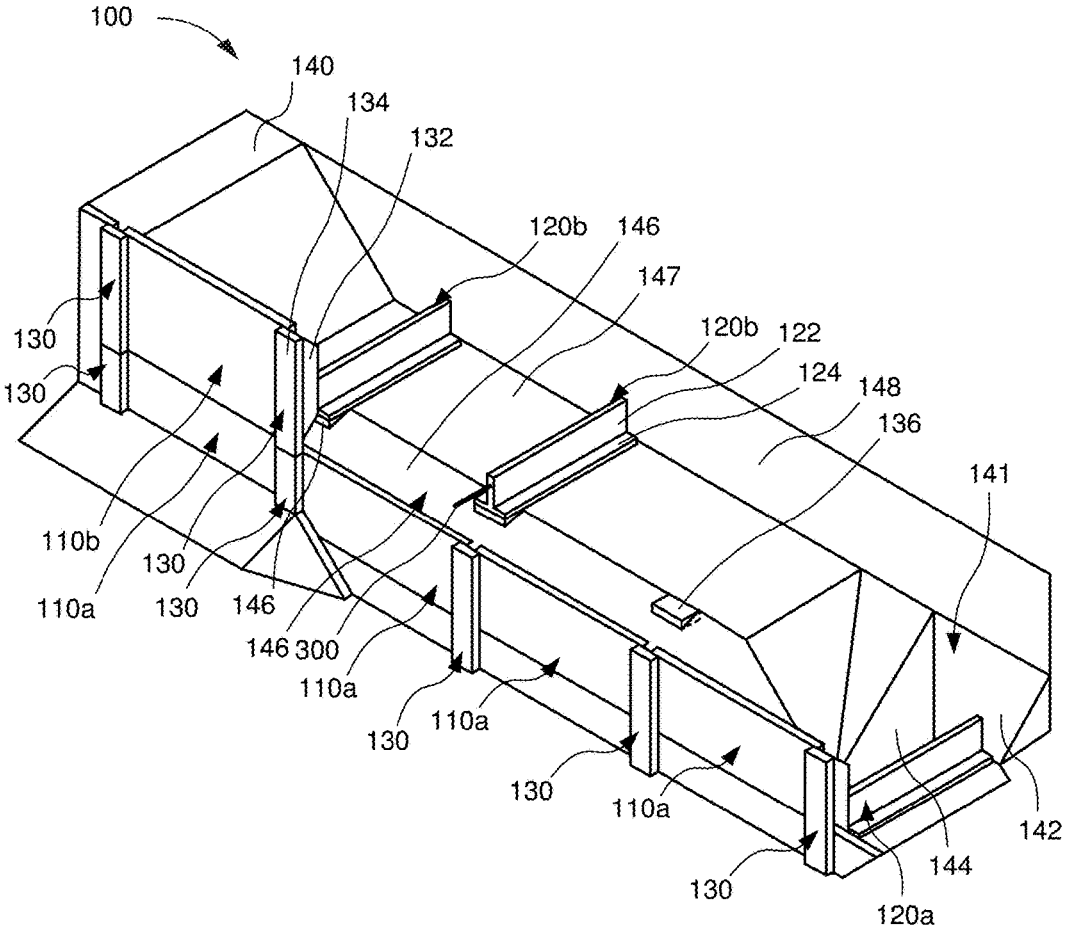
FIG. 1B is a perspective cut-away view illustrating the counterfort wall system of FIG. 1A in accordance with some embodiments of the present invention.

FIG. 1B depicts a perspective cut-away view illustrating the counterfort retaining wall 100 of FIG. 1A with a portion of the wall panels 110 and other components removed to allow for a proper understanding the various components of the counterfort retaining wall 100. The wall is depicted as only partially constructed to show the various components that would ultimately be set within and encapsulated in compacted backfill behind the wall. Although the counterfort retaining wall 100 is shown and described with certain components and functionality, other embodiments of the counterfort retaining wall 100 may include fewer or more components to implement less or more functionality.

FIG. 1B depicts a plurality of wall panels 110 including a first tier or lower tier of wall panels 110*a* which run across a base of the wall. A majority of the second tier of wall panels 110*b* except for a single wall panel 110 shown at the left end of the wall are removed. In the illustrated embodiment, the wall panels 110 are rectangular slabs. In other embodiments, the wall panels may be formed or manufactured into other shapes and configurations.

The wall panels 110 include a panel face which functions as the visible portion of the wall panels 110 upon completion of the wall. The panel face forms a substantially vertical two-dimensional plane. In some embodiments, the panel faces of the upper tier wall panels 110*b* are coplanar with the panel faces of the lower tier wall panels 110*a*. In some embodiments, the panel faces of the upper tier wall panels 110*b* are not coplanar with the panel faces of the lower tier wall panels 110*a* but are offset and parallel to each other.

The wall panels 110 include a rear panel face which is the portion of the wall panels covered by and in contact with the backfill 140 upon completion of the wall. The rear panel face forms a substantially vertical two-dimensional plane. In some embodiments, the rear panel faces of the upper tier wall panels 110*b* are coplanar with the rear panel faces of the lower tier wall panels 110*a*. In some embodiments, the rear panel faces of the upper tier wall panels 110*b* are not coplanar with the rear panel faces of the lower tier wall panels 110*a* but are offset and parallel to each other.

The wall panels 110 include a top panel edge and a bottom panel edge. As the wall is constructed in tiers starting at the base and working upwards the bottom panel edge of an upper wall panel 110*b* is directly above the top panel edge of a lower wall panel 110*a*. In some embodiments, the bottom panel edge of the upper wall panel 110*b* rests on the top panel edge of a lower wall panel 110*a*. In some embodiments, the bottom panel edge of an upper wall panel 110*b* is directly above but does not contact the top panel edge of a lower wall panel 110*a*. In a fully constructed wall, the top panel edge and the bottom panel edge, in some embodiments, form a substantially horizontal two-dimensional plane. In some embodiments, a horizontal junction occurs between the lower tier and the upper tier.

The wall panels 110 include a first side panel edge, and a second side panel edge. In a fully constructed wall, the first side panel edge and the second side panel edge form, in some embodiments, a substantially vertical two-dimensional plane orthogonal to the panel face as well as the top panel edge. Where two wall panels 110 meet at their side panel edges, the side panel edges form a vertical junction. However, instead of side panel edges being adjacent to a neighboring wall panel, a face joint member 130 is inserted into the vertical junction which separates the side panel edges from each other.

In some embodiments, the wall panels 110 are precast panels. Precast panels allow for the manufacture of the wall panels 110 in a first location which then can be shipped to an assembly location where the wall is built. In some embodiments, the wall panels 110 are precast concrete panels. Concrete typically is comprised of a hardened mixture of stone, gravel, sand, cement, and water.

In the illustrated embodiment, the counterfort retaining wall 100 includes face joint members 130. The face joint members are placed in a substantially vertical position between adjacent wall panels 110. The face joint members 130 may alternatively be placed perpendicular to the grade at the top of the wall. The face joint members 130 include a joint web 132 which is disposed between the side panel edge of a first wall panel and the side panel edge of a second wall panel at vertical junction. The face joint members 130 further include a joint flange 134 which is visible upon completion of the wall. The joint flanges 134 extend out and support the wall panels 110 as the panel faces rest against the joint flange 134. In some embodiments, the face joint members 130 lean out to provide a planting space (or exposed soil) between tiers.

In the illustrated embodiment, the counterfort retaining wall 100 includes a plurality of counterfort beams 120 (120*a*, 120*b*) which are each coupled to a face joint member 130 at a first end of the counterfort beam 120. The counterfort beams 120 are configured to extend back into the backfill 140 and are configured to transfer forces exerted on the wall panels back into the backfill 140.

The counterfort beams 120 may be of different shapes and configurations. In some embodiments, the counterfort beams 120 are tee beams and include a counterfort web 122 and a counterfort flange 124. The counterfort web 122 and the counterfort flange 124 are in substantially orthogonal two-dimensional planes in which the counterfort flange 124 is in a horizontal two-dimensional plane and the counterfort web 122 is in a vertical two-dimensional plane. In some embodiments, substantially orthogonal is within five degrees of orthogonal.

The counterfort flange 124 forms the bottom surface of the counterfort beam 120. In some embodiments, the counterfort beam 120 is coupled to the face joint member 130 such that a bottom surface of the counterfort flange 124 is above a bottom edge of the face joint member 130. In some embodiments, the bottom surface of the counterfort flange 124 is above the horizontal junction 170 between a lower tier of wall panels and an upper tier of wall panels or a lower tier of face joint members 130 and an upper tier of face joint members 130.

The process for constructing a wall is described briefly. The wall is constructed tier by tier. At each tier, the backfill 140 behind the wall includes compacted backfill and uncompacted backfill or undisturbed in situ material. The amount and slope of the compacted backfill is, in many cases, dictated by code. For example, a 2:1 slope is standard in many jurisdictions. This is shown is FIG. 2, with the compacted backfill 140*a* starting at a base of the wall panel 110 and extending backwards at a 2:1 slope. The sloped surface 146 is also depicted in FIG. 1B at the second tier.

The compacted backfill 140*a* starts at the wall at the bottom of the upper tier or the top of the lower tier and slopes backwards.

Figure 2:
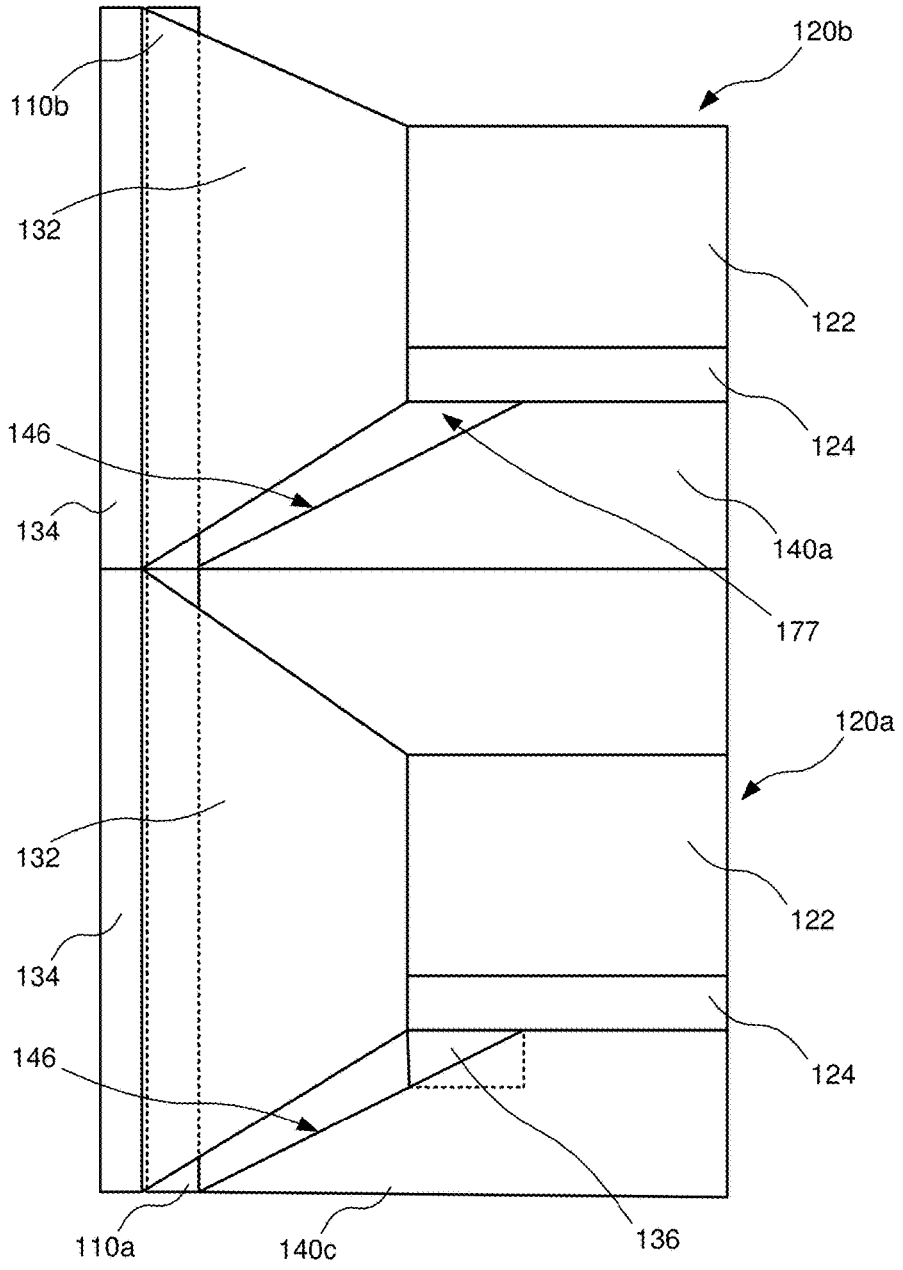
FIG. 2 is a side view illustrating one embodiment of counterfort beams in relation to compacted backfill and wall panels in accordance with some embodiments of the present invention.

To place the counterfort beams 120, it is sometimes necessary to make a slot cut 141 in the backfill 140 or in situ material. A slot cut 141 is done to place the counterfort beam 120 and allow for attachment or coupling of the counterfort beam 120 to a face joint member 130. FIG. 1B depicts a slot cut 141 on the lower tier. The slot cut 141 includes a sloping back cut 142 and sloping side cuts 144. The slot cut 141 must be dug to a depth at least deep enough to place the counterfort beam 120. The bottom surface of the counterfort beam 120 rests on the compacted backfill 140*a* or in situ material 140*c*. Referring to FIG. 2, the lower counterfort beam 120*a* rests on the in situ material 140*c* and the upper counterfort beam 120*b* rests on the compacted backfill 140*a*. A slot cut 141, in some embodiments, is utilized to eliminate the use of shoring that would otherwise be required for open cuts into the existing in situ material.

Figure 4:
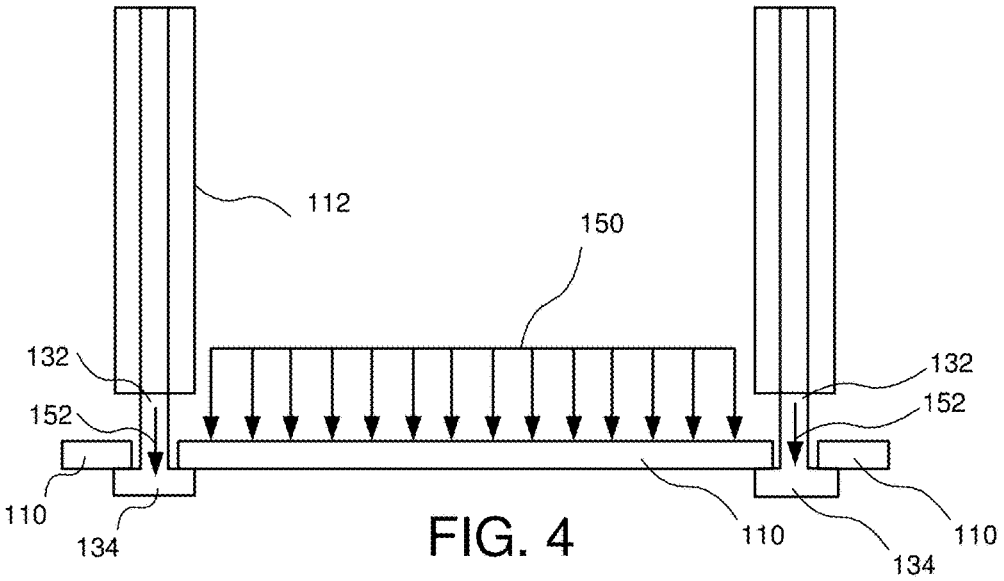
FIG. 4 is a top view illustrating a distribution of loads on the counterfort beams in accordance with some embodiments of the present invention.
Figure 6:
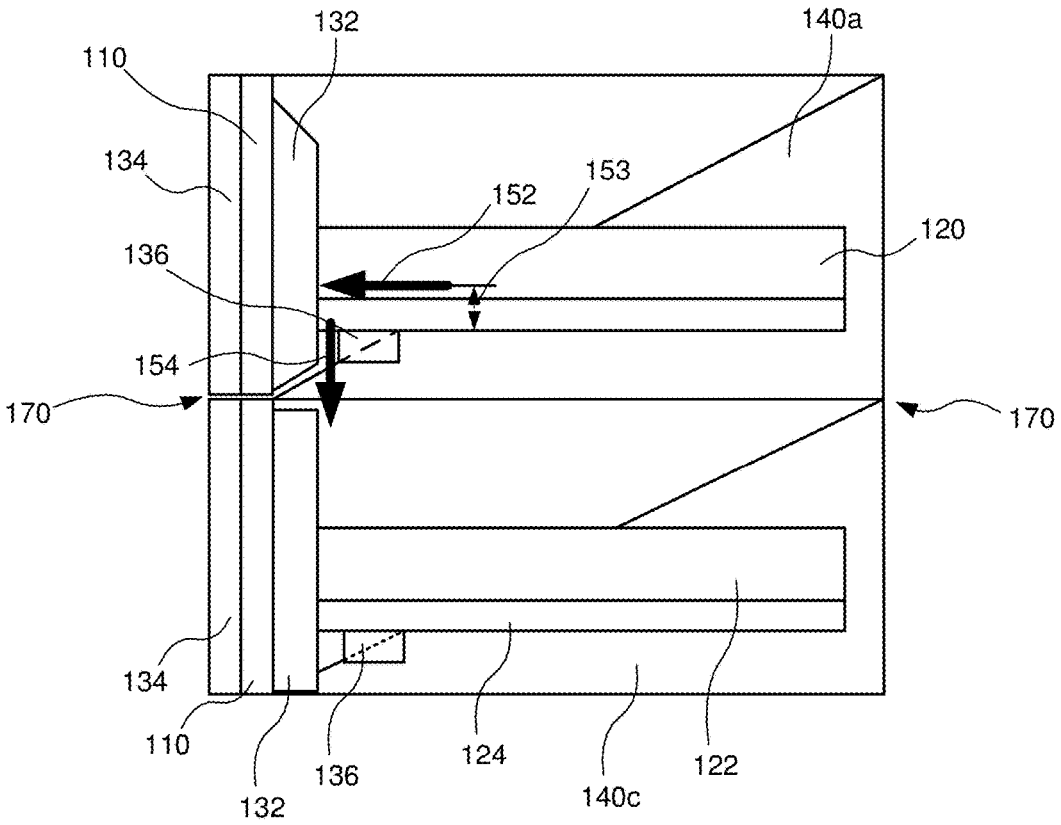
FIG. 6 is a side view illustrating a distribution of tiers of wall panels in accordance with some embodiments of the present invention.

Embodiments described herein allow for the coupling of the counterfort beam 120 at an elevated location such that the bottom surface of the counterfort flange 124 is above a bottom edge of the face joint member or the horizontal junction between tiers. FIG. 4 depicts L-shaped counterfort members 121 in which the bottom surface of the counterfort members 121 is at the same elevation as the bottom edge of the face joint member 130 or the horizontal junction between tiers. FIGS. 2 and 6 depict the counterfort beams 120 as elevated above the horizontal junction between tiers.

Each face joint member 130 is coupled to a counterfort beam 120*a* on the lower tier. Once coupled, the backfill 140 is replaced within any slot cut 141 and elsewhere and to cover the counterfort beams 120*a*. After finishing the lower tier, the upper tier is constructed and this process is repeated until the wall is constructed tier by tier.

The forces exerted on the wall and transferred back to the soil through the counterfort beams 120 is briefly explained with reference to FIG. 4. FIG. 4 is a top view of wall panels 110, face joint members 130, and counterfort beam 120. The soil exerts a generally uniformly distributed load (depicted as arrows 150 in FIG. 4) on the rear panel faces of the wall panels 110 which push the wall panels 110 out and against the joint flange 134 of the face joint members 130. The generally distributed load (arrows 150) results in an equivalent resultant load (depicted as arrows 152) on the face joint members 130. The face joint members 130 are coupled to the counterfort beams 120 which extend back into the backfill 140 and the backfill forces and which hold the face joint members 130 in place as the backfill 140 resists displacement of the counterfort beams 120.

Figure 5:
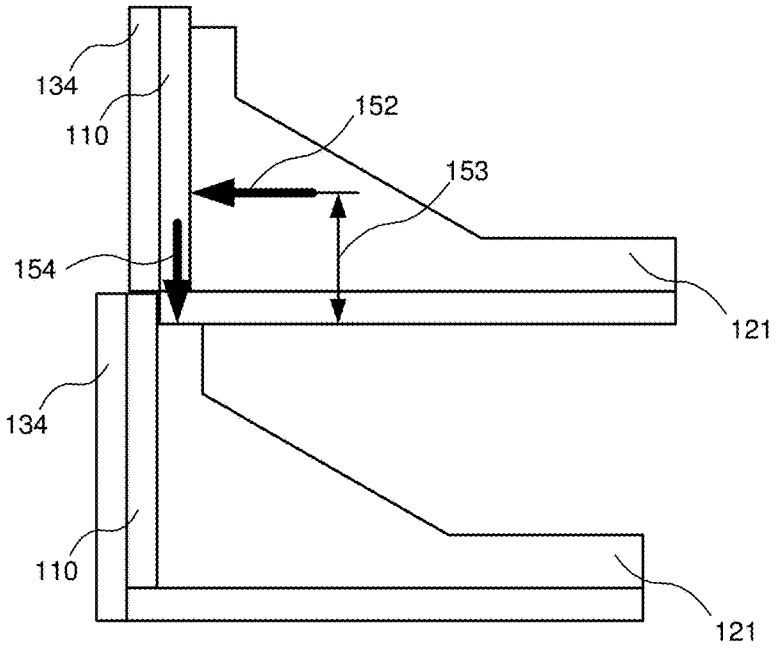
FIG. 5 is a side view illustrating L-shaped counterforts and a distribution of tiers of wall panels.

Referring now to FIG. 5, L-shaped counterfort members 121 are depicted. The L-shaped counterfort members 121 have various drawbacks. First, the larger members result in higher material costs to manufacture and higher shipping costs as well. Second, the L-shaped counterfort members 121 are positioned with the bottom surface of the counterfort members 121 at approximately the bottom surface of the face joint member 130 or the horizontal junction. This results in two main problems: (1) the need to make a deeper slot cut in the backfill to place the counterfort member 121; and (2) larger vertical loads exerted on lower tiers of wall panels. The larger vertical load is explained briefly with reference to FIG. 5.

As discussed above, a resultant load (depicted as arrow 152) is exerted on the face joint members 130. The equivalent resultant load is exerted at a distance above the bottom surface of the counterfort member 121. This distance is depicted by arrow 153. The moment of the resultant load is the distance times the resultant load. The moment exerts a rotational force on the assembly. This rotational force induces a vertical imposed surcharge pressure (depicted as arrow 154) which is exerted on the lower tier. The vertical imposed surcharge pressure may exert larger and larger loads on lower tiers. For this reason, many designs of retaining walls utilize offset wall tiers or are limited on tier height.

In contrast, referring now to FIG. 6, a counterfort beam 120 is coupled to the face joint member 130 at an elevated position. That is, the bottom surface of the counterfort beam 120 is elevated above the horizontal junction 170 between wall tiers. Put another way, the bottom surface of the counterfort beam 120 is elevated above the bottom surface of the face joint member 130. This helps reduce the depth of a slot cut 141 necessary to place the counterfort beam 120 greatly reducing installation time and labor. In addition to reducing the depth of a slot cut 141 the elevated counterfort beam 120 allows for a reduction in the vertical imposed surcharge pressure.

Similar to what is discussed in conjunction with FIG. 5, a resultant load (depicted as arrow 152) is exerted on the face joint members 130. The equivalent resultant load is exerted at a distance above the bottom surface of the counterfort beam 120. This distance is depicted by arrow 153. The moment of the resultant load is the distance times the resultant load. The moment exerts a rotational force on the assembly. As is seen, the moment arm distance is reduced dramatically which results in a lower magnitude moment. This rotational force induces a vertical imposed surcharge pressure (depicted as arrow 154) which is exerted on the lower tier but the vertical imposed surcharge pressure is greatly reduced and is a function of the height at which the counterfort beam 120 is attached. See also FIGS. 82 and 83 and associated description.

As the counterfort beam 120 is coupled at an elevated position, a first end of the counterfort beam 120 extends out and above the compressed backfill 140*a* (or the in situ material 140*c* for the lower counterfort beam). That is, the first end of the counterfort beam 120, at which the counterfort beam 120 is coupled to the face joint member 130, may not be supported by the compacted backfill 140*a* (or in situ material 140*c*) in some cases. A void 177 exists (see FIG. 2). To compensate for the void 177, embodiments of the invention include options such as a void replacement member 136. The optional void replacement member 136 rests in the compacted backfill 140*a* and extends up to support the counterfort flange 124.

The void replacement member 136 may be made of formed material or confined compacted material that is compacted after placement of the counterfort beam 120. The void replacement member 136, in one embodiment, by eliminating the void that would otherwise exist, provides adequate bearing capacity as the void replacement member 136 supports the front portion of the counterfort beam 120 while the rear portion is supported by the compacted backfill 140*a* on a horizontal plane 147 formed within a trench.

Figure 3:
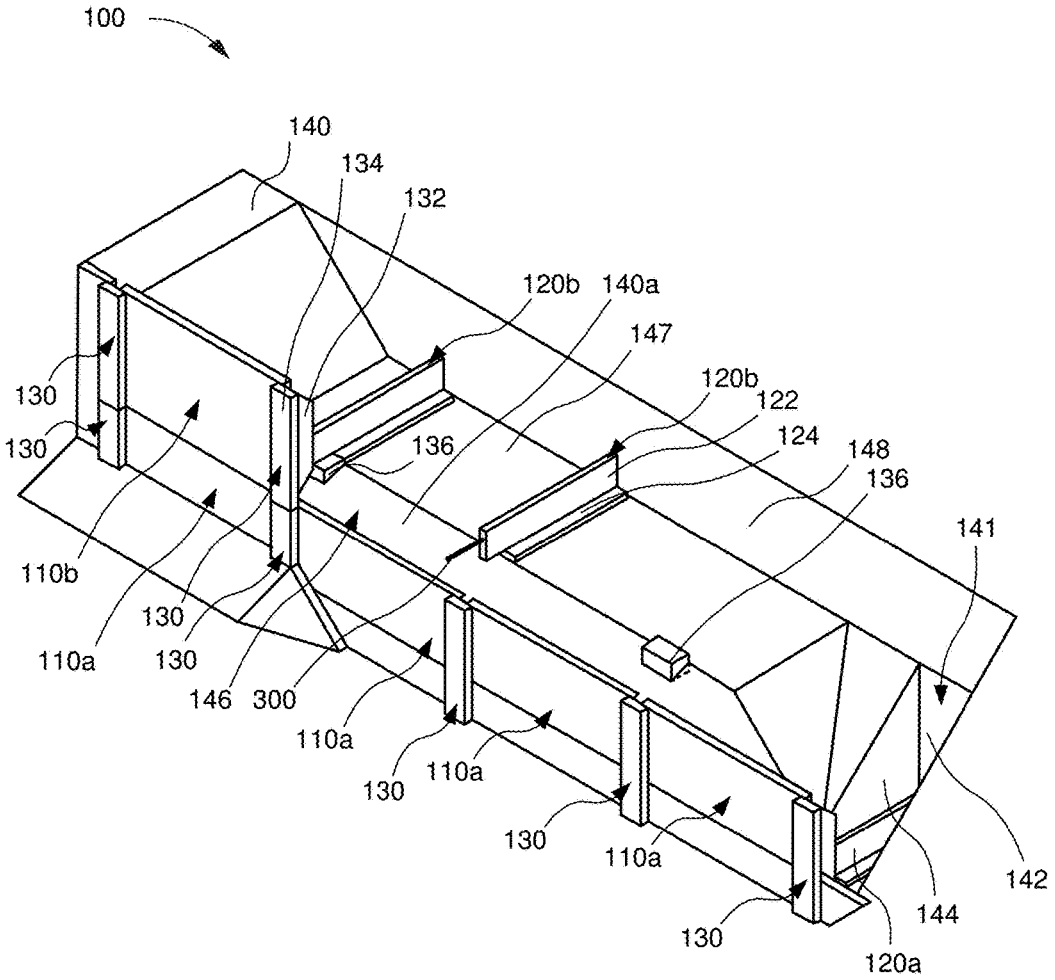
FIG. 3 is a perspective view illustrating another embodiment of a counterfort wall system in accordance with some embodiments of the present invention.

Referring now to FIG. 3, a perspective view illustrating another embodiment of a counterfort retaining wall 100 is shown. In the illustrated embodiment, the counterfort beams 120*b* and the void replacement member 136 vary from previously described members. In FIG. 1B, the counterfort flange 124 and the counterfort web 122 span an entirety of a length of the counterfort beam 120. In FIG. 3, the reduced length counterfort flange 124 does not span an entirety of the length of the counterfort beam 120. As is shown, the counterfort flange 124 does not extend out to overhang the compressed backfill 140*a*.

In some embodiments, the void replacement member 136 extends higher. In the illustrated embodiment of FIG. 3, the void replacement member 136 supports the counterfort beam 120 at the counterfort web 122 as the counterfort flange 124 does not extend the entirety of the length of the counterfort beam.

As the area of contact between the void replacement member 136 and the bottom of the counterfort web 122 of the counterfort beam 120*b* is minimized as compared to the embodiment depicted in FIG. 1B, there is a minimal degree of field leveling or grade adjustment required between the two members. Since there is a minimal contact/bearing area, in some embodiments, there will be a negligible requirement for grouting at the contact/bearing area. This would typically not be the case for the larger contact/bearing area for the previously shown and described void replacement of FIG. 1B. Such a combination is a viable and potentially cost saving option also since there is a reduced amount of structural concrete.

Figure 7:
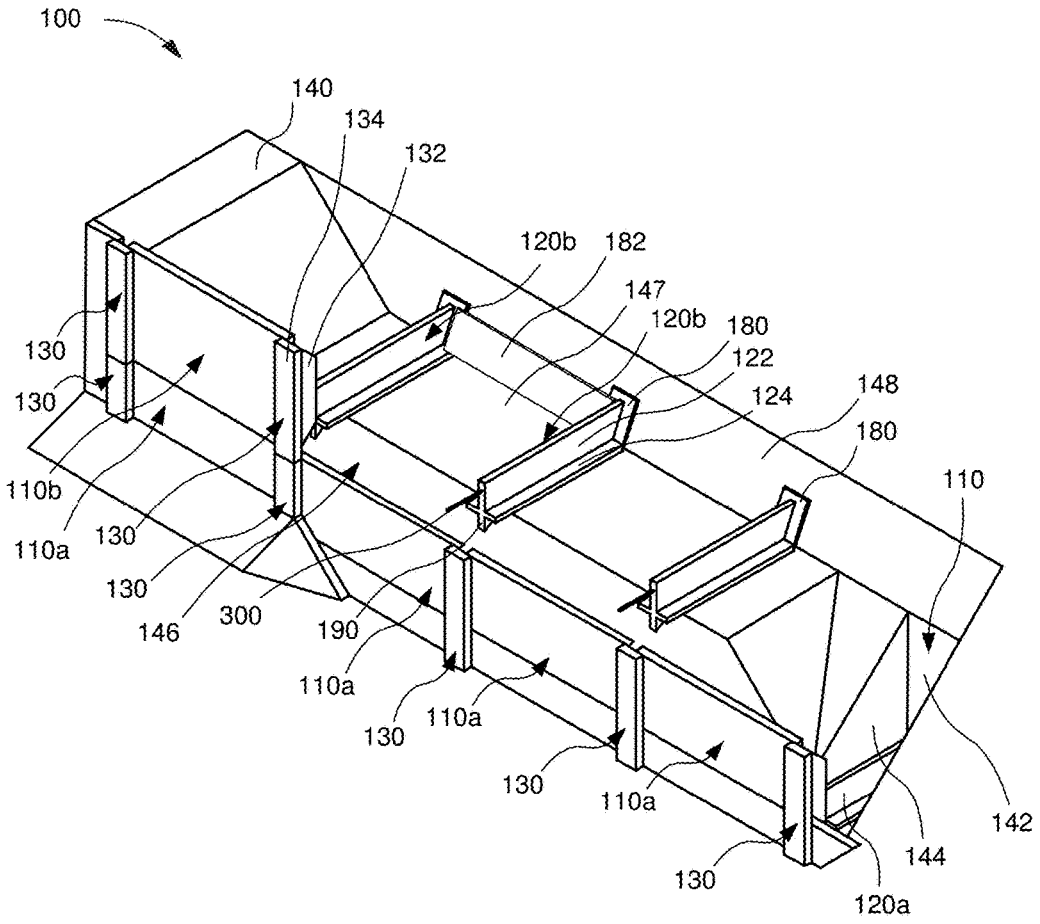
FIG. 7 is a perspective view illustrating another embodiment of a counterfort wall system in accordance with some embodiments of the present invention.

Referring now to FIG. 7 a perspective view illustrating another embodiment of a counterfort retaining wall 100 is shown. In the illustrated embodiment, the counterfort beams 120*b* includes extended web 190. The extended web 190 is an extension of the counterfort web 122 in which a portion extends through the counterfort flange 124 and out the bottom of the counterfort beam 120.

The extended web 190, in one embodiment, is a triangular shaped web that extends down to contact the sloped surface 146 of the compacted backfill 140*a*. The extended web 190 may eliminate the need for a void replacement member 136, in some embodiments, because the extended web 190 contacts the sloped surface 146 and rests on the compacted backfill 140*a*. After placement of the counterfort beam 120, the backfill 140 under the counterfort flange 124 may be compacted or pushed with tampers or compactors. The extended web 190 acts as a barrier or stop for compacting the backfill under the counterfort flange 124.

In the illustrated embodiment, the counterfort beams 120 further includes inclined rear panels 180. The inclined rear panels 180, in some embodiments, are inclined and extend away from the counterfort flange 124. In some embodiments, the inclined rear panels 180 have the same width as the counterfort flange 124. In some embodiments, the inclined rear panels 180 are narrower than the counterfort flanges 124. In some embodiments, the inclined rear panels 180 are wider than the counterfort flanges 124.

In some embodiments, the inclined rear panels 180 are inclined to closely correspond to the face of and match the sloped excavated cut 148 behind the counterfort beam 120*b*. The inclined rear panels 180 will typically be approximately the same orientation as and will be roughly parallel to the angle of the face of the sloped excavation cut 148. In some embodiments, the inclined rear panels 180 are offset from the counterfort flange 124 by an angle of forty-five degrees. In some embodiments, the inclined rear panels 180 are offset from the counterfort flange 124 by an angle of approximately sixty degrees. In some embodiments, the inclined rear panels 180 extend above the counterfort web 122 as is depicted in FIG. 7. The angle of the inclined rear panels 180 may be adjusted to correspond to the angle or slope of the excavated cut 148 behind a counterfort beam 120.

The inclined rear panels 180 increase the safety factors for pullout because the inclined rear panels 180 provide more surface area and are oriented so that the resultant opposing loads are approximately normal to the inclined rear panel 180. Some embodiments further include an anchor panel 182 which is placed at the second end of the counterfort beam 120 between two adjacent counterfort beams 120. The anchor panel 182, in one embodiment, rests on the edges of the inclined rear panels 180. The anchor panel 182, in some embodiments, may be attached to the inclined rear panels 180. The increased surface area provided by further increase safety factors. Although described in conjunction with FIG. 7, the inclined rear panels 180 can be utilized with the other embodiments described herein.

Figure 8:
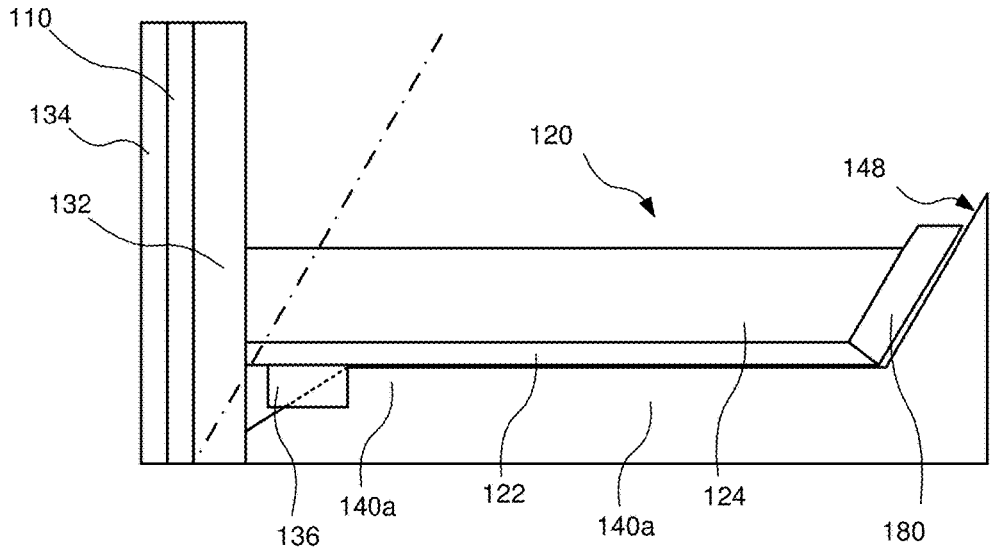
FIG. 8 is a side view of a counterfort beam including an inclined rear panel in accordance with some embodiments of the present invention.
Figure 9:
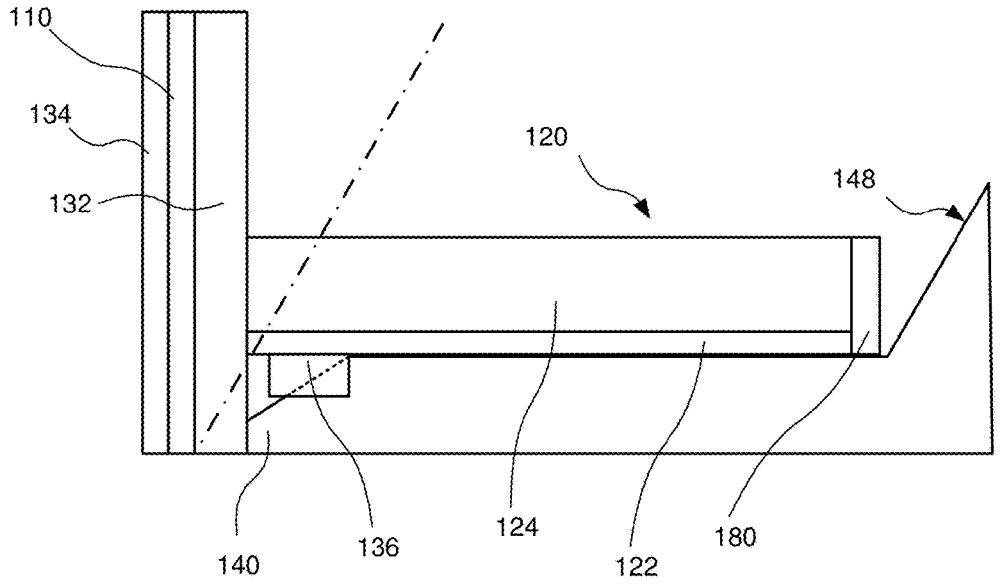
FIG. 9 is a side view of a counterfort beam including a vertical rear panel in accordance with some embodiments of the present invention.

Referring now to FIGS. 8 and 9, the inclined rear panel 180 of FIG. 8 is contrasted with vertical rear panel 180 which is shown in FIG. 9. The sloped excavation cut 148 and the slot cut 141 (not shown in FIG. 8 or 9) for both embodiments shown in FIG. 8 and FIG. 9 are approximately the same but the inclined rear panel 180 of FIG. 8 provides resistance from rotational forces as the surface area is increased, due to the inclined orientation, as well as the moment arm of the force loading down the rear panels from backfill 140 that is placed over the counterfort beams 120.

Since the counterfort beam 120 of FIG. 8 extends to or near to the sloped excavation cut 148 of the existing embankment, the effective base length of the counterfort beam 120 is the overall base length. In other words, the inclined rear panels 180 allow for longer counterfort beams 120 within the same width sloped excavation cut 148.

Conversely, for the vertical rear panel 180 of FIG. 9, the counterfort base length is required to be shorter since there would be interference with the sloped excavation cut 148. For those not skilled in the art it may not be obvious that the inclined rear panels 180 result in an effectively longer base length than counterfort base length for the vertical rear panels 180 (see, for example vertical rear panel 180*a* in FIG. 10). So, due to the effectively longer base length, critical geotechnical and structural criteria will have higher safety factors with the use of the inclined rear panels 180 compared to those for vertical rear panels 180. Although the vertical rear panels 180 could be used it would typically require that the excavation extend further into the embankment to accommodate the longer equivalent length of the vertical rear panels 180. Therefore, since the use of the vertical rear panels 180 requires more excavation and fill, such an option would typically not be considered due to both the associated reduced safety factors and higher excavation and fill costs.

Figure 10:
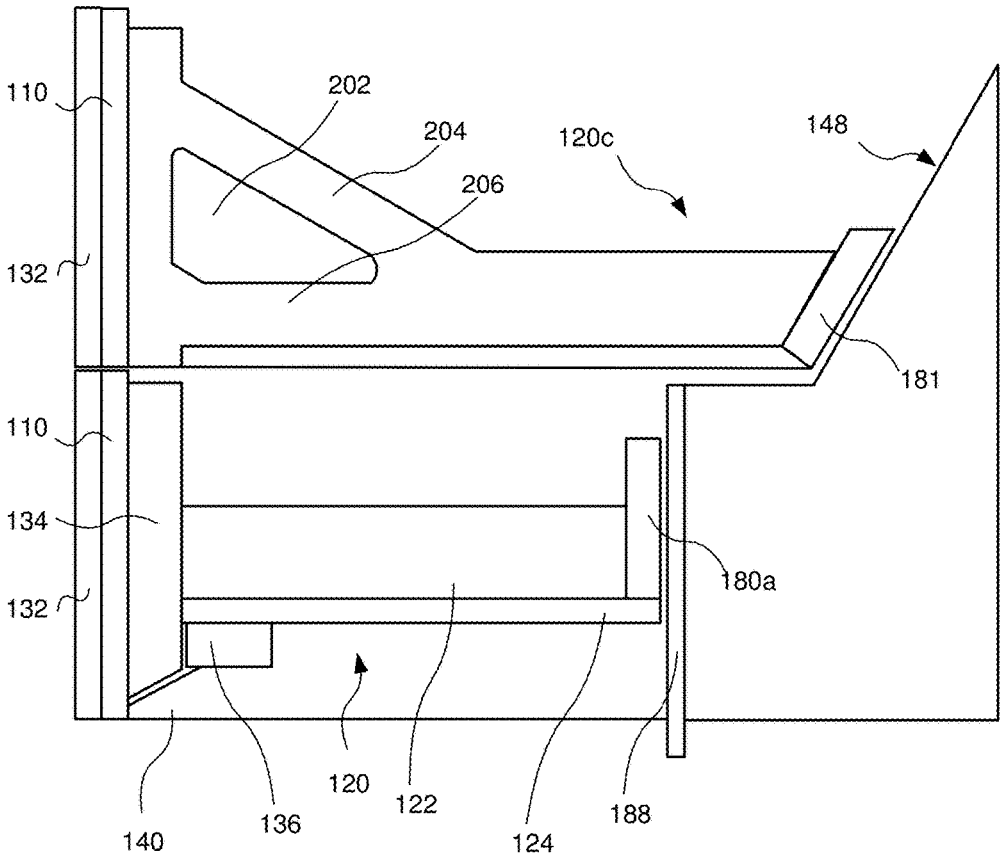
FIG. 10 is a side view illustrating a first and second tier in a counterfort wall system in accordance with some embodiments of the present invention.

Referring to FIG. 10, an alternate vertical section of a two-tier vertical counterfort wall is shown. The lower or base tier utilizes vertical rear panel 180*a*, due to the limited base length restriction, and because of the required temporary shoring 188 the vertical rear panel option can be a preferred option per specific site conditions. A counterfort beam 120 with an essentially vertically oriented rear panel 180*a* is shown wherein the upper portion of the essentially vertically oriented rear panel 180*a* extends above the counterfort web 122.

A non-elevated base L-shaped counterfort 120*c* is shown utilized for the top tier. The non-elevated base L-shaped counterfort 120*c* includes a variable inclined rear panel 181. The non-elevated base L-shaped counterfort 120*c* is an appropriate optional counterfort profile for wall sites where the allowable soil bearing capacity is adequate for the higher overturning vertical load which is typical for the non-elevated base L-shaped counterfort 120*c*. Since the non-elevated base L-shaped counterfort 120*c* does not require a confined, non-compressible, void replacement member, it will typically be cost effective to use the non-elevated base L-shaped counterfort 120*c* where the site conditions are appropriate.

The non-elevated base L-shaped counterfort 120*c* shown for this example utilizes an optional counterfort web void 202. Due to the counterfort web void 202 a reduction of the counterfort mass and associated reduction in concrete volume and reinforcement is reduced to a minimum. An upper slope arm 204 segment and the lower base segment 206 in conjunction with the counterfort face form a structural truss, which may include equivalent strength characteristics to that of a monolithically cast non-elevated base L-shaped counterfort without a counterfort web void 202. Where used, the counterfort web void 202 may result in reduced costs for the non-elevated base L-shaped counterfort.

Figure 11:
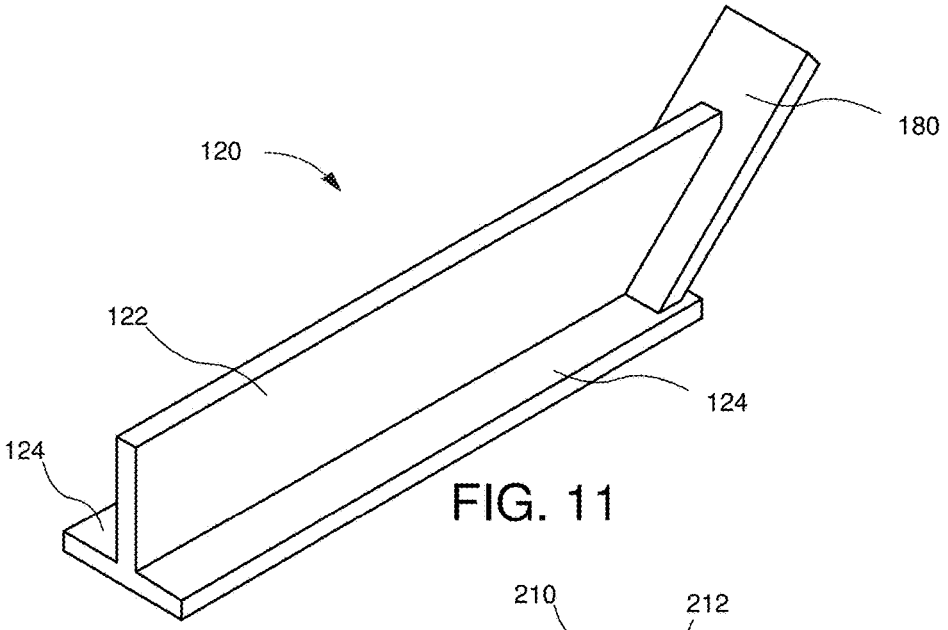
FIG. 11 is a perspective view of a counterfort beam including an inclined rear panel in accordance with some embodiments of the present invention.
Figure 12:
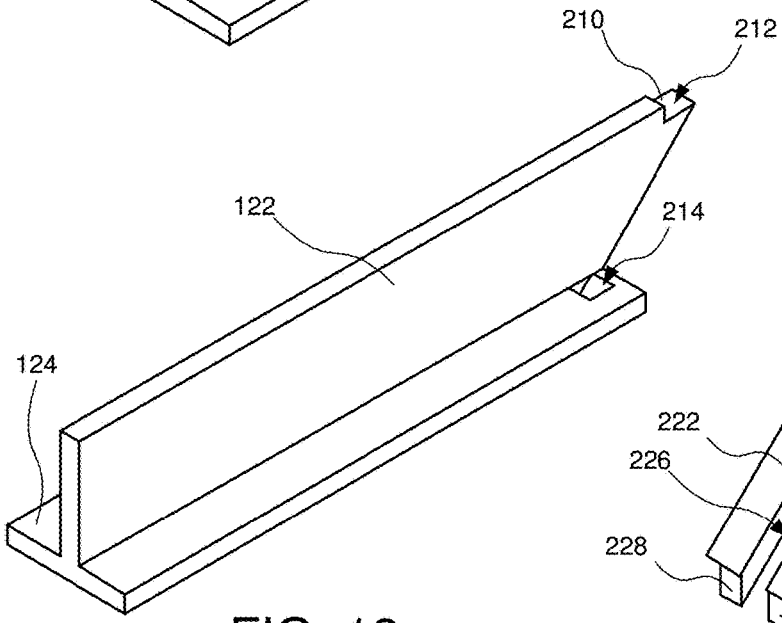
FIG. 12 is a perspective view of the counterfort beam of FIG. 11 with the inclined rear panel removed in accordance with some embodiments of the present invention.

Referring to FIG. 11, a two-piece counterfort beam 120 is shown. The counterfort beam 120 includes a counterfort web 122 and counterfort flange 124 and a detachable inclined rear panel 180. Referring to FIG. 12, the counterfort beam 120 includes a vertical notch 210 with a bearing surface 212 located at an end of the counterfort web 122. The inclined rear panel 180 rests on the bearing surface 212. The counterfort flange 124 includes two void pockets 214 located on an upper surface of the counterfort flange 124 on either side of the counterfort web 122.

Figure 13:
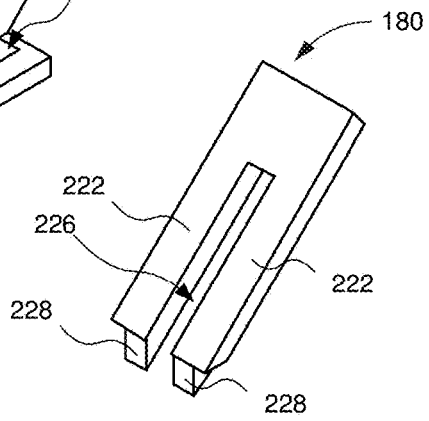
FIG. 13 is a perspective view of the rear panel in accordance with some embodiments of the present invention.

Referring to FIG. 13, the separate inclined rear panel 180 is shown. The inclined rear panel 180 includes two prongs 222 with a slot 226 between the prongs 222. The prongs 222 are configured to straddle each side the counterfort web 122 and the prongs 222 are configured to extend down to the counterfort flange 124. The two prongs include knobs 228 at the base of the prongs 222. The knobs 228 are configured to be inserted into the void pockets 214 in the counterfort flange 124. As shown in FIG. 11, the inclined rear panel 180 couples to the counterfort flange 124 and counterfort web 122 to form a counterfort beam 120 with an inclined rear panel 180. In some embodiments, the inclined rear panel is a separate piece. In some embodiments, the inclined rear panel is integral to the counterfort beam 120. One of skill in the art will recognize other ways to attach the inclined rear panel 180 to the counterfort beam 120.

Figure 49:
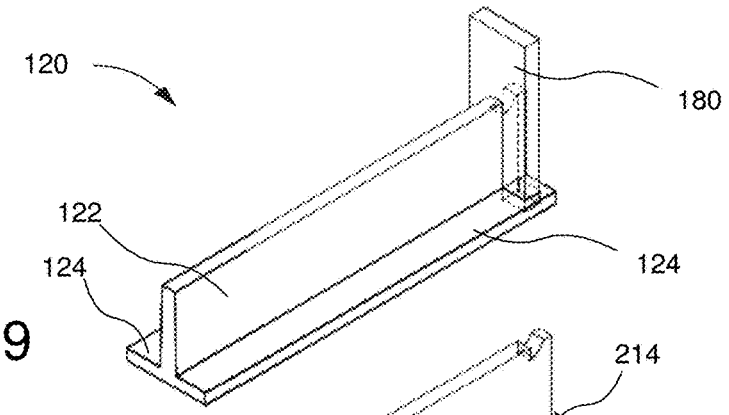
FIG. 49 is a perspective view of a counterfort beam including a rear panel in accordance with some embodiments of the present invention.
Figure 50:
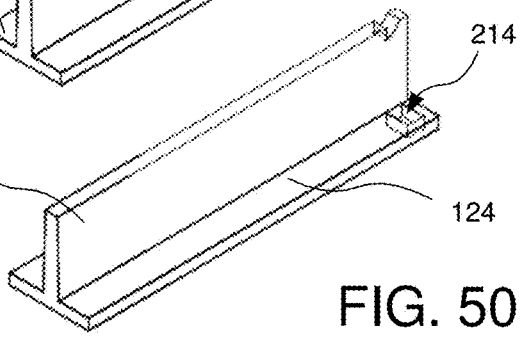
FIG. 50 is a perspective view of the counterfort beam of FIG. 49 with the rear panel removed in accordance with some embodiments of the present invention.
Figure 51:
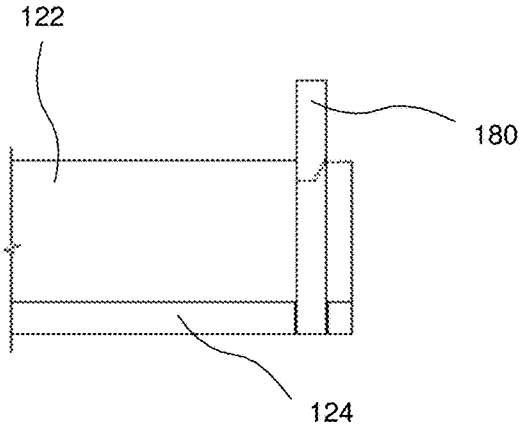
FIG. 51 is a side view of the counterfort beam including the rear panel in accordance with some embodiments of the present invention.

Referring to FIGS. 49 and 51, a two-piece counterfort beam 120 is shown. The counterfort beam 120 includes a counterfort web 122 and counterfort flange 124 and a detachable rear panel 180. Referring to FIG. 50, the counterfort beam 120 includes a vertical notch located at an end of the counterfort web 122. The rear panel 180 rests on the notch. The counterfort flange 124 includes two void pockets 214 located on an upper surface of the counterfort flange 124 on either side of the counterfort web 122.

Figure 52:
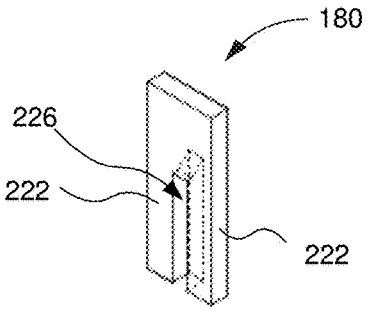
FIG. 52 is a perspective view of the rear panel in accordance with some embodiments of the present invention.

Referring to FIG. 52, the separate rear panel 180 is shown. The rear panel 180 includes two prongs 222 with a slot 226 between the prongs 222. The prongs 222 are configured to straddle each side the counterfort web 122 and the prongs 222 are configured to extend down to the counterfort flange 124. The two prongs are configured to be inserted into the void pockets 214 in the counterfort flange 124. As shown in FIG. 49, the rear panel 180 couples to the counterfort flange 124 and counterfort web 122 to form a counterfort beam 120 with a rear panel 180 orthogonal to the counterfort flange 124. In some embodiments, the rear panel is a separate piece. In some embodiments, the rear panel is integral to the counterfort beam 120. One of skill in the art will recognize other ways to attach the rear panel 180 to the counterfort beam 120

Figure 14:
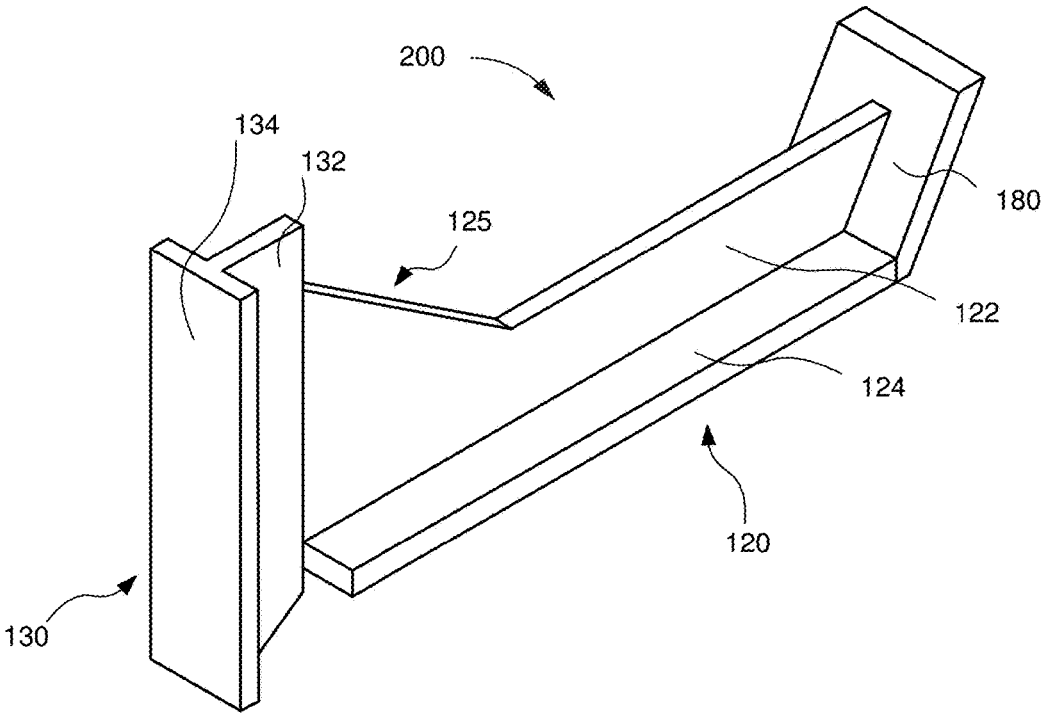
FIG. 14 is a perspective view of a counterfort beam and face joint member in accordance with some embodiments of the present invention.

Referring to FIG. 14, a counterfort assembly 200 is shown with a counterfort beam 120 coupled to a face joint member 130. In the illustrated embodiment, the counterfort web 122 is coupled to the joint web 132 of the face joint member 130. The counterfort web 122 includes an upper extended web 125 at a first end of the counterfort beam 120. The extended web 125 increases the contact area between the counterfort web 122 and the joint web 132 which may provide increased stability. The counterfort beam 120 is a monolithically one-piece cast which eliminates the interfaces and interconnections described in conjunction with FIGS. 11-13.

Figure 15:
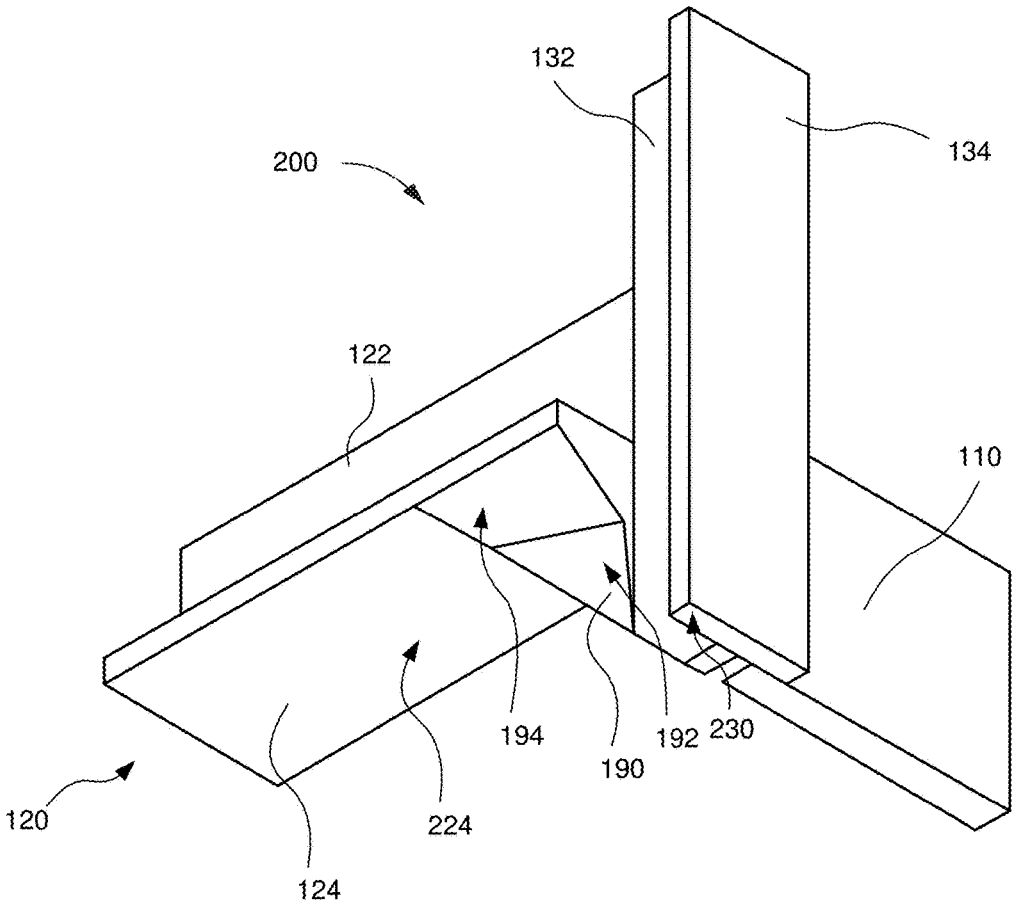
FIG. 15 is a perspective view of a counterfort beam and face joint member in accordance with some embodiments of the present invention.
Figure 16:
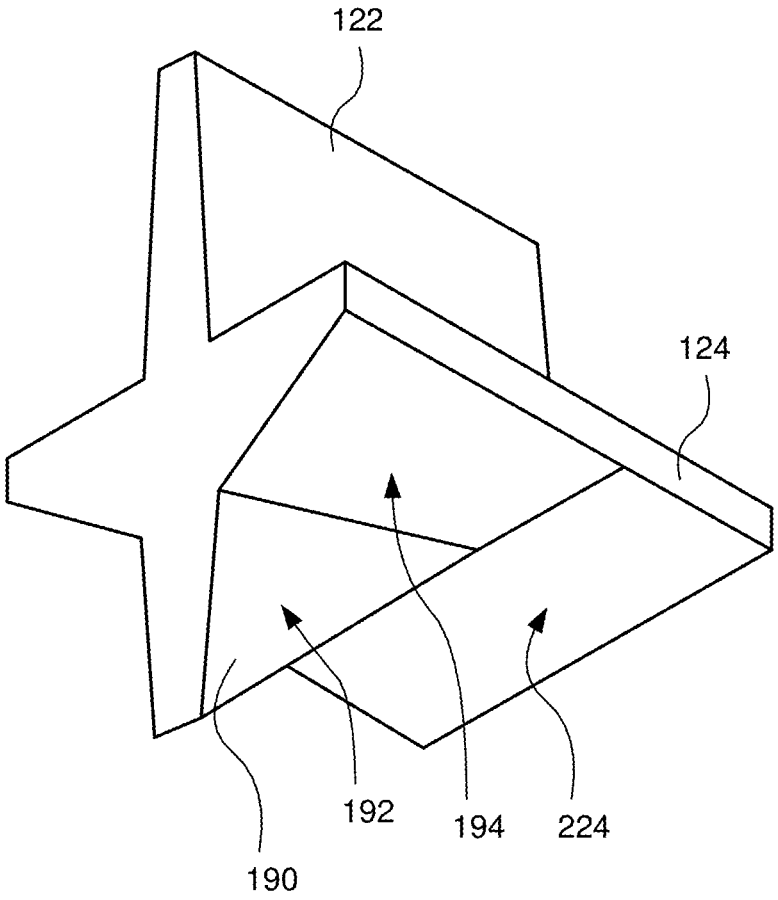
FIG. 16 is a perspective view of a counterfort beam in accordance with some embodiments of the present invention.

Referring to FIG. 15, a counterfort assembly 200 is shown with a counterfort beam 120 coupled to a face joint member 130. FIG. 16 depicts a truncated representation of the counterfort beam 120 of FIG. 15. The counterfort beam 120 includes an extended web 190. The extended web 190 is an extension of the counterfort web 122 in which a portion extends through the counterfort flange 124 and out the bottom of the counterfort beam 120. In the illustrated embodiment, instead of a horizontal bottom surface similar to the bottom surface 224 of the counterfort flange 124, there is a downward sloping face 194 which better allows for the fill material to be placed and compacted after the counterfort beam 120 is coupled to the face joint member 130. Once coupled, it is difficult to see under the counterfort flange 124 but the downward sloping face 194 and vertical sloping face 192 allow for the fill to be compacted underneath the counterfort flange 124.

As is depicted in FIG. 15, the bottom surface 224 of the counterfort flange 124 is elevated above the bottom surface 230 of the face joint member 130. The elevated counterfort beam 120 offers benefits to the assembly that allow for more cost effective walls to be built which can have reduced vertical loads on lower tiers.

Figure 17:
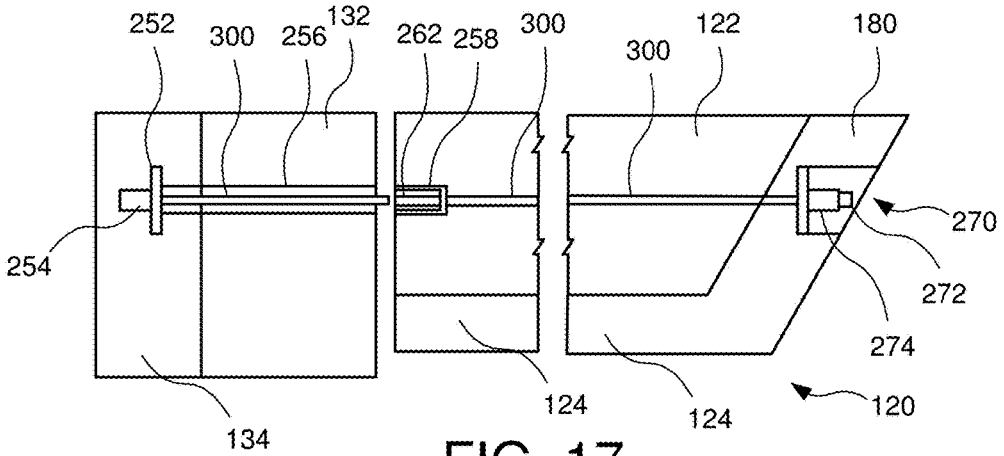
FIG. 17 is a side view of one embodiment of a coupling of a counterfort beam and a face joint member in accordance with some embodiments of the present invention.
Figure 18:
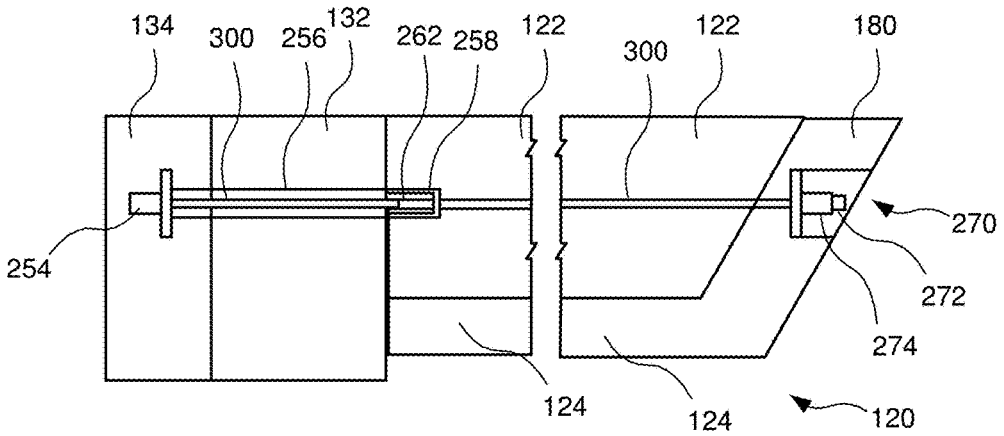
FIG. 18 is a side view of a coupling of a counterfort beam and a face joint member in accordance with some embodiments of the present invention.

Referring to FIGS. 17 and 18, one embodiment of a coupling mechanism is shown. The coupling mechanism, which employs a sleeved threadbar 300, couples the counterfort beam 120 to the face joint member 130. In the illustrated embodiment, the coupling mechanism includes an end plate 252 and a post tension nut 254. In some embodiments, the post tension nut 254 is welded to the end plate 252. The end plate 252 and the post tension nut may be cast into the face joint member 130. A duct segment 256 may also be cast into the face joint member 130. A sleeved threadbar 300 segment is shown threaded into the post tension nut 254 within the duct segment 256. The end of the sleeved threadbar 300 extends slightly out from the back of the face joint member 130 exposing threads. In some embodiments, the duct segment 256 is corrugated. References to a threadbar herein may, in some embodiments, include stainless or equivalent corrosion resistant connection means.

The counterfort beam 120 is also shown horizontally displaced from the back of the face joint member 130 by a distance. The counterfort beam 120, in one embodiment, includes a corrugated duct segment 258 cast into the counterfort beam 120 and a sleeved threadbar 300 extending throughout the counterfort beam 120. The sleeved threadbar 300 is coupled to a post tension coupler 274 and a stop nut 272 at an access opening 270 located in the inclined rear panel 180. In one embodiment, the sleeved threadbar 300 includes an inner metal threaded bar 302 with an outer protective sleeve 306 with a grease layer 304 between the inner metal threaded bar 302 and the outer protective sleeve 306.

Figure 19:
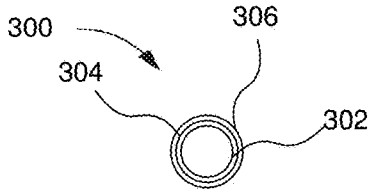
FIG. 19 is a cross sectional view of a threadbar in accordance with some embodiments of the present invention.

A post tension coupler 274 is shown threaded onto the end of the exposed portion of the sleeved threadbar 300 in the access opening 274 at the rear of the inclined rear panel 180. A stop nut 272 is shown threaded into the post tension coupler 274 to temporarily lock the post tension coupler 274 onto the exposed portion of the sleeved threadbar 300. Referring to FIG. 19, a cross section of the sleeved threadbar 300 is shown. In an embodiment, the sleeved threadbar 300 includes a surrounding polymer outer protective sleeve 306 is shown surrounding and encapsulating the protective grease layer 304. A section of the surrounding polymer outer protective sleeve 306 has been removed from the end section of the sleeved threadbar bar 300 over the length of the post tension coupler 274 so that the post tension coupler 274 can be threaded onto the exposed steel end (not shown) of the sleeved threadbar 300.

To secure the face joint member 130 to the elevated counterfort beam 120, the stop nut 272 is rotated which turns the inner metal threaded bar 302. The post tension coupler 274 within the corrugated duct segment 258 segment rotates as the inner metal threadbar 302 in the sleeved threadbar 300 rotates. The protective grease layer 162 facilitates the rotation of the inner metal threadbar 302 within the polymer outer protective sleeve 306.

As the post tension coupler 274 is rotated, the exposed end of the inner metal threaded bar 302 that extends from the back of the counterfort beam 120, will become engaged to the interior (female) threads of the post tension coupler 274 as the face joint member 130 is slowly advanced toward the counterfort beam 120. Since the end plate 252 is welded to the post tension nut 254 that cast in assembly will not rotate as the inner metal threaded bar 302 is rotated. When the thread engagement distance has been achieved, a post tensioning device may be attached to the post tension coupler 274 in the access opening 270 to apply the required post tensioning force to the sleeved threadbar 300.

After the design post tensioning preload force is applied, which is typically referred to as the lock off load by those skilled in the art, the face joint member 130 and the counterfort beam 120 result in a combined unit that is structurally equivalent to a monolithic counterfort unit following pressure grout injection into the corrugated duct segments 256 and 258 to fully encapsulate the sleeved threadbar 300. Prior to field installation, in one embodiment the access opening 270 may also be filled with dry pack fill grout so that all surfaces of the steel post tensioning components are encapsulated in grout.

For some embodiments, the access opening 270 is on the front face of the wall so that any dry packed grout would be visible. In the illustrated embodiment, having a rear post tensioning access opening 270 provides aesthetic options for the wall.

Although described with the above fastening components, the sleeved threadbar 300 may include fewer or more components and/or alternative fastening components to couple the counterfort beam 120 and the face joint member 130.

Figure 24:
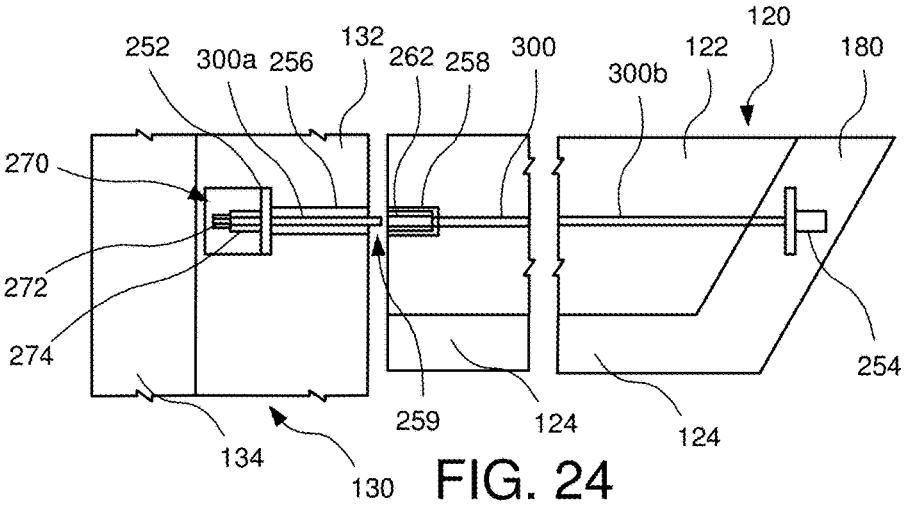
FIG. 24 is a side view of one embodiment of a coupling of a counterfort beam and a face joint member in accordance with some embodiments of the present invention.
Figure 25:
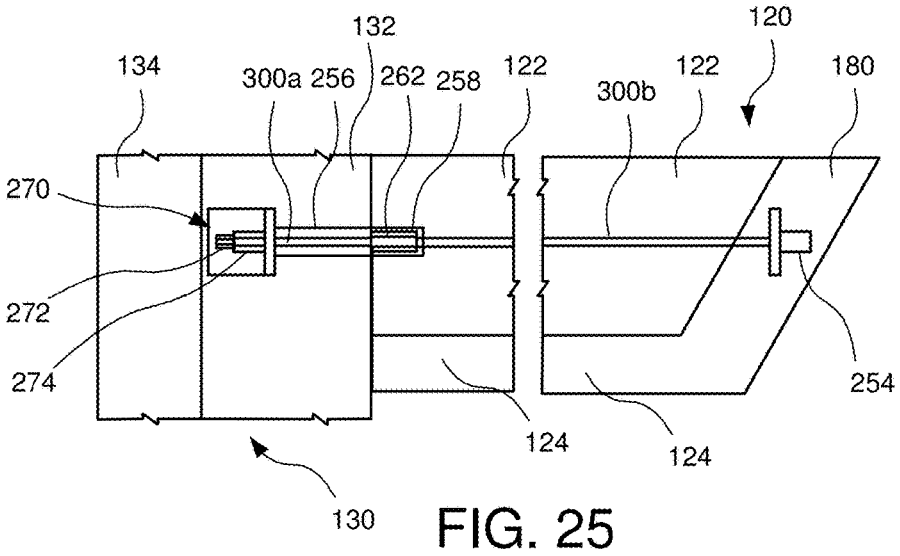
FIG. 25 is a side view of a coupling of a counterfort beam and a face joint member in accordance with some embodiments of the present invention.

Referring now to FIGS. 24 and 25, one embodiment of a coupling mechanism is shown. The coupling mechanism, which employs a sleeved threadbar 300, couples the counterfort beam 120 to the face joint member 130. In the illustrated embodiment, the sleeved threadbar 300 includes a first segment 300*a* and a second segment 300*b*. The first segment 300*a* is positioned within the face joint member 130 with an exposed portion 259 of the first segment 300*a* extending out the back of the joint web 132. The second segment 300*b* is positioned within the counterfort beam 120 and includes a coupler 262 configured to attach or otherwise couple the first segment 300*a* to the second segment 300*b*.

In the illustrated embodiment, the stop nut 272 and post tension coupler 274 are coupled to a first end of the first segment 300*a* of the sleeved threadbar 300. The stop nut 272 and post tension coupler 274 are positioned in the joint web 132 and are accessed through an access opening or post tensioning access opening 270. In addition, a post tension nut 254 at a second end of the second segment 300*b* of the sleeved threadbar 300 is cast into the inclined rear panel 180. As torque tensioning is applied at the first end of the sleeved threadbar 300 (within the post tensioning access opening 270), the first segment 300*a* of the threadbar 300 is secured into coupler 262.

As the sleeved threadbar 300 is tightened, the counterfort beam 120 and the face joint member 130 are compressed between the post tension nut 254 and the end plate 252. More specifically, in some embodiments, the inner metal threaded bar 302 is held in tension between the post tension nut 254 and the end plate 252. Because the inner metal threaded bar 302 is housed within the outer protective sleeve 306 (with a grease layer 304 between), the compression occurs at the ends of the sleeved threadbar 300.

After torque tensioning, the post tensioning access opening 270 may be dry packed with grout or other flowable fill means. In other embodiments, the access may be in the joint flange 134. In other embodiments, the access opening may be in the counterfort beam 120 and not in the face joint member 130.

In some embodiments, the sleeved threadbar 300 may be referred to as a connecting threadbar to distinguish from other threadbars used (such as the vertical web threadbar (described at least in conjunction with FIGS. 33 and 34) or the slab threadbar (described at least in conjunction with FIGS. 37 and 38)). Some embodiments include one or more connecting threadbars, one or more web threadbars, and one or more slab threadbars. In some embodiments, the counterfort beam 120 is coupled to the face joint member 130 by a connecting sleeved threadbar 300 that extends through the counterfort beam 120 and into the face joint member 130.

In some embodiments, the connecting sleeved threadbar 300 includes an inner metal threaded bar 302 and an outer protective sleeve 306. In some embodiments, the inner metal threaded bar 302 is configured to rotate relative to the outer protective sleeve 306. That is, the outer protective sleeve 306 may be cast into the concrete of the counterfort beam 120 and/or the face joint member 130 not allowing the outer protective sleeve to move or rotate relative to the counterfort beam 120 and/or the face joint member 130. However, the inner metal threaded bar 302 can move relative to the outer protective sleeve 306 as well as the counterfort beam 120 and/or the face joint member 130. This allows for tensioning of the concrete after casting and assembly of the counterfort beam 120 with the face joint member 130. In some embodiments, the connecting sleeved threadbar 300 includes a grease layer 304 between the inner metal threaded bar 302 and the outer protective sleeve 306 which allows for smoother relative movement between the inner metal threaded bar 302 and the outer protective sleeve 306.

In some embodiments, the connecting sleeved threadbar 300 includes a first segment 300*a* within the face joint member 130 and a second segment 300*b* positioned within the counterfort beam 120, wherein the first segment 300*a* is coupled to the second segment 300*b*. In some embodiments, the connecting sleeved threadbar 300 is a single element and is post tensioned by connecting the connecting sleeved threadbar 300 to a post tension coupler 274 located at one of the ends of the connecting sleeved threadbar 300.

In some embodiments, the face joint member 130 further includes a first corrugated duct segment 256. In some embodiments, the first segment 300*a* of the connecting sleeved threadbar 300 is positioned within the first corrugated duct segment 256. In some embodiments, the counterfort beam 120 further includes a second corrugated duct segment 258. In some embodiments, the second segment 300*b* of the connecting sleeved threadbar 300 is positioned within the second corrugated duct segment 258.

In some embodiments, a first end of the connecting threadbar is cast-in-place within either one of the face joint member 130 (see, for example, FIGS. 17 and 18) or the counterfort beam 120 (see, for example, FIGS. 24 and 25). The second end of the connecting sleeved threadbar 300 is coupled to a post tension coupler 274 in either one of the face joint member 130 (see, for example, FIGS. 24 and 25) or the counterfort beam 120 (see, for example, FIGS. 17 and 18).

In some embodiments, the counterfort beam 120 further includes an inclined rear panel 180 (see, for example, FIGS. 24 and 25). In some embodiments, the counterfort beam 120 further includes a vertical rear panel 180 (see, for example, FIG. 48).

Figure 33:
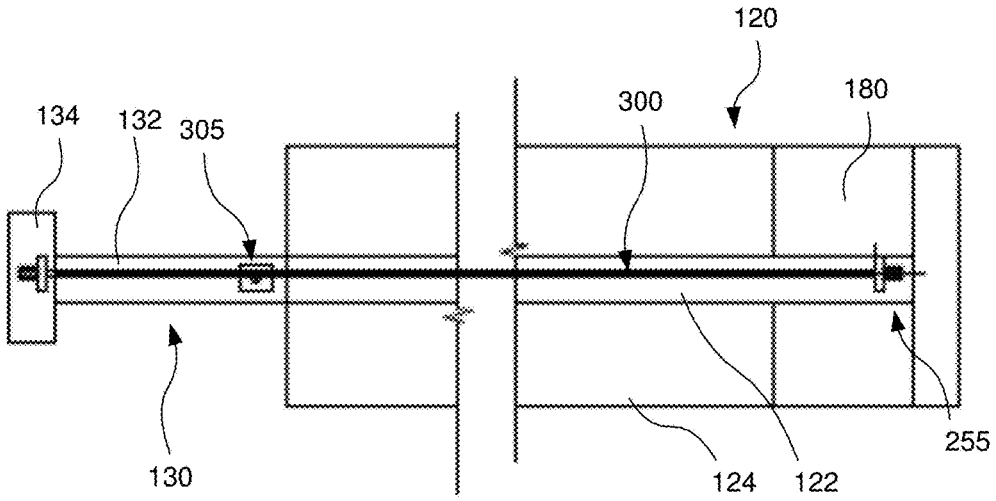
FIG. 33 is a top view illustrating a coupling of a counterfort beam and a face joint member in accordance with some embodiments of the present invention.
Figure 34:
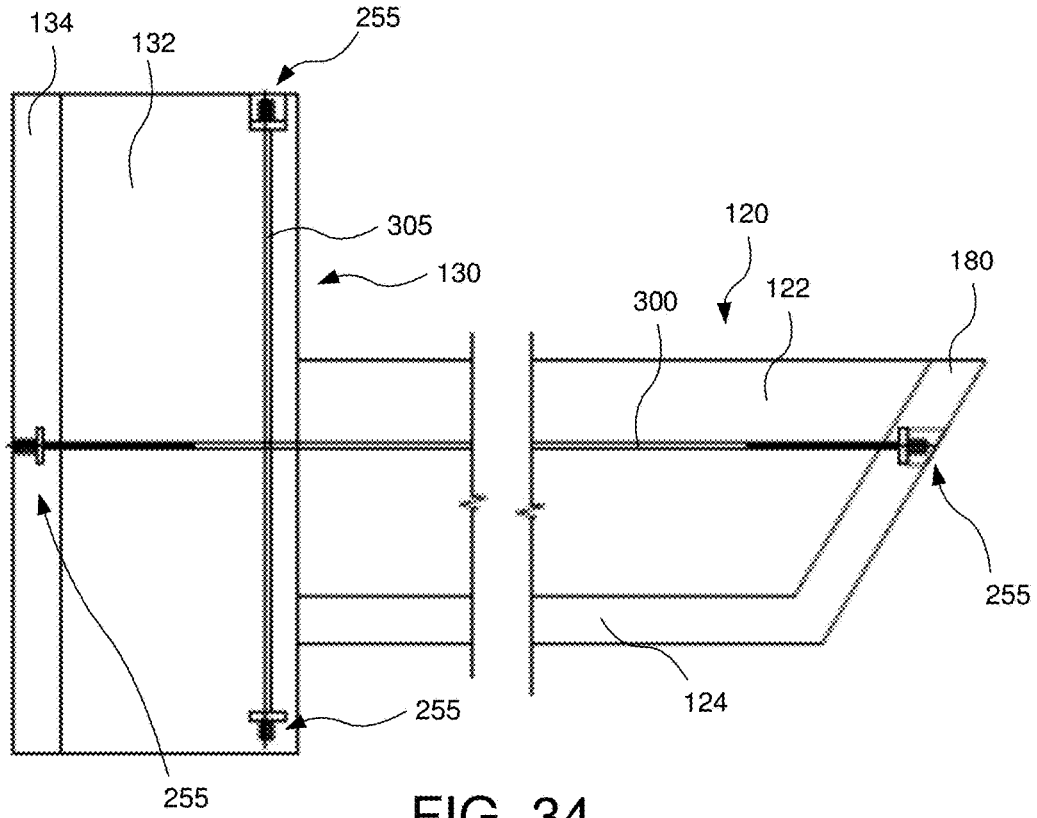
FIG. 34 is a side view illustrating a coupling of a counterfort beam and a face joint member in accordance with some embodiments of the present invention

In some embodiments, the face joint member 130 includes a web threadbar 305 in the joint web 132 of the face joint member 130 (see, for example, FIGS. 33 and 34). In some embodiments, the web threadbar 305 and the connecting sleeved threadbar 300 cross and pass by in proximity to each other within the joint web 132 of the face joint member 130. In some embodiments, the web threadbar 305 is orthogonal to the connecting sleeved threadbar 300.

In some embodiments, the web threadbar 305 is off center of a centroid of the face joint member 130. That is, because the web threadbar 305 and the connecting sleeved threadbar 300 cross by each other, one or the other or both of the web threadbar 305 and the connecting sleeved threadbar 300 are not centered about the centroid of the face joint member 130. In some embodiments, the connecting threadbar is off center of a centroid of the counterfort beam.

In some embodiments, a second connecting sleeved threadbar 300 extends through the counterfort beam 120 and into the face joint member 130. In some embodiments, the second connecting sleeved threadbar 300 includes a second inner metal threaded bar 302 and a second outer protective sleeve 306 with a grease layer 304 between the second inner metal threaded bar 302 and the second outer protective sleeve 306. In some embodiments, the second connecting sleeved threadbar 300 may be above or below the first connecting sleeved threadbar 300. In some embodiments, the second connecting sleeved threadbar 300 and the first connecting sleeved threadbar 300 may be side by side.

In some embodiments, the counterfort beam 120 is formed together with the face joint member 130 using monolithic construction. That is, instead of having two separate pieces (as depicted, for example, in FIGS. 33 and 34), the counterfort beam 120 and the face joint member 130 may be one solid cast of concrete (see, for example, FIGS. 47 and 48). The connecting sleeved threadbar 300 may still be tensioned after casting by tightening at an access opening 270 in the face joint member 130 or the counterfort beam 120. The access opening 270 may be in the face joint member 130 or in the counterfort beam 120.

Figure 37:
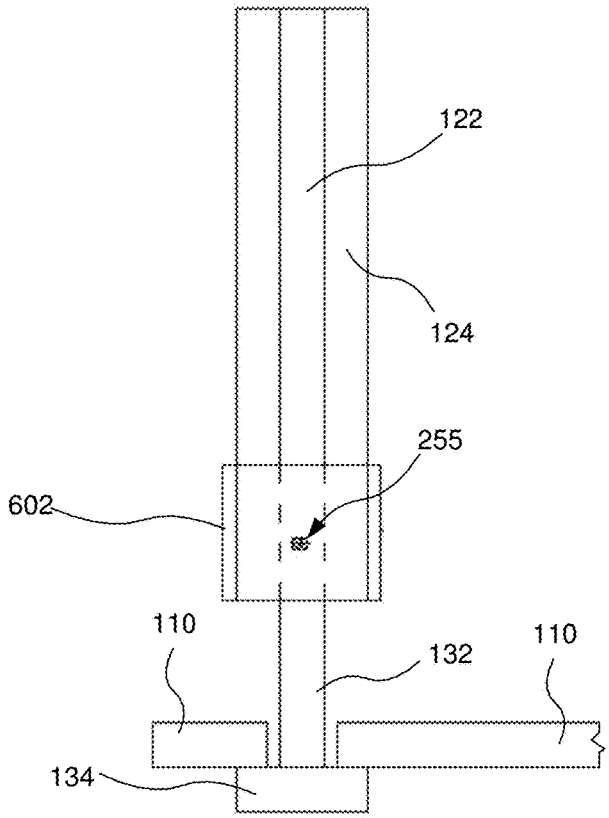
FIG. 37 is a top view illustrating another embodiment of a counterfort wall system in accordance with some embodiments of the present invention.
Figure 38:
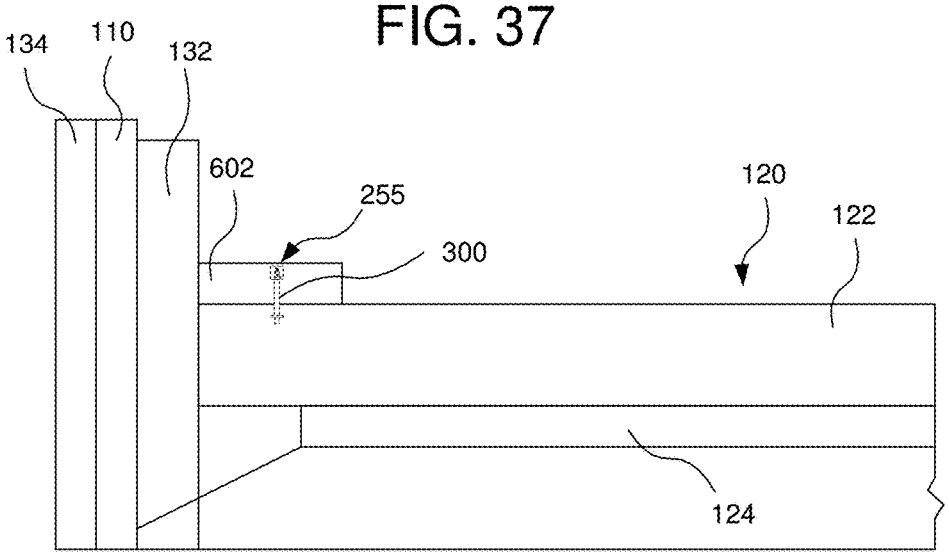
FIG. 38 is a side view illustrating another embodiment of a counterfort wall system in accordance with some embodiments of the present invention.

In some embodiments, the wall system further includes an upper support slab 602 coupled to a counterfort web 122 of the counterfort beam 120 (see, for example, FIGS. 37 and 38). In some embodiments, the upper support slab 602 extends out beyond a width of a counterfort flange 124 of the counterfort beam 120. In some embodiments, the upper support slab 602 is coupled to the counterfort web 122 by a sleeved threadbar 300. This sleeved threadbar 300 may sometimes be referred to as a slab threadbar to distinguish it from a connecting threadbar. Other suitable connecting hardware may be used to connect the upper support slab 602 to the counterfort web 122.

Figure 47:
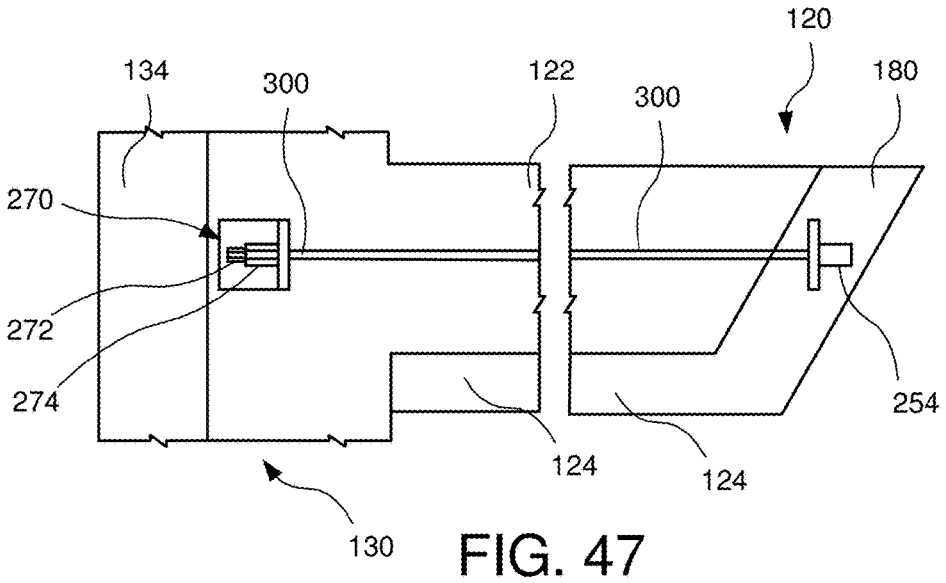
FIG. 47 is a side view of one embodiment of a sleeved threadbar of a counterfort beam and face joint member in accordance with some embodiments of the present invention.
Figure 48:
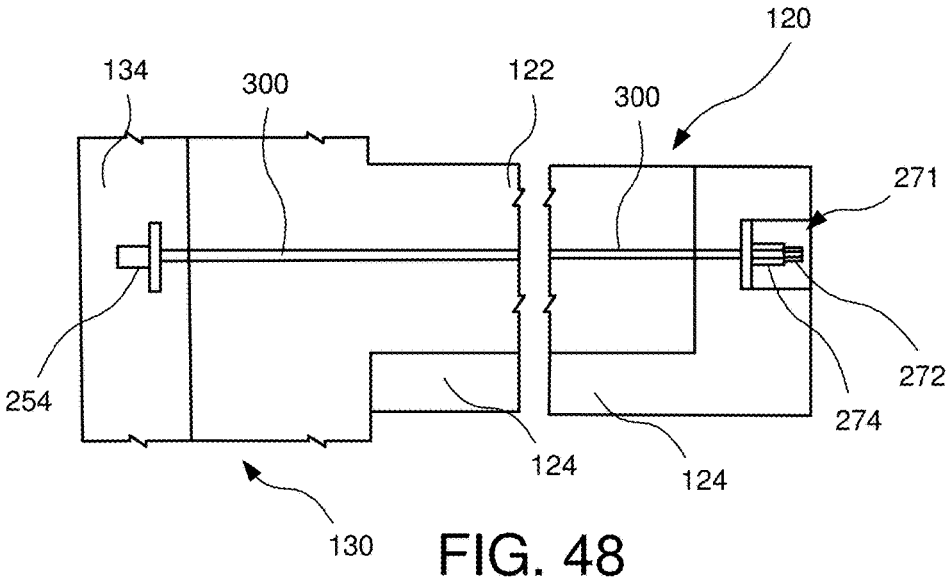
FIG. 48 is a side view of one embodiment of a sleeved threadbar of a counterfort beam and face joint member in accordance with some embodiments of the present invention.

Referring now to FIGS. 47 and 48, other embodiments of wall systems are shown. In FIG. 47, a monolithically formed counterfort wall is formed with a sleeved threadbar 300 formed within the web of the counterfort beam 120 and the joint web of the face joint member 130. The sleeved threadbar 300 may be tensioned at access opening 270 in the face joint member 130. In another embodiment, the sleeved threadbar 300 may be tensioned at an access opening 270 in the counterfort beam 120 (see, for example, FIG. 48). A counterfort wall is formed with a sleeved threadbar 300 formed within the web of the counterfort beam 120 and the joint web of the face joint member 130 is described in more detail in U.S. application Ser. No. 16/146,873 entitled "THREADBAR CONNECTIONS FOR WALL SYSTEMS" and filed on Sep. 28, 2018 for John Babcock, which is incorporated herein by reference for all purposes.

Various embodiments may include some or all the features described in conjunction with FIGS. 17-19, 24-25, 33-38, and 47-48 in any combination or sub-combination of those features. Each combination or sub combination is not described for the sake of brevity.

Figure 20:
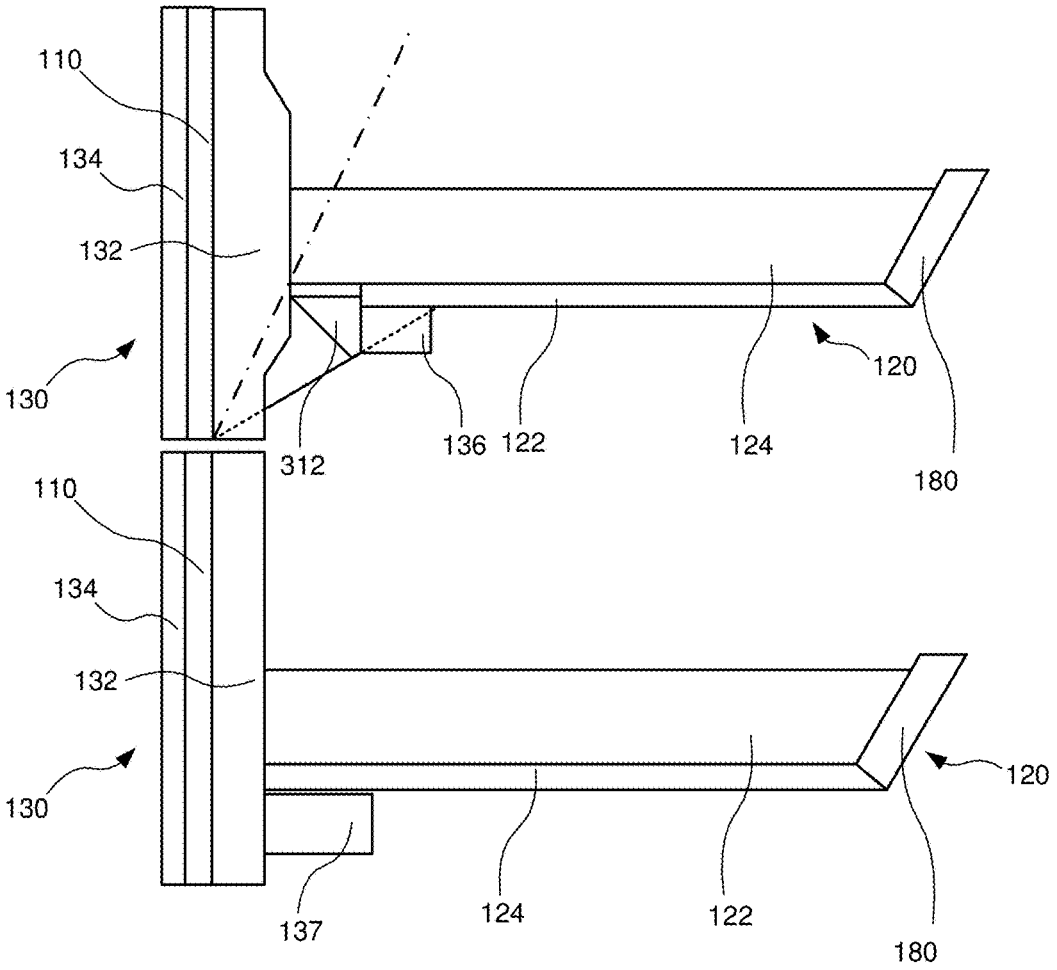
FIG. 20 is a side view illustrating a first and second tier in a counterfort wall system in accordance with some embodiments of the present invention.

Referring to FIG. 20, a side view of a lower tier and upper tier wall is depicted. In the illustrated embodiment, the counterfort beams 120 include inclined rear panels 180 and are coupled to the face joint members 130 at a height above the bottom surface of the face joint members 130. Focusing on the upper tier, the counterfort member 120 includes a tapered lower extension 312. Such a tapered lower extension 312 may allow for the placement of the counterfort beam 120 higher on the face joint member 130 than may be possible for other embodiments as the tapered lower extension 312 and the void replacement member 136 work to provide adequate bearing capacity for the front end of the counterfort beam 120. Referring to the lower tier, a larger extended void replacement member 137 supports the lower counterfort beam 120 under the counterfort flange 124. The extended void replacement member 137 is placed adjacent to the joint web 132 of the face joint member 130.

Figure 21:
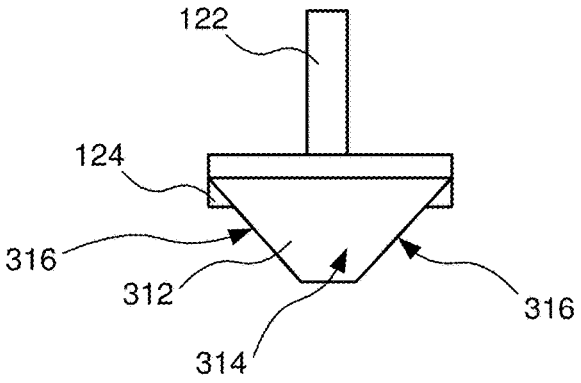
FIG. 21 is a front view illustrating a counterfort beam in accordance with some embodiments of the present invention.
Figure 22:
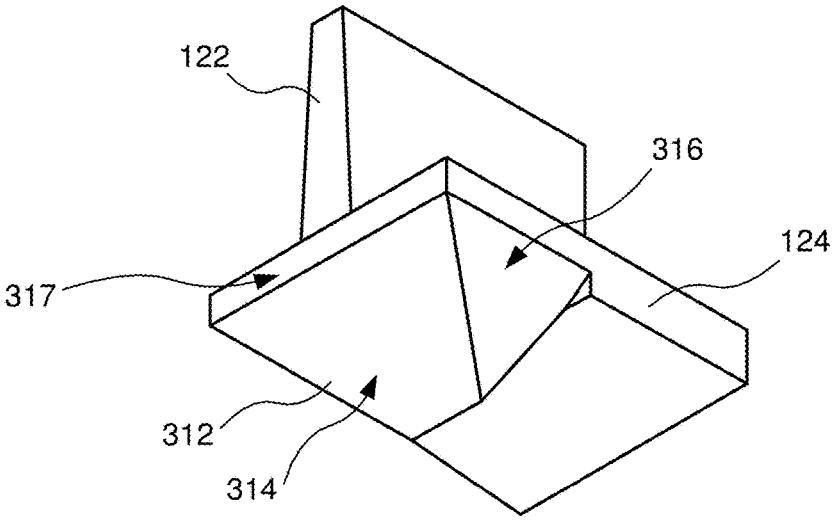
FIG. 22 is a perspective view illustrating a counterfort beam in accordance with some embodiments of the present invention.

Referring to FIGS. 21 and 22, a front view and a lower perspective view of the counterfort beam 120 on the upper tier of FIG. 20 is shown. The counterfort beam 120 includes the tapered lower extension 312. The tapered lower extension 312 includes a front taper 314 that tapers down from the first end 317 of the counterfort flange 124 and side tapers 316 that taper down from the sides of the counterfort flange 124. The tapered lower extension 312 has a small contact area on the sloped backfill but maintains an adequate bearing capacity to support the counterfort beam 120.

Figure 23:
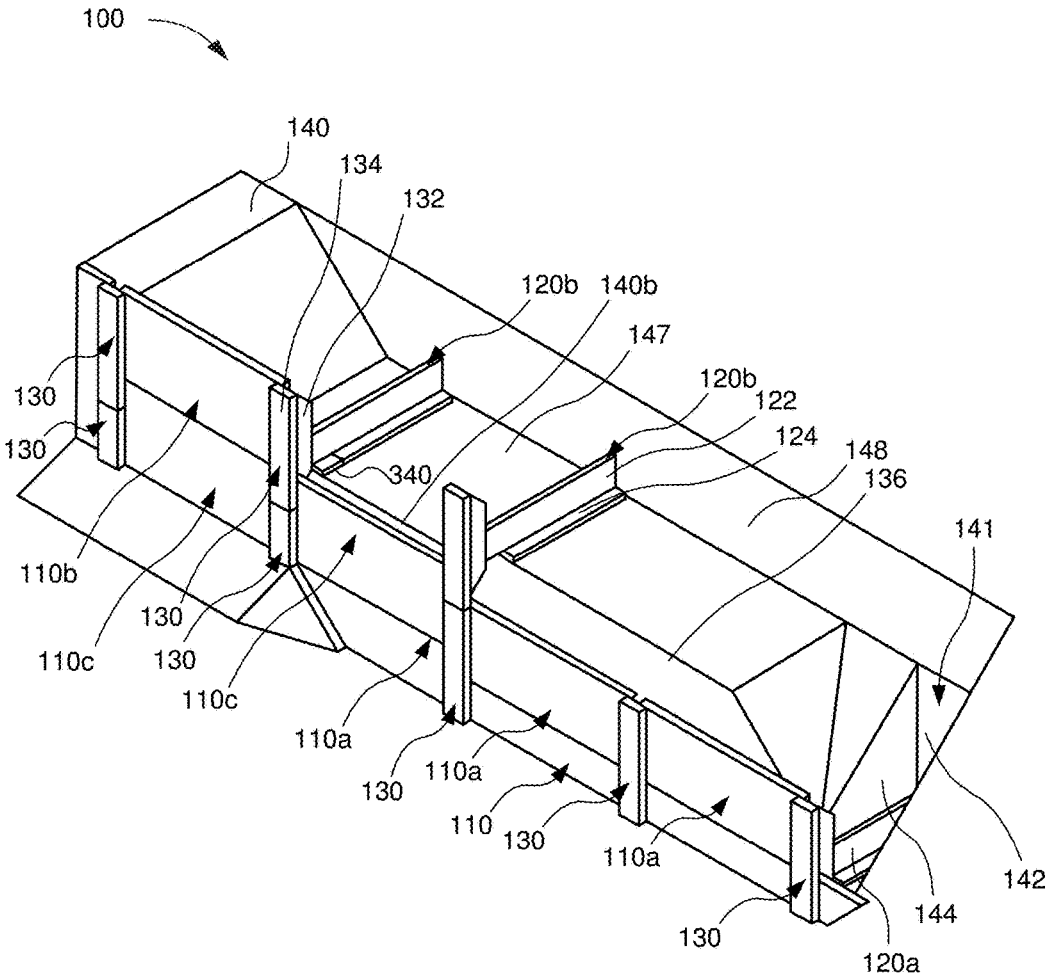
FIG. 23 is a perspective view illustrating another embodiment of a counterfort wall system in accordance with some embodiments of the present invention.

Referring now to FIG. 23, a perspective view illustrating another embodiment of a counterfort retaining wall 100 is shown. The illustrated embodiment varies from the embodiments described in conjunction with FIGS. 1B and 3. The illustrated embodiment includes wall panels 110*c* which span between the lower tier and upper tier. That is, the top panel edge of the wall panels 110*c* extend above the top edge of the lower face joint member 130 and bottom edge of the upper face joint member 130 (or the horizontal junction between the upper and lower face joint members 130). With the top panel edge of the wall panel 110*c* extended above the horizontal junction, the sloped backfill 140*b* starts at a higher point and thus the horizontal plane 147 extends closer to the face joint member 130 and thus the end of the counterfort beam 120*b*. With the horizontal plane 147 extending closer to the face joint member 130 and thus the end of the counterfort beam 120*b*, the illustrated embodiment does not utilize a void replacement member 136 because no void exists.

In some embodiments, the counterfort flange 124 of the counterfort beam 120*b* does not span an entirety of the length of the counterfort beam 120*b*, but is truncated. In such embodiments, a flange extension 340 is utilized and placed between the counterfort web 122 and the compressed backfill. In some embodiments, dry pack grout may be placed between the flange extension 340 and the counterfort web 122.

The illustrated embodiment depicts wall panels 110*c* which span between tiers. Other embodiments may include wall panels 110 which are half panels or less than a full tier. Embodiments described herein may utilize various size wall panels that are less than, equal, or greater in height than the face joint members 130.

As described herein, the counterfort beam 120 may include various features and components. The components and features described herein relating to a single figure may be included with the components features of the other figures described herein within various combinations.

Figure 26:
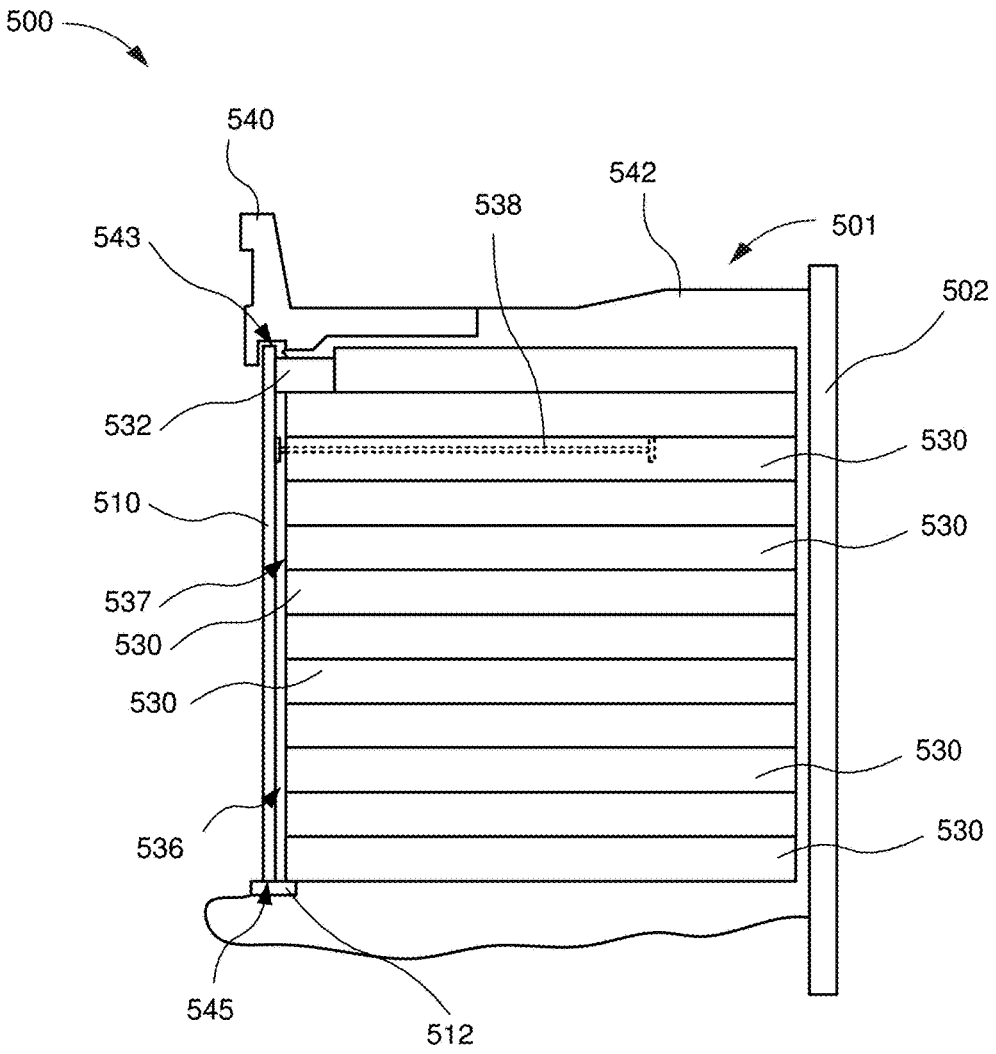
FIG. 26 is a side view illustrating a mechanically stabilized earth (MSE) wall in accordance with some embodiments of the present invention.

Referring now to FIG. 26, a side view illustrating a mechanically stabilized earth (MSE) wall system 500 in accordance with some embodiments of the present invention is shown. The MSE wall system 500 includes an MSE wall 501 coupled to fascia panels 510 by a coupling mechanism 538. Although the MSE wall system 500 is shown and described with certain components and functionality, other embodiments of the MSE wall system 500 may include fewer or more components to implement less or more functionality.

The MSE wall 501 includes a plurality of layers 530 stacked on one another. The layers 530 are formed of enclosed material. For example, a fill, such as soil or sand, is enclosed in a tensile inclusion material. As shown, the enclosed fill forms a generally rectangular block shape that can be stacked in an overlapping manner to form the MSE wall 501. The confined tensile inclusion material is high strength, flexible material. In an example, the confined tensile inclusion material depicted is a geotextile or other fabric that reinforces the fill into an enclosed mass. A thorough description of MSE walls is found in U.S. Pat. No. 6,238,144 B1, by the inventor, the contents of which are incorporated by reference herein.

In the typical full height MSE wall embodiment depicted in FIG. 26, the MSE wall 501 is the full height of the finished wall. As shown, the bottom layer 530 extends back as far as the top layer 530 of the MSE wall 501. As such, the placement of the bottom layer 530 when constructing the wall necessitates that temporary or permanent shoring 502 is installed. The shoring 502 allows for the bottom layer 530 to be placed to an appropriate embedment depth, which is dictated by the height of the finished wall. The shoring 502 increases the cost and time utilized in constructing the retaining wall.

A coupling mechanism 538 couples the MSE wall 501 to fascia panel 510. The coupling mechanism 538 may be a tie rod assembly that includes a tie rod that is buried in a layer 530 or in between layers 530 of the MSE wall 501 and extends out a face 537 of the MSE wall 501 and attaches to the fascia panel 510. The coupling mechanism 538 may, in some embodiments, be configured similar to sleeved threadbar 300 described in conjunction with FIGS. 17-19. As such, in an embodiment, the coupling mechanism 538 may include a polymer sleeve surrounding and encapsulating a protective grease layer covering a tie rod (or a galvanized long bolt or equivalent).

The tie rod or coupling mechanism 538 may be removable coupled or permanently attached to the fascia panel 510. The coupling between the fascia panel 510 and the MSE wall 501 restricts relative movement between the fascia panel 510 and the MSE wall 501.

In the illustrated embodiment, the height of the fascia panel 510 is equal or approximately equal to the height of the MSE wall 501. The fascia panel 510 is spaced apart a distance from the face 537 of the MSE wall 501 forming a gap 536 between the face 537 of the MSE wall 501 and the fascia panel 510. The gap 536 may be filled with a void replacement material 561 (see, for example, FIG. 27). The void replacement material 561 is between the fascia panels 510 and the face 537 of the MSE wall 501.

The void replacement material 561 (depicted, partially, in FIG. 27) is a lightweight material. In some embodiments, the void replacement material 561 is a tire-derived aggregate (TDA). In some embodiments, the void replacement material 561 is an expanded polystyrene (EPS). In some embodiments, the void replacement material 561 is a material with similar low porosity properties to TDA or EPS.

The gap 536 is covered at the top of the MSE wall 501 by a closure block 532. The closure block 532 runs along the length of the finished wall and separates the void replacement material 561 with any back fill. The closure block 532 abuts the back of the fascia panels 510 and the top layer 530 of the MSE wall 501 and rests on the edge of the layer 530 below the top layer 530. The closure block 532 may be constructed of foam, EPS, or another lightweight material or another material that is typically utilized for fill embankments to reduce loads.

Further depicted in FIG. 26 is top fill 542 which is placed over the top layer 530 of the MSE wall 501 and the closure block 532. In some embodiments, an impact barrier 540 is positioned over a top edge 543 of the fascia panel 510. In some embodiments, the impact barrier 540 extends over an exposed face 513 of the fascia panel 510.

In some embodiments, the impact barrier 540 is not in direct contact with the fascia panel 501 as a space is formed between the top edge 543 of the fascia panel 510 and the impact barrier 540. The space allows for any forces exerted on the impact barrier 540 to not transfer to the fascia panels 510.

The bottom edge 545 of the fascia panel 510 is supported by a leveling pad 512. The leveling pad 512 supports the fascia panels 510 vertically and may further include displacement tabs 514 (see, for example, FIG. 28) which are configured to restrict horizontal movement of the fascia panels 510 at the base. The coupling mechanism 538 and the displacement tabs 514 cooperatively work to restrict horizontal movement of the fascia panels 510.

Figure 27:
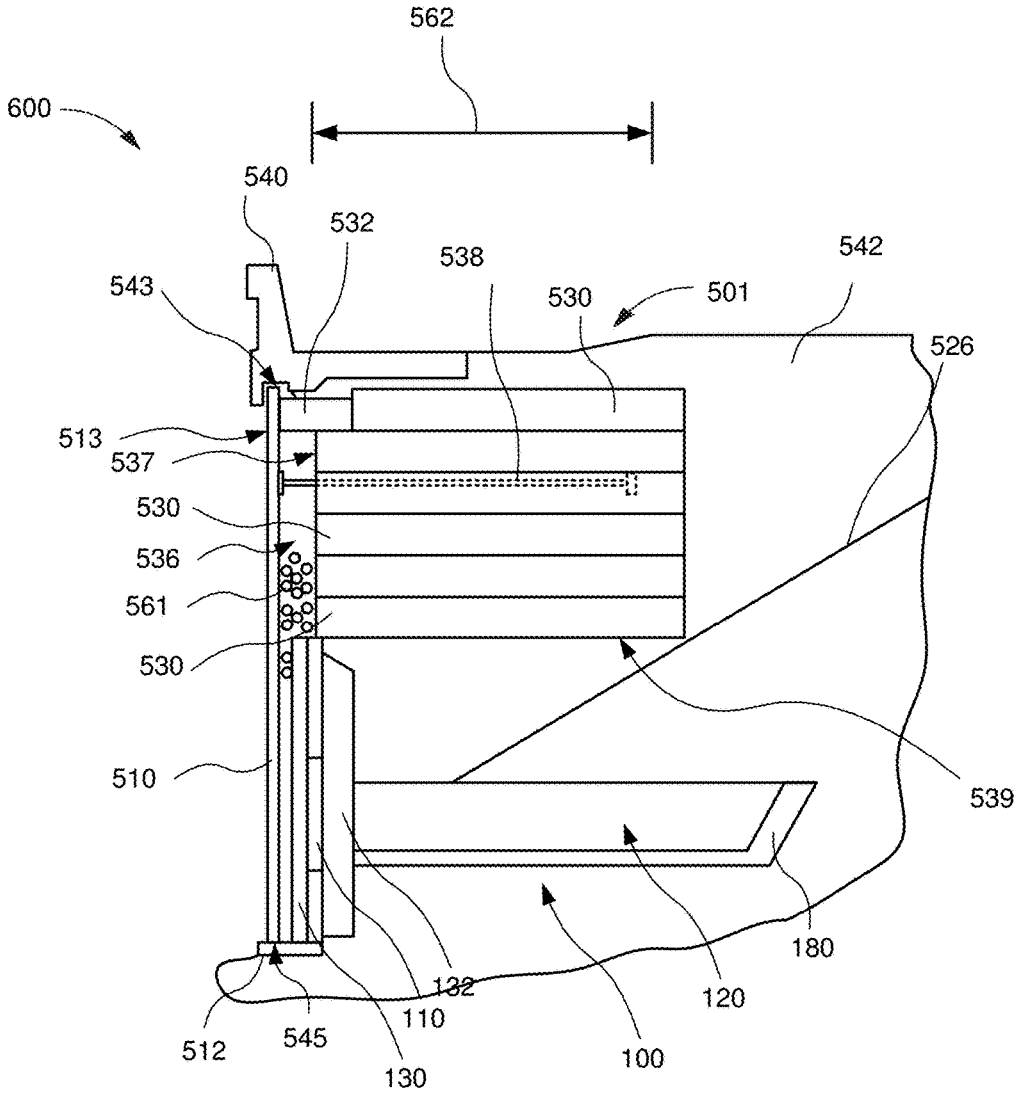
FIG. 27 is a side view illustrating a wall system in accordance with some embodiments of the present invention.

Referring now to FIG. 27 a side cross-sectional view illustrating a wall system 600 in accordance with some embodiments of the present invention is shown. The wall system 600 combines the MSE wall system 500 and a counterfort retaining wall 100. Although the wall system 600 is shown and described with certain components and functionality, other embodiments of the MSE wall system 600 may include fewer or more components to implement less or more functionality.

The wall system 600 includes a counterfort retaining wall 100. The counterfort retaining wall 100 may include some or all of the features, components, and functionality described herein in conjunction with FIGS. 1-25 and such features, components, and functionality are not repeated for the sake of brevity.

In some embodiments, the counterfort retaining wall 100 forms the lower portion of the wall system 600 and an MSE wall 501 forms an upper portion of the wall system 600. As described previously, the counterfort retaining wall 100 eliminates the need for shoring due to utilizing the slot cut installation method for the counterforts. As opposed to a full height MSE wall system 500, such as depicted in FIG. 26, utilizing a counterfort retaining wall 100 as the lower portion of the wall system 600 no shoring is needed.

Although only one tier of counterfort retaining wall 100 is depicted in FIG. 27, a plurality of tiers may be utilized. However high the counterfort retaining wall 100 is built up, it will, in any case, correspondingly decrease the overall height of the MSE wall 501 that forms the upper portion of the combination. As the height of the MSE wall 501 decreases, the necessary embedment depth (depicted by arrow 562) decreases.

The height of the counterfort retaining wall 100 may be selected so that the horizontal embedment depth at the bottom of the MSE wall 501 is adequate for wall stability but does not require temporary shoring. The width of the upper MSE wall 501 is shown at the intersection of the horizontal projection (plane) of the top edge of the uppermost wall panel 110 and the face cut (see line 526). As the embedment depth for the upper reduced height MSE wall 501 is substantially decreased, the need for shoring is eliminated which would have been needed for a full height MSE wall 501 (see, FIG. 26). By eliminating the need for costly shoring the wall system 600 is cost effective. In addition, the elimination of shoring reduces the field time that would otherwise be required to place a full height MSE wall 501.

At a certain overall height, the embedment depth will be small enough to negate cutting into the face cut (the slope of which is depicted by line 526) and eliminate the need for shoring 502. The overall height of the counterfort retaining wall 100 and MSE wall 501 can be manipulated and optimized to satisfy the overall height requirements for the wall system 600 while eliminating shoring.

In the illustrated embodiment, a portion of a bottom surface 539 of the bottom layer 530 of the MSE wall 501 rests on the wall panels 110 of the counterfort retaining wall 100. In some embodiments, the bottom layer 530 of the MSE wall 501 is a set back behind the wall panels 110 of the counterfort retaining wall 100. In some embodiments, the face 537 of the MSE wall 501 is coplanar with the back of the wall panels 110 of the counterfort retaining wall 100. In some embodiments, the face 537 of the MSE wall 501 is coplanar with the front of the wall panels 110 of the counterfort retaining wall 100. In some embodiments, the face 537 of the MSE wall 501 is coplanar with the front of the wall panels 110 of the counterfort retaining wall 100.

In some embodiments, the face 537 of the MSE wall 501 is closer to the fascia panels 510 than the wall panels 110 of the counterfort retaining wall 100. In some embodiments, the wall panels 110 of the counterfort retaining wall 100 are closer to the fascia panels 510 than the face 537 of the MSE wall 501. In some embodiments, the bottom layer 530 of the MSE wall is positioned above the counterfort beams 120 of the counterfort retaining wall 100. As depicted, the counterfort beams 120 of the counterfort retaining wall 100 of FIG. 27 include an inclined rear panel 180.

The inclined rear panels 180, in some embodiments, are inclined and extend away from the counterfort flange 124. The inclined rear panels 180 may have the same width, a narrower width, or a greater width than the counterfort flange 124. The inclined rear panels 180 may be inclined at various angles including any incline between five degrees from vertical and five degrees from horizontal.

In some embodiments, the inclined rear panels 180 are inclined and match the sloped excavated cut behind the counterfort beam 120. The inclined rear panels 180 may extend to the height of the counterfort web 122 or extend above or below the counterfort web 122. In some embodiments, the inclined rear panels 180 are adjustable. That is, the angle of incline is variable and can be matched to the slope of the excavated cut behind the counterfort beam 120.

The inclined rear panels 180, in some embodiments, are configured to increase the safety factors for pullout by providing more surface area. In some embodiments, the inclined rear panels 180 are configured to provide resistance from rotational forces with the increase surface area and extended moment arm of the force loading down the rear panels from backfill 140 that is placed over the counterfort beams 120.

In some embodiments, the inclined rear panels 180 are integral with the counterfort web 122 and counterfort flange 124. In some embodiments, the inclined rear panels 180 are separate from the counterfort web 122 and counterfort flange 124 and are coupled to the counterfort web 122 and counterfort flange 124, for example, in manner similar to the description of FIGS. 11-13.

Fascia panels 510 are coupled to the MSE wall 501 via a coupling mechanism 538 similar to what is described in conjunction with FIG. 26. The fascia panels 510 are vertical panels that, in some embodiments, cover an entirety of the face 537 of the MSE wall 501. In the illustrated embodiment, the fascia panels 510 cover the face 537 of the MSE wall 501 and the wall panels 110 of the counterfort retaining wall 100 and thus extend further down than the bottom of the MSE wall 501.

The fascia panels 510, as depicted in FIG. 27, are spaced horizontally from the face 537 of the MSE wall 501 a distance greater than depicted in FIG. 26. The fascia panels 510 are displaced from what the fascia panels 510 would have been without counterfort retaining wall 100 present. The added clearance allows for space for the face joint members 130 which extend out further than the wall panels 110 and the face 537 of the MSE wall 501. As such, a larger gap 536 is formed between the fascia panels 510 and the face 537 of the MSE wall 501. As shown, the gap may be filled with void replacement material 561. The larger gap 536 necessitates a larger closure block 532.

The bottom edge 545 of the fascia panel 510 is supported by a leveling pad 512. The leveling pad 512 supports the fascia panels 510 vertically. As depicted, the leveling pad 512 extends back underneath the counterfort retaining wall 100. Specifically, the leveling pad 512 supports the face joint member 130 and the bottom wall panel 110. With the leveling pad 512 supporting both the fascia panels 510 and the counterfort retaining wall 100 and since the leveling pad 512 is positioned under the counterfort retaining wall 100, any settling that may occur will be distributed between both the fascia panels 510 and the counterfort retaining wall 100.

Figure 28:
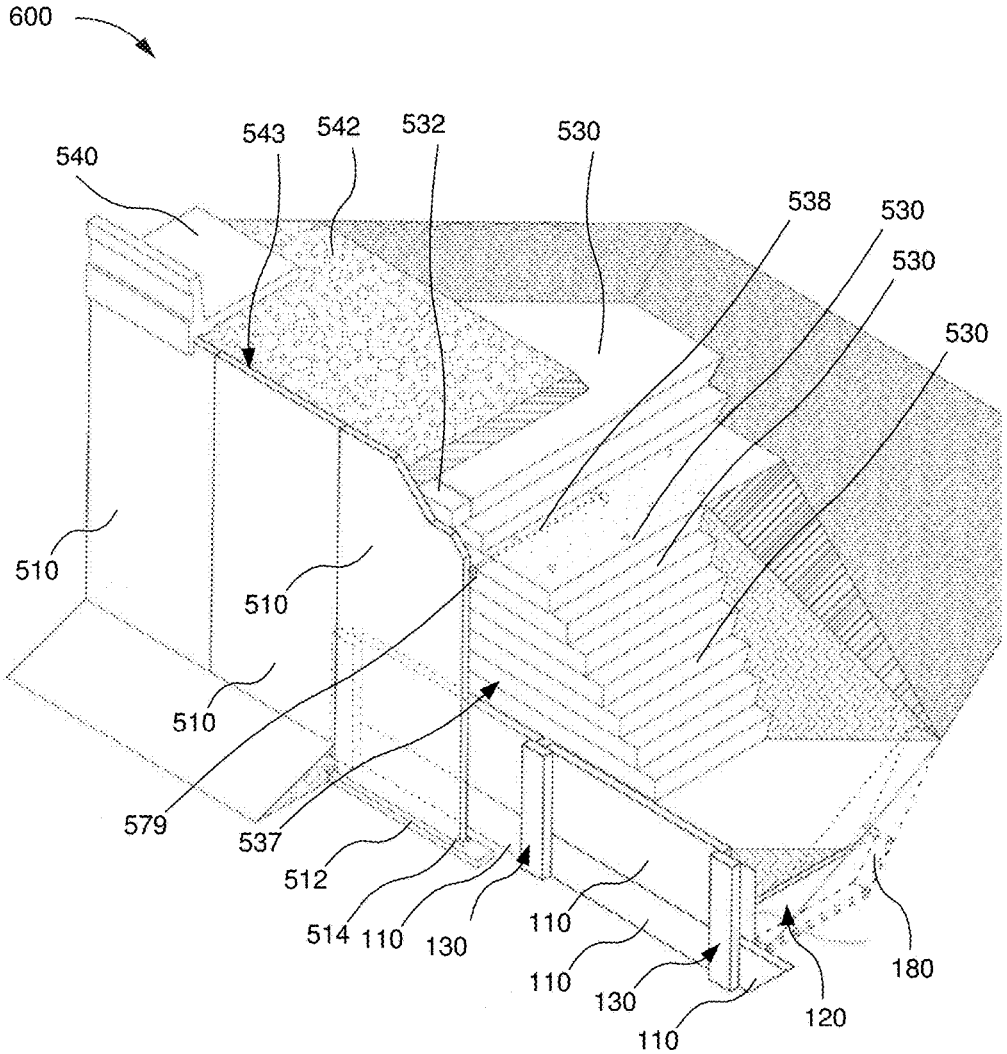
FIG. 28 is a perspective view illustrating one embodiment of a wall system in accordance with some embodiments of the present invention.

Referring now to FIG. 28 a perspective cut-away view illustrating the wall system 600 with a portion of the fascia panels 510 and other components removed to allow for a proper understanding the various components of the wall system 600. The wall system 600 is depicted as only partially constructed to show the various components that would be buried in backfill behind the fascia panels 510. Although the wall system 600 is shown and described with certain components and functionality, other embodiments of the wall system 600 may include fewer or more components to implement less or more functionality.

In the illustrated embodiment, the left side is fully completed and various components are shown removed when viewed progressing from the left to the right in the figure. The wall system 600, fully finished, includes a plurality of fascia panels 510 that abut each other and along the length of the retaining wall. In some embodiments, the impact barrier 540 also extends along the length of the retaining wall to cover the top edge 543 of the fascia panels 510. The impact barriers 540 rest on the top fill 542.

Below the top fill 542 are the top layer 530 of the MSE wall 501 and closure block 532. As shown, the fascia panels 510 are coupled to the MSE wall 501 by the coupling mechanism 538. In the illustrated embodiment, the coupling mechanism 538 includes a fastening flange 579. The coupling mechanism 538 may be positioned such that the fastening flange 579 connects to two fascia panels 510 at the seam between the two fascia panels. In the illustrated cut-away view the second fascia panel 510 has been removed to show the coupling mechanism 538.

Behind the fascia panels 510 are the MSE wall 501 and the counterfort retaining wall 100. The counterfort retaining wall 100 forms the lower portion of the retaining wall and the MSE wall 501 forms the upper portion of the retaining wall. The MSE wall 501 and the counterfort retaining wall 100 cooperatively form the full height combination retaining wall structure. In some embodiments, the bottom surface 539 of the bottom layer 530 of the MSE wall 501 is coplanar with the top edge of the uppermost wall panels 110 of the counterfort retaining wall 100.

In some embodiments, the bottom surface 539 of the bottom layer 530 of the MSE wall 501 may be slightly above or below the top edge of the uppermost wall panels 110 of the counterfort retaining wall 100. If below, the MSE wall 501 is set back from the wall panels 110. In the illustrated embodiment, the bottom surface 539 of the bottom layer 530 of the MSE wall 501 is coplanar with the top edge of the uppermost wall panels 110 of the counterfort retaining wall 100 and the face 537 of the MSE wall 501 is coplanar with the back of the wall panels 110 of the counterfort retaining wall 100.

The MSE wall 501 extends along the length of the retaining wall as well and is positioned above the counterfort beams 120 of the counterfort retaining wall 100. As shown, the front face of each of the layers 530 of the MSE wall 501 are substantially flush with each other and together form the face 537 of the MSE wall 501.

Exposed at the right of FIG. 28 is one of the counterfort beams 120 and face joint members 130 which depict the counterfort retaining wall 100 similar to what is described above in conjunction with FIGS. 1-25. The counterfort retaining wall 100 also extends along the length of the wall and is completely obscured by the fascia panels 510 when the wall system 600 is finished.

Figure 29:
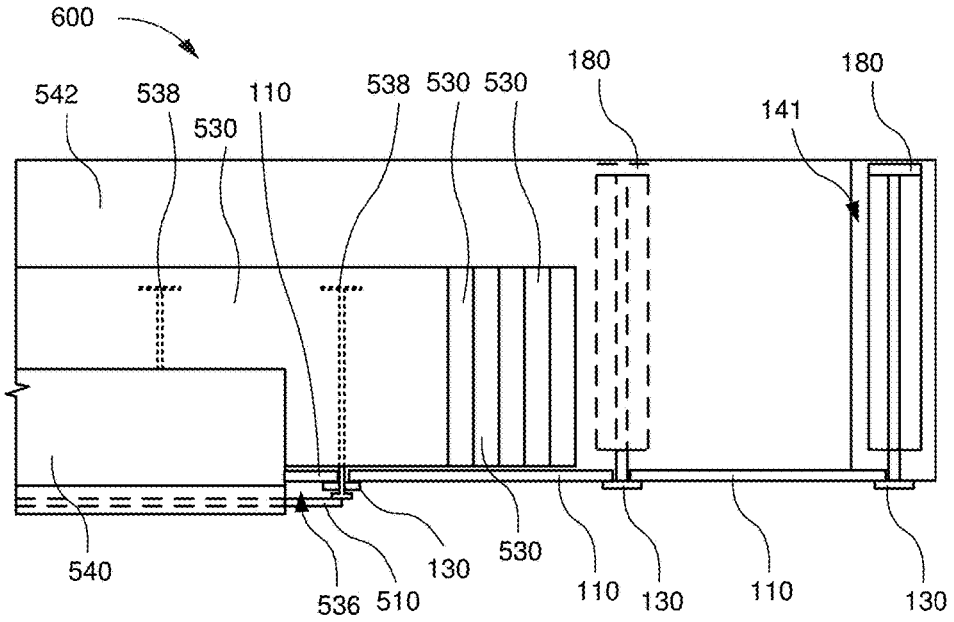
FIG. 29 is a top view illustrating one embodiment of a wall system in accordance with some embodiments of the present invention.

Referring now to FIG. 29, a top view illustrating one embodiment of a wall system 600 in accordance with some embodiments of the present invention is shown. Similar to FIG. 28, FIG. 29 is a cut-away view illustrating the wall system 600 with a portion of the fascia panels 510 and other components removed to allow for a proper understanding the various components of the wall system 600. The wall system 600 is depicted as only partially constructed to show the various components that would be buried under the top fill 542.

The wall system 600 includes a counterfort retaining wall 100 and an MSE wall 501. The wall system 600 further includes a plurality of fascia panels 510 spaced horizontally from a face 537 of the MSE wall 501 and the wall panels 110 of the counterfort retaining wall 100. As shown, the fascia panels 510 are spaced apart from the face joint members 130 as well.

Figure 30:
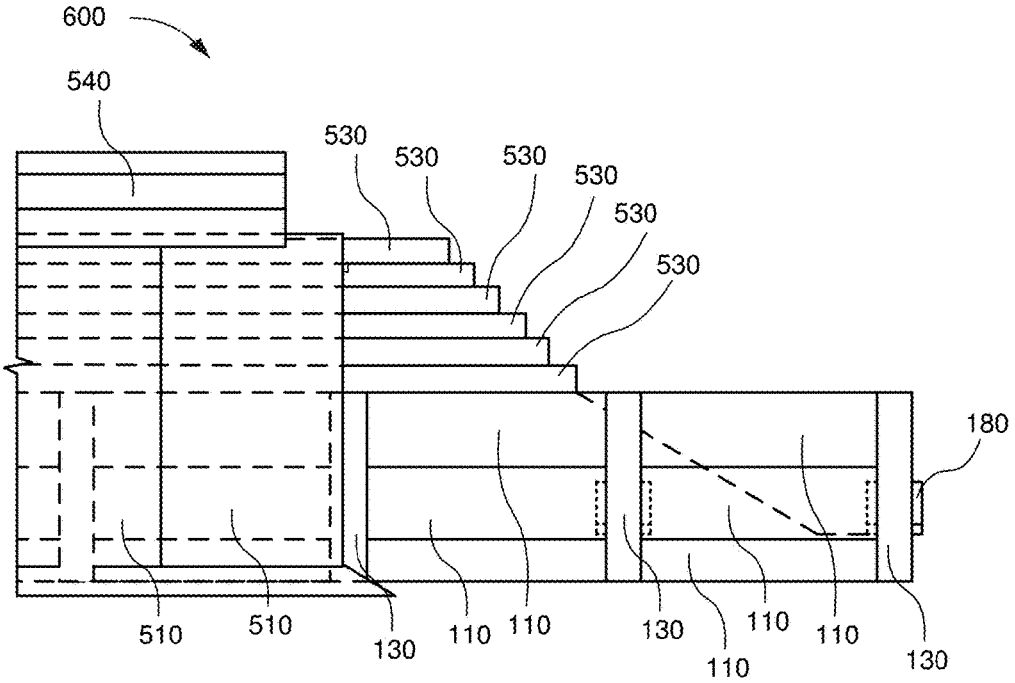
FIG. 30 is a front view illustrating one embodiment of a wall system in accordance with some embodiments of the present invention.

Referring now to FIG. 30, a front view illustrating one embodiment of a wall system 600 in accordance with some embodiments of the present invention is shown. Similar to FIGS. 28 and 29, FIG. 30 is a cut-away view illustrating the wall system 600 with a portion of the fascia panels 510 and other components removed to allow for a proper understanding the various components of the wall system 600. The wall system 600 is depicted as only partially constructed to show the various components that would be behind the fascia panels 510.

The counterfort retaining wall 100 forms at least one tier of the wall system 600. In the illustrated embodiment, the counterfort retaining wall 100 forms the lowermost tier of the wall system 600. The counterfort retaining wall 100 includes counterfort beams 120, wall panels 110, and face joint members 130. Above the counterfort retaining wall 100, the wall system 600 includes MSE wall 501. The bottom layer 530 of the MSE wall is positioned above the counterfort beams 120 of the counterfort retaining wall 100.

Figure 31:
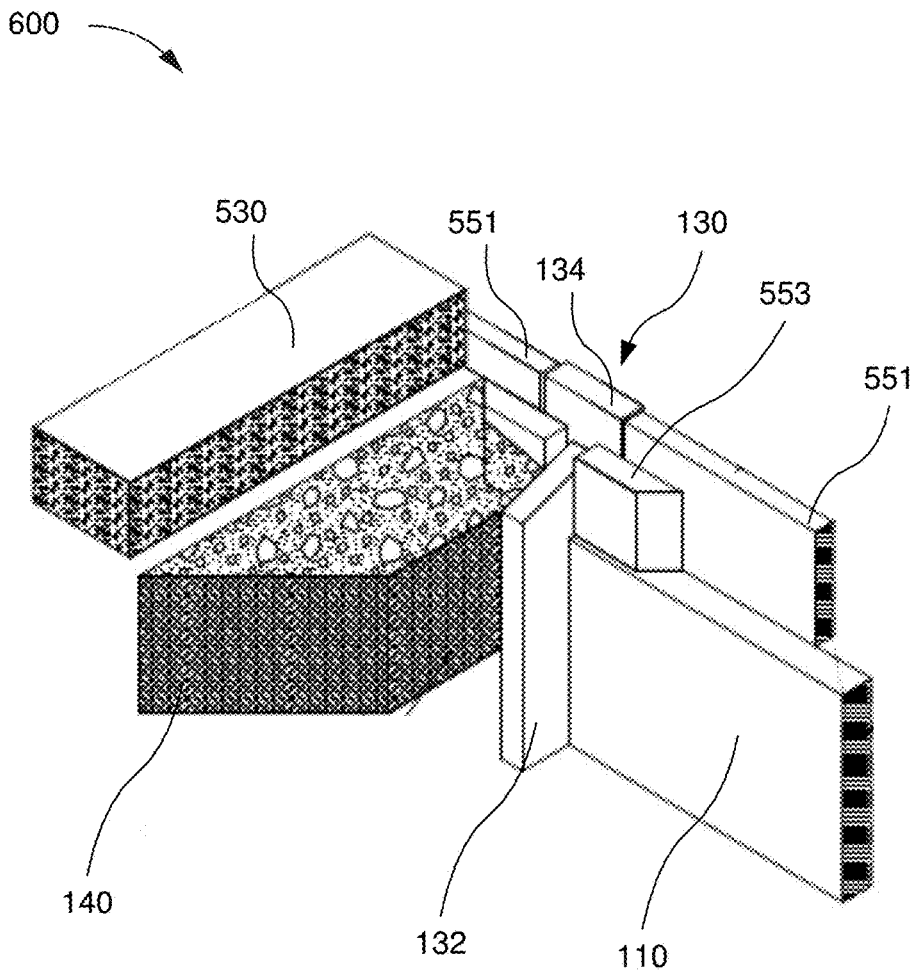
FIG. 31 is a perspective cut-away view illustrating a wall system in accordance with some embodiments of the present invention.

Referring now to FIG. 31, a rear perspective cut-away view illustrating a wall system 600 in accordance with some embodiments of the present invention is shown. The wall system 600 may be similar to those described in conjunction with FIGS. 27-30 or FIGS. 1-25 or FIGS. 53-99 but includes an offset top wall panel 551. The uppermost wall panel of the counterfort retaining wall 100 is offset or set forward from the remaining wall panels 110.

Referring specifically to FIG. 31, a wall panel 110 is shown to interface with the face joint member 130 with the wall panel 110 tucked behind the joint flange 134. The offset top wall panel 551, however, is set forward and abuts the side of the joint flange 134. The offset top wall panel 551 is held in place with a corbel 553. The corbel 553 may be a separate piece coupled to the back of the offset top wall panel 551 or may be integral to the corbel 553. The corbel 553 protrudes out the side of the offset top wall panel 551 such that the corbel 553 tucks behind the joint flange 134 to hold the offset top wall panel 551 in place. The corbel 553 extends only partially the overall height of the offset top wall panel 551.

Also depicted in FIG. 31 is the bottom layer 530 of an MSE wall 501. As shown, the bottom layer 530 is set behind an upper portion of the offset top wall panel 551. In such embodiments, the bottom layer 530 can be lined up to about the backside of the offset top wall panel 551. This panel configuration results in the overall minimum horizontal displacement of the fascia panel 510 from the face of the MSE wall 501.

Figure 32:
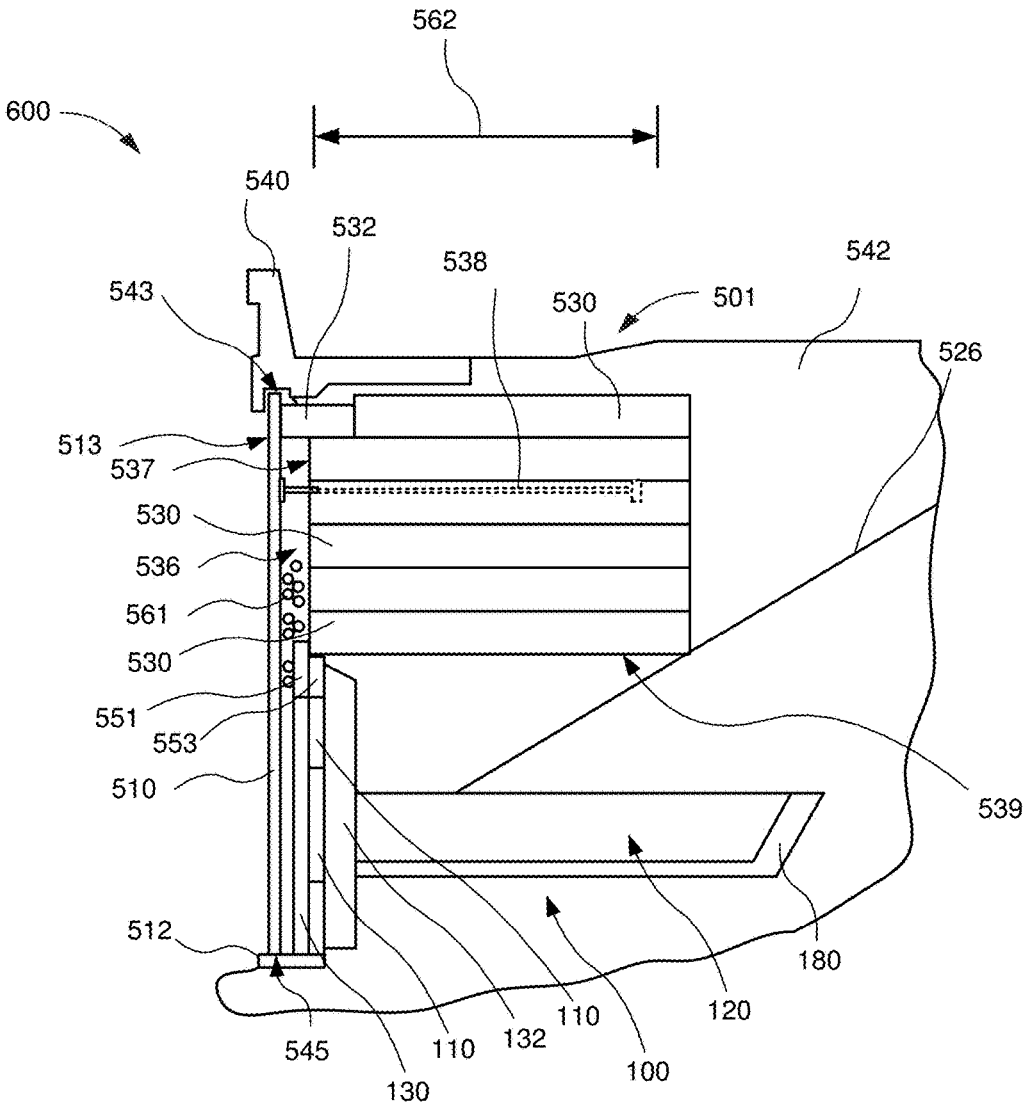
FIG. 32 is a side view illustrating a wall system in accordance with some embodiments of the present invention.

Referring now to FIG. 32, a side view illustrating a wall system 600 in accordance with some embodiments of the present invention is shown. As depicted, the bottom layer 530 of the MSE wall 501 is set behind the offset top wall panel 551 and above the corbel 553. In the illustrated embodiment, the face 537 of the MSE wall 501 is a coplanar with the wall panels 110 of the counterfort retaining wall 100. The face 537 of the MSE wall 501 is a coplanar with the backside of the offset top wall panel 551

Referring now to FIG. 33, a top view illustrating a coupling of a counterfort beam 120 and a face joint member 130 of a counterfort retaining wall 100 in accordance with some embodiments of the present invention is shown. The coupling mechanism of FIG. 33 may, in some embodiments, be the same as discussed in conjunction with FIGS. 17-19 herein. For example, the sleeved threadbar 300 may include an inner metal threaded bar 302 with an outer protective sleeve 306 with a grease layer 304 between the inner metal threaded bar 302 and the outer protective sleeve 306.

In addition, the sleeved threadbar 300 includes end couplings 255 which may include plates, nuts, bolts, and couplers similar to what is described above in conjunction with FIGS. 17-18 (such as post tension coupler 274, stop nut 272, end plate 252, post tension nut 254).

Referring now to FIG. 34, a side view illustrating a coupling of a counterfort beam 120 and a face joint member 130 of a counterfort retaining wall 100 in accordance with some embodiments of the present invention is shown. In addition to the sleeved threadbar 300 coupling the counterfort beam 120 and the face joint member 130, the joint web 132 of the face joint member 130 includes a sleeved threadbar 300. The sleeved threadbar 300 of the face joint member 130 extends vertically through the joint web 132.

The sleeved threadbar 300 of the face joint member 130 includes end couplings 255 which may include plates, nuts, bolts, and couplers similar to what is described above in conjunction with FIGS. 17-18 (such as post tension coupler 274, stop nut 272, end plate 252, post tension nut 254). The sleeved threadbar 300 of the face joint member 130 may improve resistance to crack propagation in the face joint member due to the post tensioning effect of inducing a compression force on the concrete so there is no tension force to create potential cracks. The embodiments described in conjunction with FIGS. 33 and 34 may be included with the embodiments described in the other figures described herein and apply to either joined counterfort assemblies or monolithically cast members.

Some embodiments may include more than one sleeved threadbar 300 in either the counterfort beam 120 or the face joint member 130. For example, the counterfort beam 120 may include two sleeved threadbars 300 vertically spaced from each other. In another example, the face joint member 130 may include two sleeved threadbars 300 horizontally spaced from each other. Other combinations of multiple sleeved threadbars 300 are contemplated herein.

Figure 35:
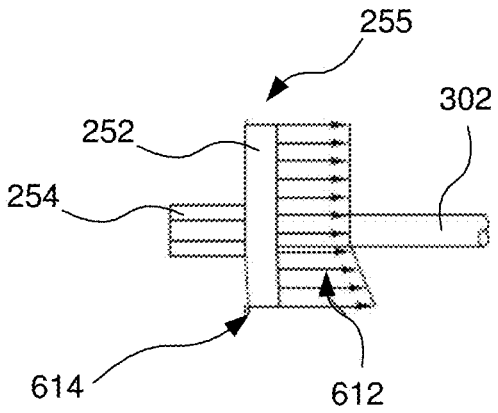
FIG. 35 is a side view illustrating an end coupling in accordance with some embodiments of the present invention.

In embodiments that include a sleeved threadbar 300 in the counterfort beam 120 and the face joint member 130, the sleeved threadbars 300 cross and pass by in close proximity to each other. As such, one or both of the sleeved threadbars 300 may be off center of the counterfort beam 120 or the face joint member 130. An off center sleeved threadbar 300 may result in uneven loads being placed on the concrete structure once the sleeved threadbars 300 are tightened. Referring now to FIG. 35, a side view illustrating an end coupling 255 in accordance with some embodiments of the present invention is shown. The off center inner metal threaded bar 302 results in an uneven load distribution 612. The uneven load distribution 612 may lead to deformation 614 of the end plate 252. The inner metal threaded bar may be made of steel in some embodiments.

Figure 36:
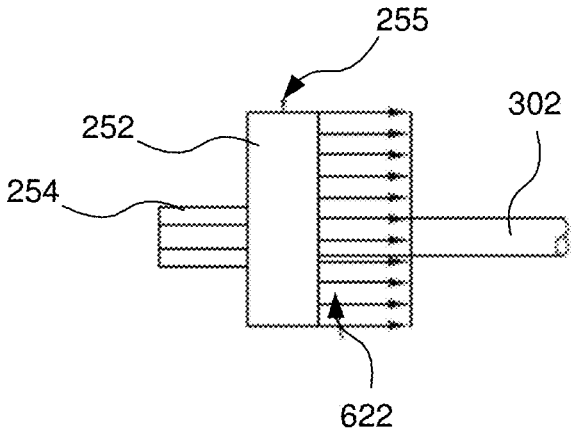
FIG. 36 is a side view illustrating an end coupling in accordance with some embodiments of the present invention.

Referring now to FIG. 36, a side view illustrating an end coupling 255 in accordance with some embodiments of the present invention is shown. The end coupling 255 of FIG. 36 includes an enlarged end plate 252. With an enlarged end plate 252, the load is distributed more evenly which will reduce or eliminate off center loads. The even load distribution 622 allows for the sleeved threadbar 300 to be off center without resulting in an uneven distribution of the load.

Referring now to FIG. 37, a top view illustrating another embodiment of a counterfort wall system in accordance with some embodiments of the present invention is shown. The counterfort wall system utilizes an upper support slab 602. The upper support slab 602 is coupled to the counterfort web 122 of the counterfort beam. The upper support slab 602 extends out beyond the edges of the counterfort web 122 and provides support to the counterfort beam with filling material previously placed and compacted below the upper support slab 602 on each side of the counterfort web 122. The upper support slab 602 may be coupled to the counterfort beam by many different means. Illustrated in FIGS. 37 and 38, the upper support slab 602 is coupled to the counterfort beam by a sleeved threadbar 300. The sleeved threadbar 300 includes an end coupling 255 which secures the sleeved threadbar 300 to the upper support slab 602. The sleeved threadbar 300 is further fixedly attached to the counterfort web 122. Other coupling means are contemplated herein.

Referring now to FIG. 38, a side view illustrating another embodiment of a counterfort wall system in accordance with some embodiments of the present invention is shown. The upper support slab 602 is depicted as adjacent and perpendicular to the counterfort web 122 and coupled to the counterfort web 122 via the sleeved threadbar 300 or other fastening means. In some embodiments, the upper support slab 602 extends out a distance greater than the width of the counterfort flange 124 (as is depicted in FIG. 37). In other embodiments, the upper support slab 602 extends out a distance equal to the width of the counterfort flange 124. In yet other embodiments, the upper support slab 602 extends out a distance less than the width of the counterfort flange 124 but greater than the width of the counterfort web 122. The upper support slab 602 may be utilized for each embodiment of the counterfort beam contemplated herein. In addition, the upper support slab 602 may be utilized in embodiments utilizing primarily a counterfort wall system as a retaining wall similar to what is described in conjunction with FIG. 1A, 1B, 3, 7, or 23 and can be utilized in a combined counterfort wall and mechanically stabilized earth wall system as described in conjunction with FIG. 43.

Figure 39:
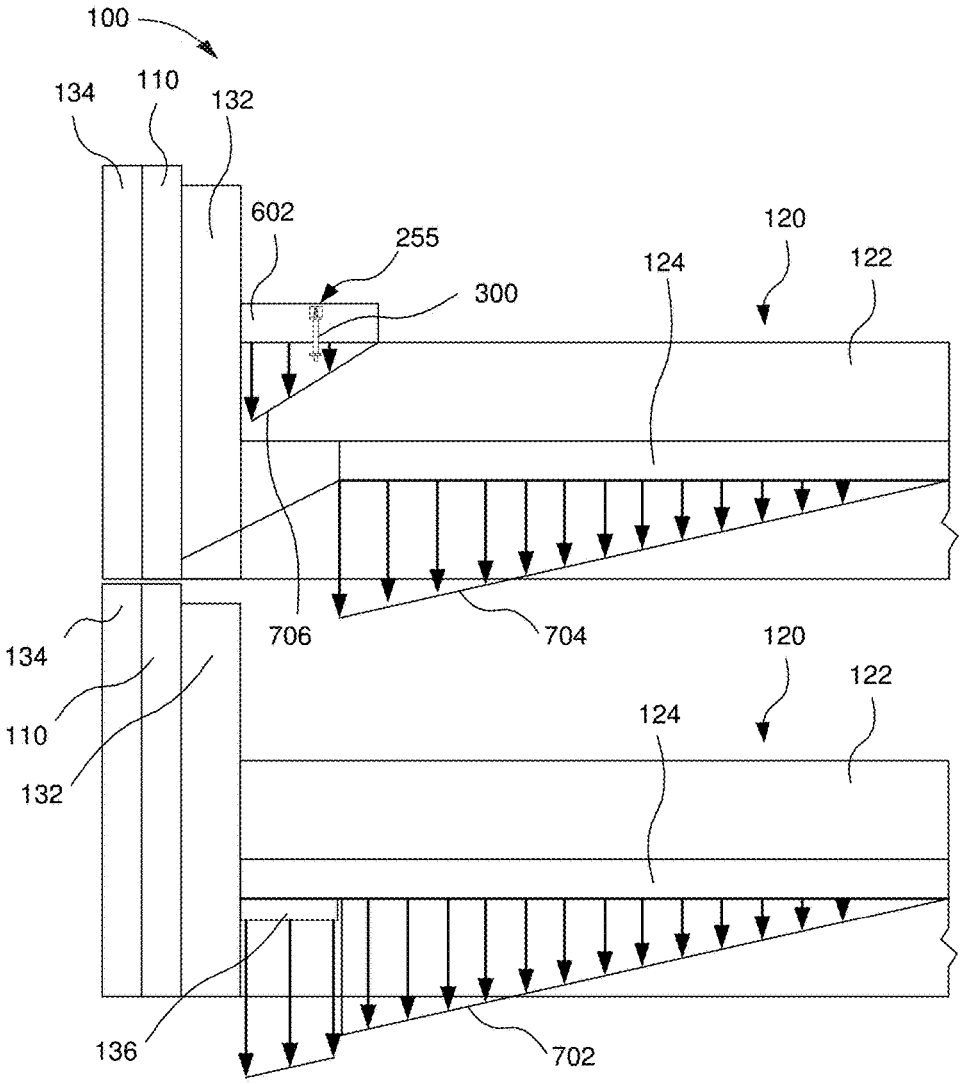
FIG. 39 is a side view illustrating another embodiment of a counterfort wall system in accordance with some embodiments of the present invention.

Referring now to FIG. 39, a side view illustrating another embodiment of a counterfort wall system 100 in accordance with some embodiments of the present invention is shown. Specifically, FIG. 39 illustrates loads exerted on the different tiers as they are configured differently. The lower tier utilizes a void replacement member 136 to support the counterfort beam 120 while the upper tier utilizes an upper support slab 602 without the use of a void replacement member 136. As is depicted on the lower tier, a first loading (depicted by arrows 702) is shown in relation to the counterfort beam 120 and the void replacement member 136.

Referring now to the upper tier, without a void replacement member 136, the loading, designated as a second loading (depicted by arrows 704) is shown in relation to the counterfort beam 120. The second loading is less than the first loading on the lower tier. To compensate, the upper support slab 602 is coupled to the upper counterfort beam 120. A third loading (depicted by arrows 706) is shown in relation to the upper support slab 602. If the third loading plus the second loading is at least equal to the first loading, the upper support slab 602 may be used in place of a void replacement member 136.

Figure 44:
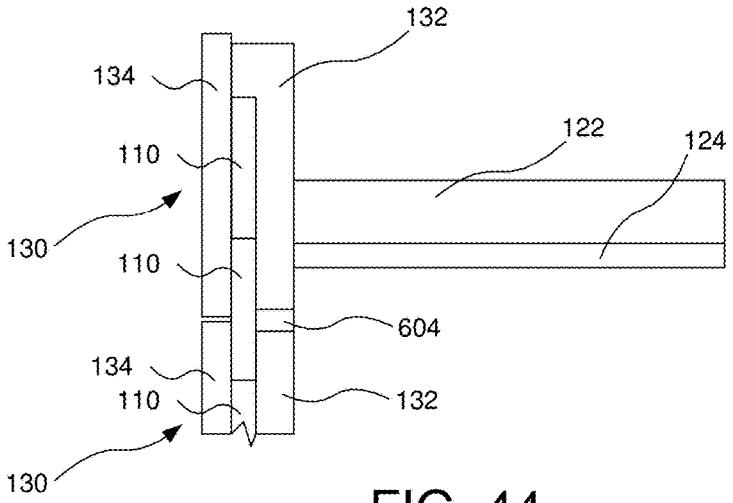
FIG. 44 is a side view illustrating another embodiment of a counterfort wall system in accordance with some embodiments of the present invention.

Referring now to FIG. 44, a side view illustrating another embodiment of a counterfort wall system in accordance with some embodiments of the present invention is shown. As discussed herein, a substantially vertical wall with coplanar wall tiers is possible because of a reduction of forces of upper tiers on lower tiers and allow for potential settlement so passive loads aren't possible. Some embodiments utilize gaps between the tiers to reduce or eliminate forces on adjacent lower tiers. As depicted in FIG. 44, a gap exists between the upper face joint member 130 shown in its entirety and the lower face joint member 130 shown as broken off. The gap may be filled by various materials including a section of compressible foam 604. The foam 604 may be rigid and/or compressible. The foam 604 may extend between the joint web 132 of the upper face joint member 130 and the joint web 132 of the lower face joint member 130. In some embodiments, the foam 604 may extend between both the joint webs 132 and the joint flanges 134 of the adjacent face joint members 130. Alternatively, the perimeter of the vertical counterfort stem can be covered so as to prevent any wall backfill from migrating to the void that would otherwise be present between subsequent counterfort tier stems.

Figure 40:
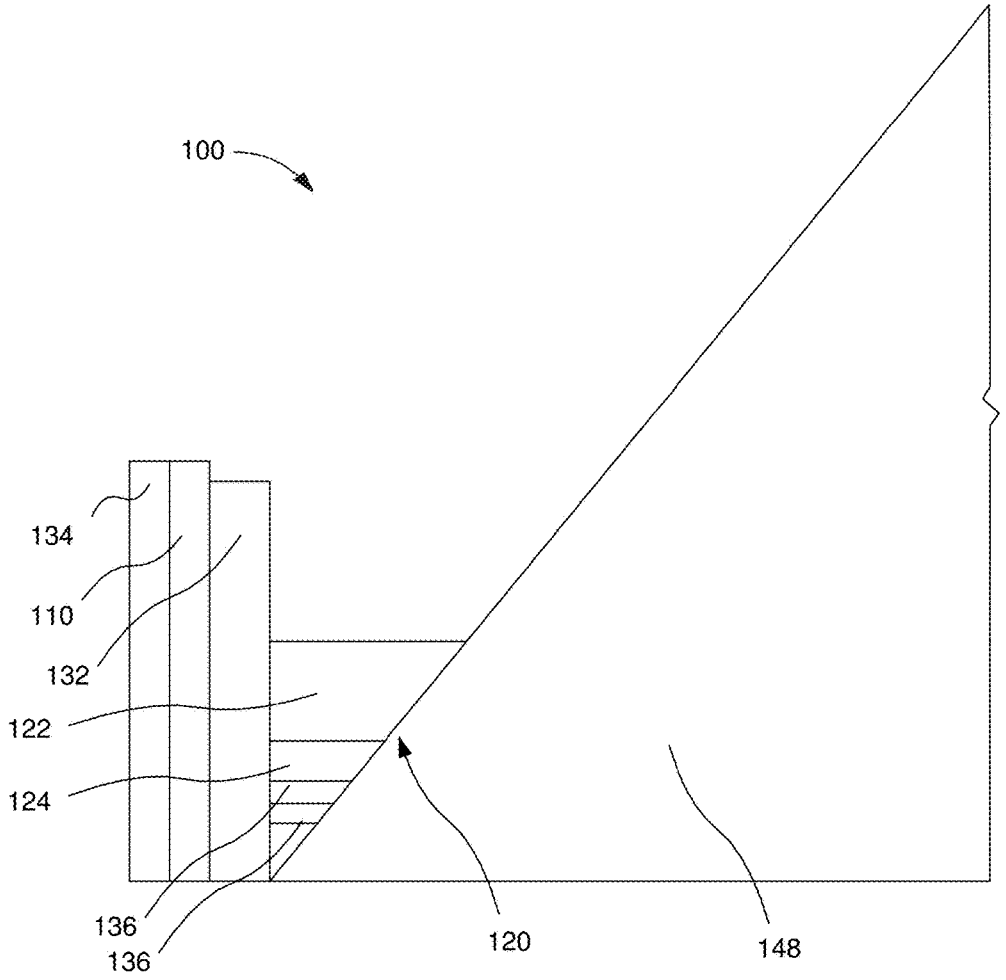
FIG. 40 is a side view illustrating another embodiment of a counterfort wall system in accordance with some embodiments of the present invention.
Figure 45:
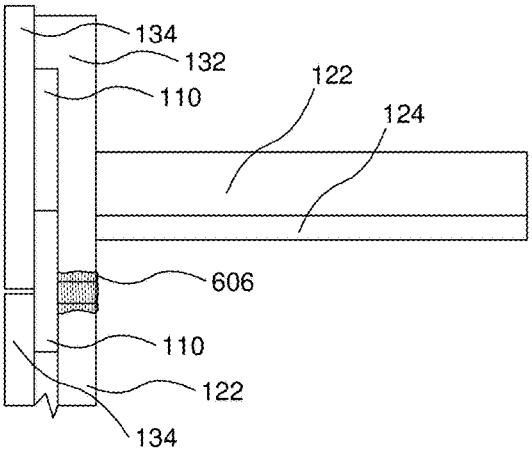
FIG. 45 is a side view illustrating another embodiment of a counterfort wall system in accordance with some embodiments of the present invention.

Referring now to FIG. 45, a side view illustrating another embodiment of a counterfort wall system in accordance with some embodiments of the present invention is shown. In FIG. 40, the gap between the upper face joint member 130 and the lower face joint member 130 is filled with a granular material (such as with void replacement material 561 or something similar) instead of a single piece. With granular material, the counterfort system may utilize a barrier 606 to contain or restrain the granular material from migrating under compression. In the illustrated embodiment, the barrier 606 extends from the joint web 132 of the upper face joint member 130 to the joint web 132 of the lower face joint member 130.

Figure 46:
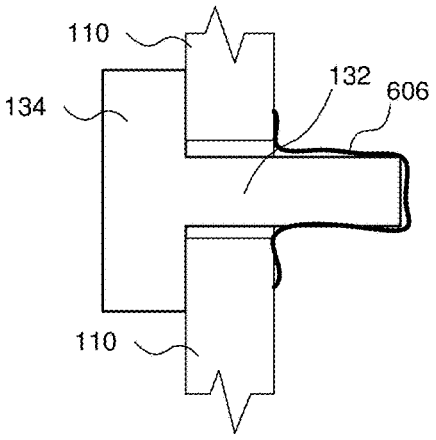
FIG. 46 is a top view illustrating another embodiment of a counterfort wall system in accordance with some embodiments of the present invention.

Referring now to FIG. 46, a top cutaway view illustrating another embodiment of a counterfort wall system in accordance with some embodiments of the present invention is shown. As depicted, the barrier 606 extends around the granular material and around the joint web 132 and against the wall panels 110. The barrier 606 may be a mesh barrier or geotextile or other fabric or formable material that can be pressed against and contain the granular material.

Figure 42:
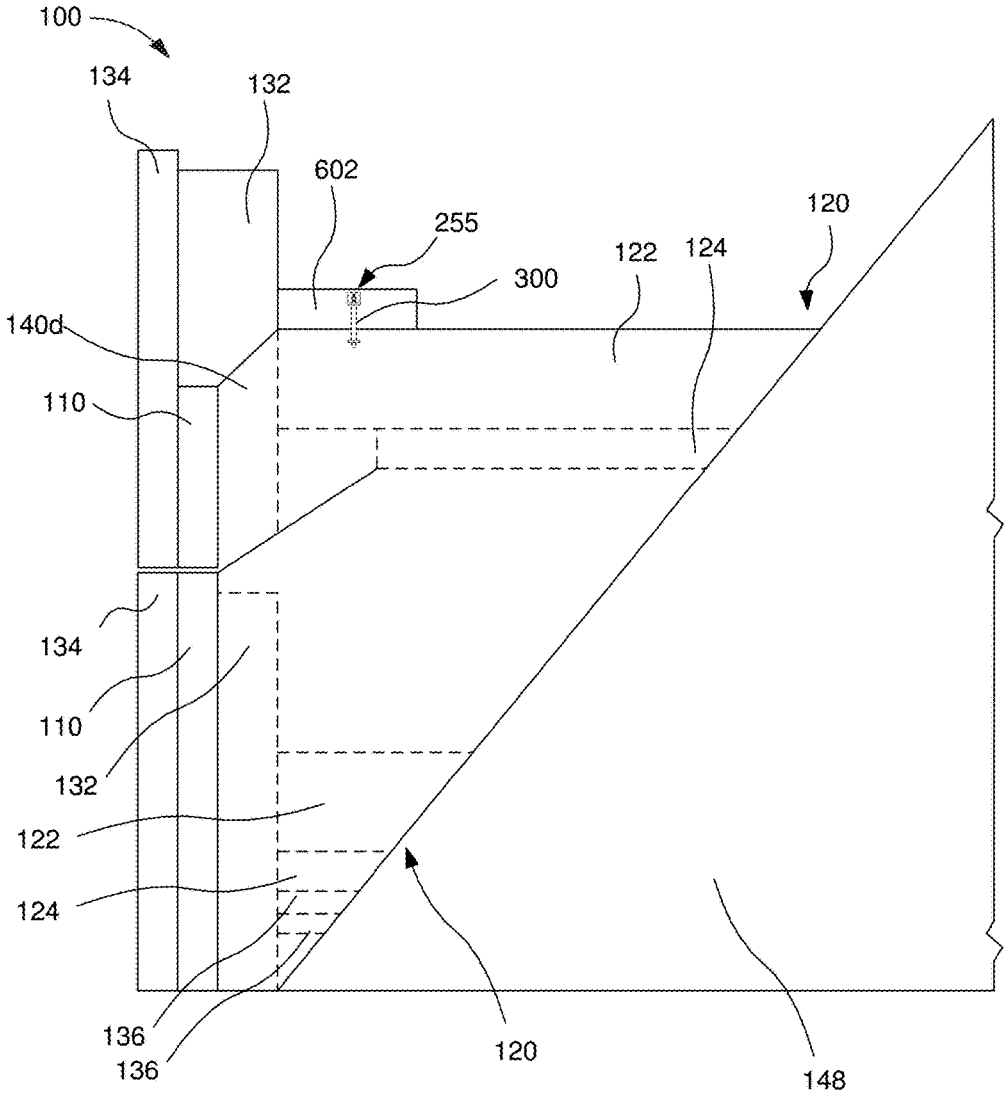
FIG. 42 is a side view illustrating another embodiment of a counterfort wall system in accordance with some embodiments of the present invention.
Figure 43:
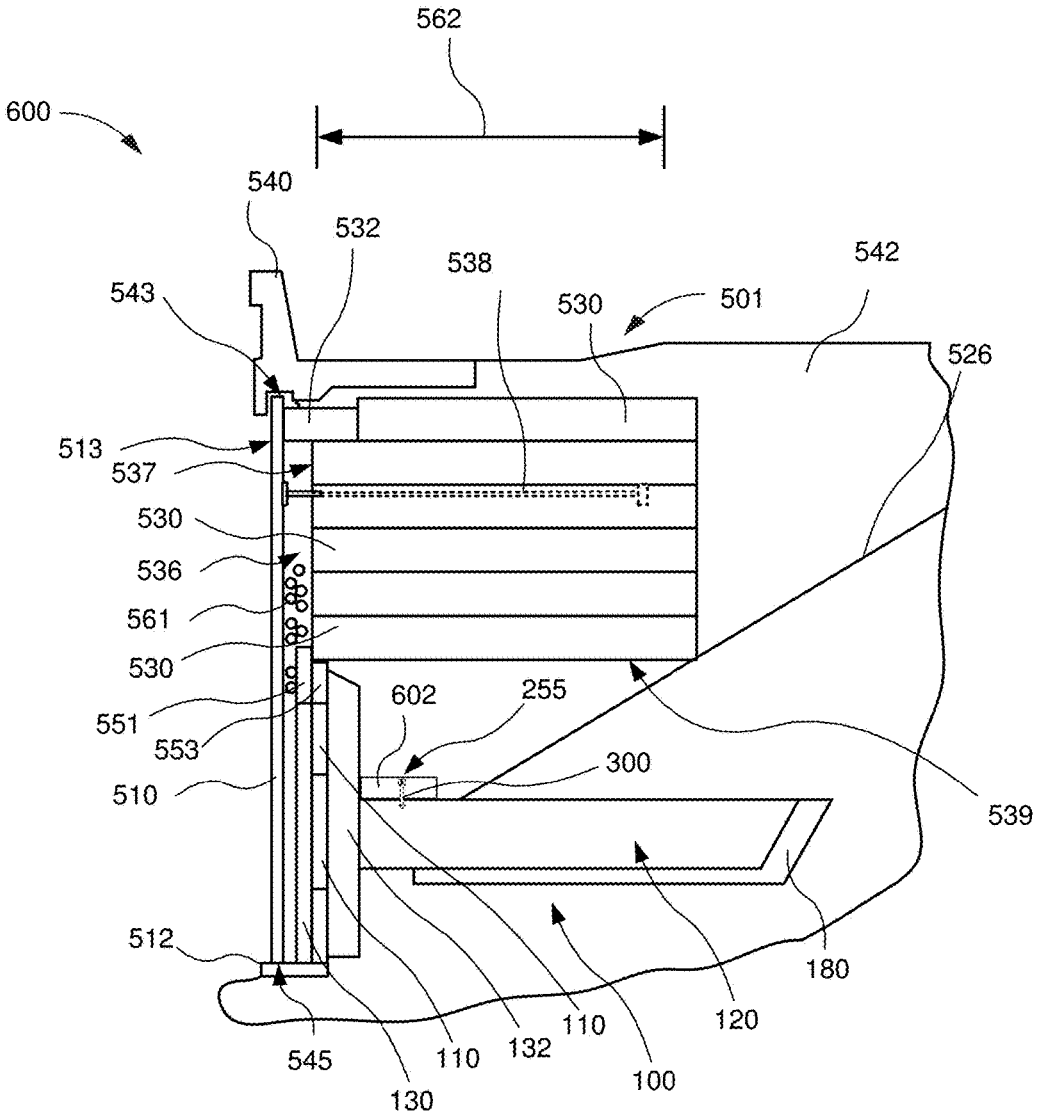
FIG. 43 is a side view illustrating a wall system in accordance with some embodiments of the present invention.

Referring now to FIG. 43, a side view illustrating a wall system 600 in accordance with some embodiments of the present invention is shown. The illustrated embodiment is similar to the embodiments depicted in FIGS. 37 and 32 and the many similarities are not repeated for the sake of brevity. However, as shown in FIG. 42, the counterfort retaining wall 100 includes an upper support slab 602 similar to what is described in conjunction with FIGS. 37 and 38, which further supports the counterfort beam 120 by coupling the upper support slab 602 to the counterfort web 122.

In some embodiments, the upper support slab 602 extends out beyond a width of the counterfort flange 124. In some embodiments, the upper support slab 602 is coupled to the counterfort web 122 by a sleeved threadbar 300 or other means. In some embodiments, the upper support slab 602 is adjacent to a joint web 132 of the face joint member 130. In some embodiments, the counterfort flange 124 does not span an entirety of the length of the counterfort beam 120 and the upper support slab 602 is parallel to the counterfort flange 124. In some embodiments, the upper support slab 602 extends over to above a first end of the counterfort flange 124. The size of the upper support slab 602 may adjusted based on the loading of a particular wall system.

Figure 41:
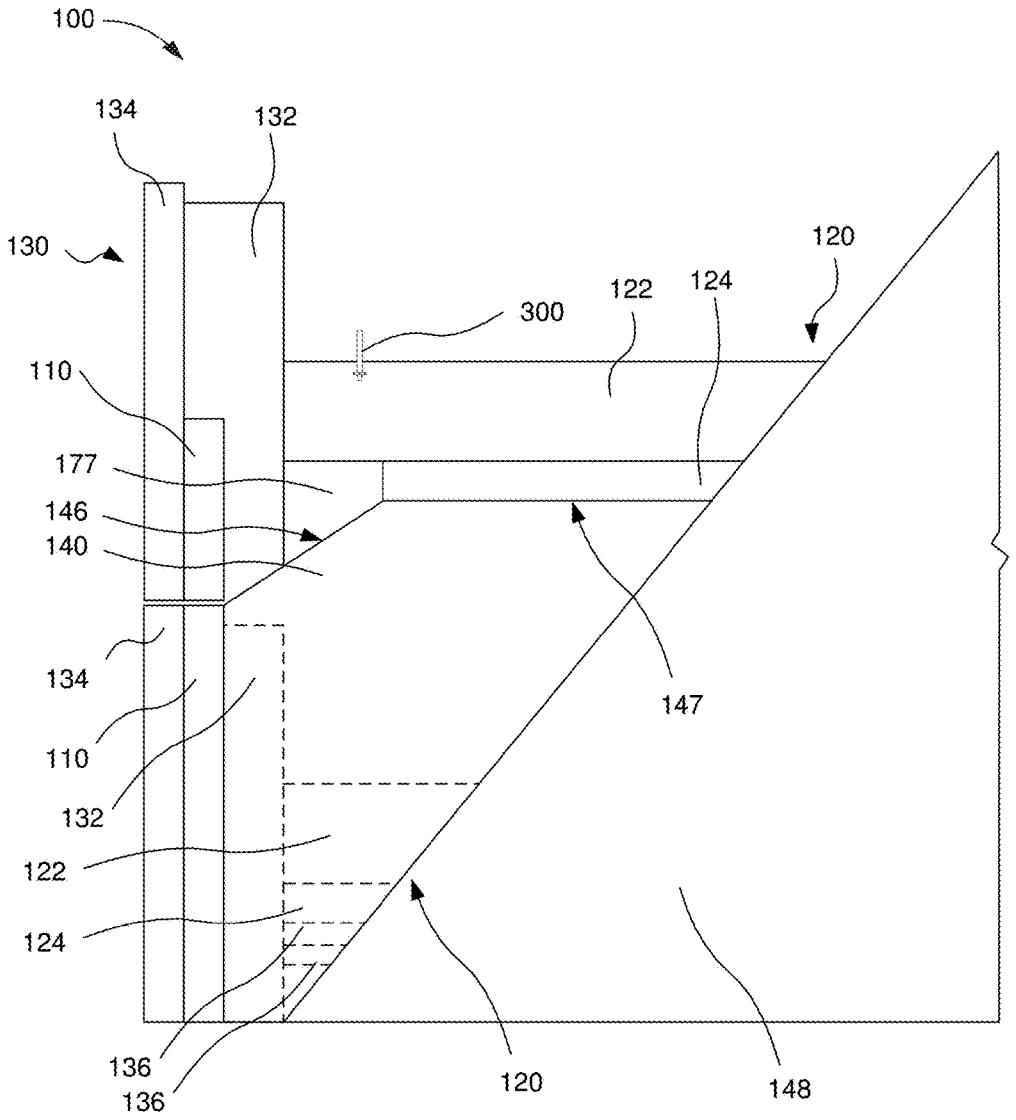
FIG. 41 is a side view illustrating another embodiment of a counterfort wall system in accordance with some embodiments of the present invention.

Referring now to FIGS. 40-42, a side view illustrating another embodiment of a counterfort wall system 100 in accordance with some embodiments of the present invention is shown. FIGS. 40-42 illustrate a few steps in a process of constructing a counterfort wall system 100. Other intermediary steps may be performed in addition to those outlined herein. Referring to FIG. 40, a sloped excavated cut 148 is shown, with a lower tier of the counterfort wall system 100 constructed. The lower tier includes void replacement members 136 similar to what is depicted in FIG. 39.

Referring now to FIG. 41, the lower tier has been covered with compacted backfill 140. The compacted backfill 140 extends up (on a sloped surface 146) from the lower tier wall panel 110. The upper tier of the counterfort wall system 100 may then be constructed with the counterfort flange 124 of the counterfort beam 120 placed on the horizontal plane 147 of the compacted backfill 140. The counterfort beam 120 is coupled to the face joint member 130 to form the upper tier. There exists a void 177 below the counterfort web 122 and above the compacted backfill 140. Once the upper tier is constructed and an upper wall panel 110 placed, additional backfill **140*d* (shown in FIG. 42) may be compacted to cover the upper counterfort beam 120. Because of the narrowness of the counterfort web 122, the additional backfill 140*d* may be compacted under the counterfort web 122**.

Referring now to FIG. 42, an upper support slab 602 is coupled to the counterfort beam 120 to further support the counterfort beam 120 as is described in conjunction with FIG. 39. Each succeeding tier may be built up in a similar manner as is described in conjunction with FIGS. 40-42.

Figure 53:
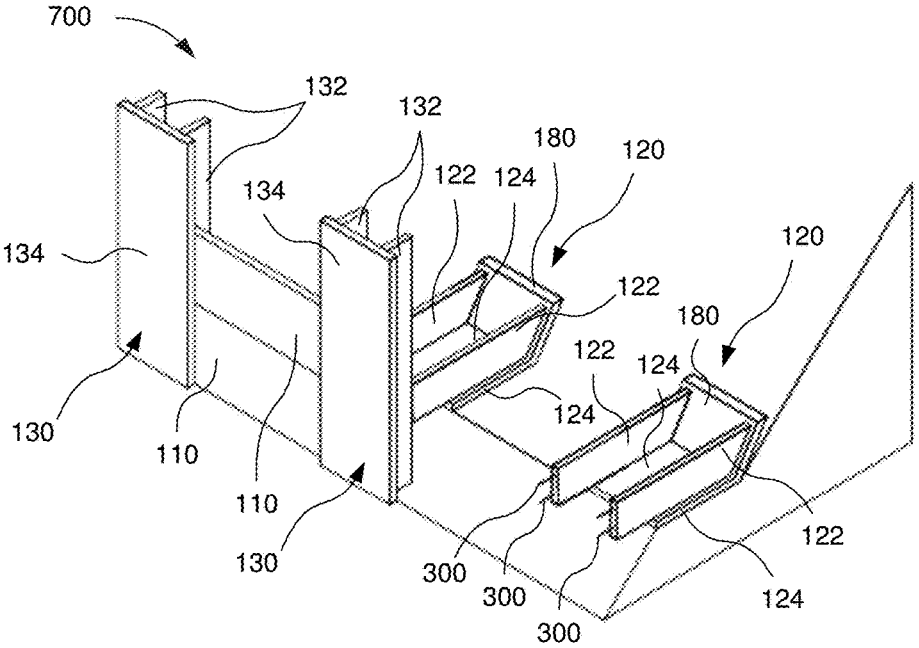
FIG. 53 is a perspective view of a wall system in accordance with some embodiments of the present invention.

Referring now to FIG. 53, a wall system 700 is shown. FIG. 53 depicts a perspective cut-away view illustrating the wall system 700 with a portion of the wall panels 110 and other components removed to allow for a proper understanding the various components of the wall system 700. The wall is depicted as only partially constructed to show the various components that would ultimately be set within and encapsulated in compacted backfill behind the wall. Although the wall system 700 is shown and described with certain components and functionality, other embodiments of the wall system 700 may include fewer or more components to implement less or more functionality.

In the illustrated embodiment, the wall panels 110 are rectangular slabs. In other embodiments, the wall panels may be formed or manufactured into other shapes and configurations. The wall panels 110 include a panel face which functions as the visible portion of the wall panels 110 upon completion of the wall. The panel face forms a substantially vertical two-dimensional plane.

The wall panels 110 include a first side panel edge, and a second side panel edge. In a fully constructed wall, the first side panel edge and the second side panel edge form, in some embodiments, a substantially vertical two-dimensional plane orthogonal to the panel edge as well as the top panel edge. Where two wall panels 110 meet at their side panel edges, the side panel edges form a vertical junction. However, instead of side panel edges being adjacent to a neighboring wall panel, a face joint member 130 is inserted into the vertical junction which separates the side panel edges from each other.

In the illustrated embodiment, the counterfort retaining wall 100 includes face joint members 130. The face joint members are placed in a substantially vertical position between adjacent wall panels 110. The face joint members 130 may alternatively be placed perpendicular to the grade at the top of the wall. The face joint members 130 include at least two joint webs 132 which are disposed between the side panel edge of a first wall panel and the side panel edge of a second wall panel at vertical junction.

The face joint members 130 further include a joint flange 134 which is visible upon completion of the wall. The joint flanges 134 include a substantially flat face and extend between the at least two joint webs 132 and out on either side of the at least two joint webs 132 and are configured to support the wall panels 110 as the panel faces rest against the joint flange 134. In some embodiments, the at least two joint webs 132 extend orthogonally or substantially orthogonally on an opposite side to the flat face.

In the illustrated embodiment, the counterfort retaining wall 100 includes a plurality of counterfort beams 120 which are each coupled to a face joint member 130 at a first end of the counterfort beam 120. The counterfort beams 120 are configured to extend back into the backfill 140 (not shown) and are configured to transfer forces exerted on the wall panels and the face joint members 130 back into the backfill 140.

The counterfort beams 120 may be of different shapes and configurations. In some embodiments, the counterfort beams 120 include at least two counterfort webs 122 and a counterfort flange 124. The at least two counterfort webs 122 and the counterfort flange 124 are in substantially orthogonal two-dimensional planes in which the counterfort flange 124 is in a horizontal two-dimensional plane and the at least two counterfort webs 122 are in a vertical two-dimensional plane. In some embodiments, substantially orthogonal is within five degrees of orthogonal.

The counterfort flange 124 forms the bottom surface of the counterfort beam 120 and extend between the at least two counterfort webs 122 and out on either side of the at least two counterfort webs 122. In some embodiments, the counterfort beam 120 is coupled to the face joint member 130 such that a bottom surface of the counterfort flange 124 is above a bottom edge of the face joint member 130. In some embodiments, the bottom surface of the counterfort flange 124 is above the horizontal junction 170 (not shown) between a lower tier of wall panels and an upper tier of wall panels or a lower tier of face joint members 130 and an upper tier of face joint members 130.

In some embodiments, the counterfort beam 120 is formed together with the face joint member 130 using monolithic construction. In some embodiments, the counterfort beam 120 and the face joint member 130 are separate pieces that are coupled together.

In some embodiments, the counterfort beam 120 is coupled to the face joint member 130 by a first connecting threadbar 300 that extends through a first one of the counterfort webs 122 of the counterfort beam 120 and into a first one of the webs 132 of the face joint member 130 and further coupled by a second connecting threadbar 300 that extends through a second one of the counterfort webs 122 of the counterfort beam 120 and into a second one of the webs 132 of the face joint member 130. In some embodiments, the connecting threadbar 300 comprises a grease layer between an inner metal threaded bar and an outer protective sleeve. In the illustrated embodiment, there are two connecting threadbars 300 in each counterfort web 122 of the counterfort beam 120.

Figure 54:
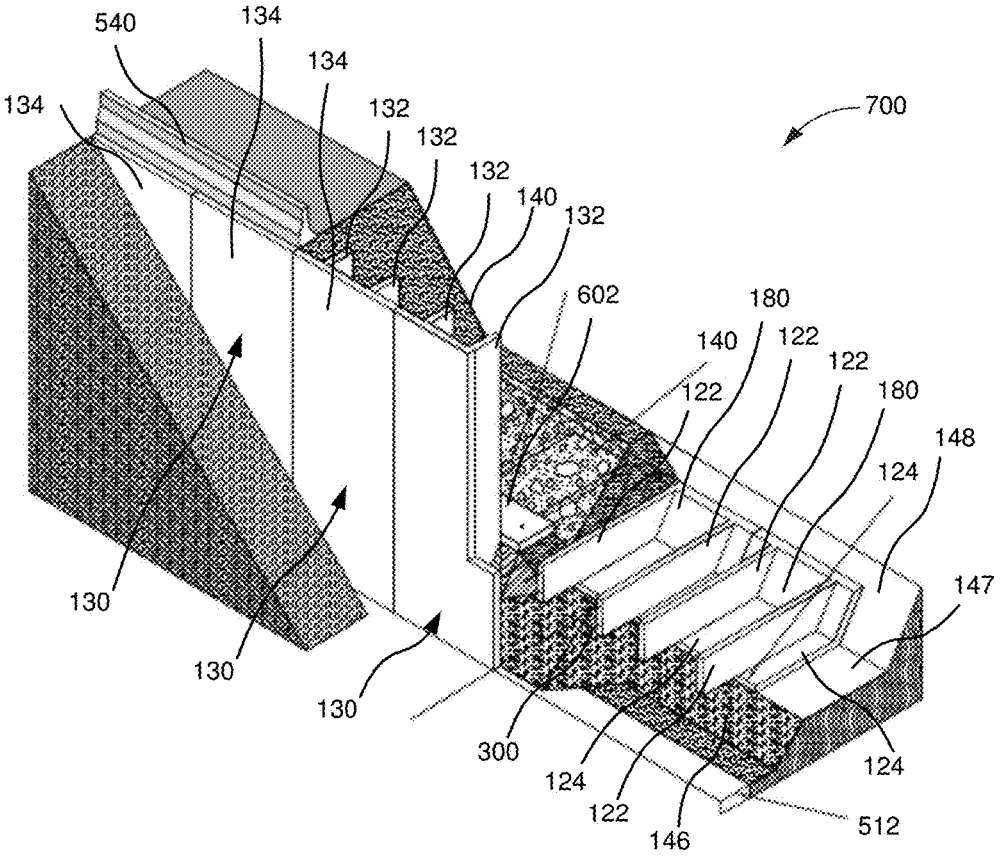
FIG. 54 is a perspective view of a wall system in accordance with some embodiments of the present invention.
Figure 55:
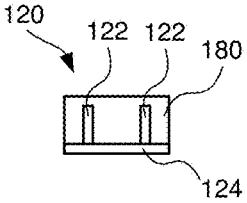
FIG. 55 is a front view of a multi-web counterfort beam in accordance with some embodiments of the present invention.
Figure 56:
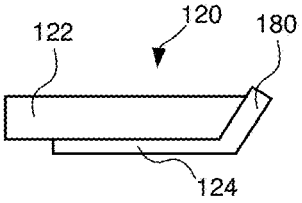
FIG. 56 is a side view of a multi-web counterfort beam in accordance with some embodiments of the present invention.
Figure 57:
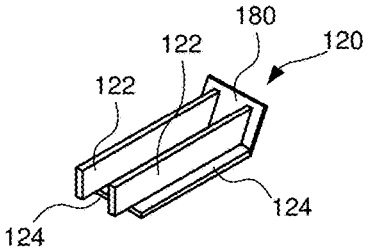
FIG. 57 is a perspective view of a multi-web counterfort beam in accordance with some embodiments of the present invention.

Referring now to FIG. 54, another embodiment of a wall system 700 is shown. The wall system of FIG. 54 (and other embodiments) does not include wall panels. The face joint members 130 (each including two webs 132) are placed adjacent to each other and connected to a respective counterfort beam 120. As discussed above, the counterfort beams 120 include two counterfort webs 122 that extend up from a counterfort flange 124. It is noted that, in some embodiments, more than two counterfort webs 122 may be included in a single counterfort beam 120.

It is further noted that the counterfort beams 120 depicted include a truncated counterfort flange 124. See FIGS. 55-57 for a front view (FIG. 55), a side view (FIG. 56), and a perspective view (FIG. 57) of a counterfort beam 120 according one or more embodiments. In other embodiments, the counterfort flange 124 may be similar to the counterfort flanges 124 of other embodiments described herein (see, for example, FIGS. 14-16 and 20-22 among others). Further, the counterfort beams 120 depicted include an inclined rear panel 180. In other embodiments, the rear panel 180 may be vertical or, in some implementations, the counterfort beam 120 may not include a rear panel 180. The rear panel 180 may be formed in monolithic construction with the remainder of the counterfort beam 120 or may be a separate piece coupled to the remainder of the counterfort beam 120.

The illustrated embodiment also depicts an upper support slab 602. The upper support slab. The upper support slab 602 may include some or all of the features described in conjunction with the other embodiments contemplated herein. With the counterfort beams 120 that include two (or more) counterfort webs 122, the upper support slab 602 is connected to the two (or more) counterfort webs 122 in a manner similar to what is described in other embodiments. The upper support slab 602 spans between the two counterfort webs 122 and beyond on each side of the two counterfort webs 122. This is depicted more clearly in FIGS. 66 and 67.

Figure 66:
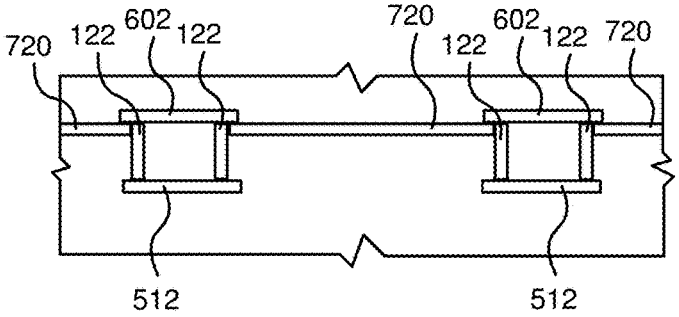
FIG. 66 is a front view of a wall system with wall panels and face joint members removed in accordance with some embodiments of the present invention
Figure 67:
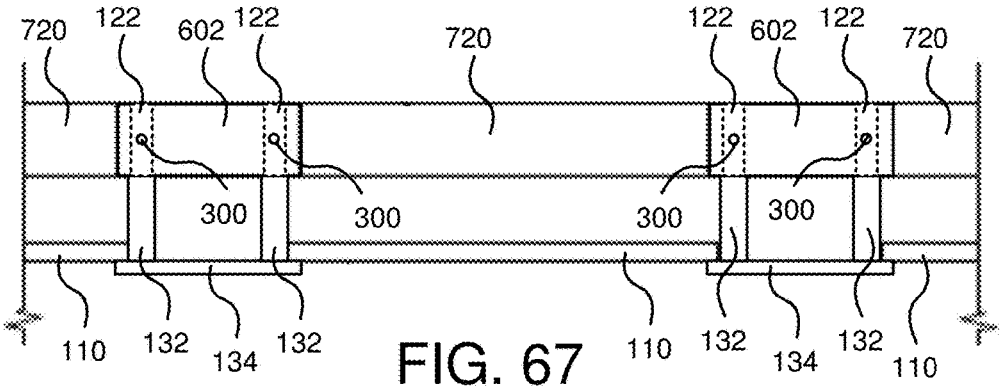
FIG. 67 is a top view of a wall system in accordance with some embodiments of the present invention.

In some embodiments, the upper support slabs 602 are adjacent each other in neighboring counterfort beams 120 (for a configuration similar to FIG. 54) or may have a large gap between (for a configuration similar to FIGS. 66 and 67).

As depicted, the counterfort beams are adjacent to each other or, more specifically, with the counterfort flanges 124 and the inclined rear panels 180 adjacent to each other. The increased surface area of the counterfort flanges 124 and inclined rear panels 180 with the multi web counterfort beams 120 allow for larger walls to be constructed. The increased surface area provides a larger resistance to an overturning moment exerted on the face joint members 130.

Figure 58:
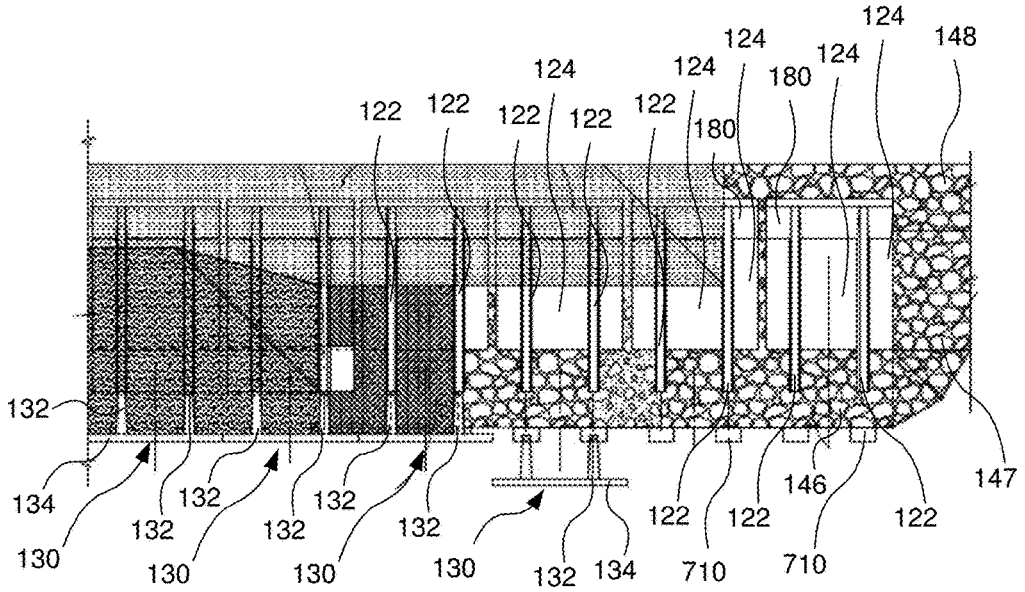
FIG. 58 is a top view of a wall system in accordance with some embodiments of the present invention.
Figure 59:
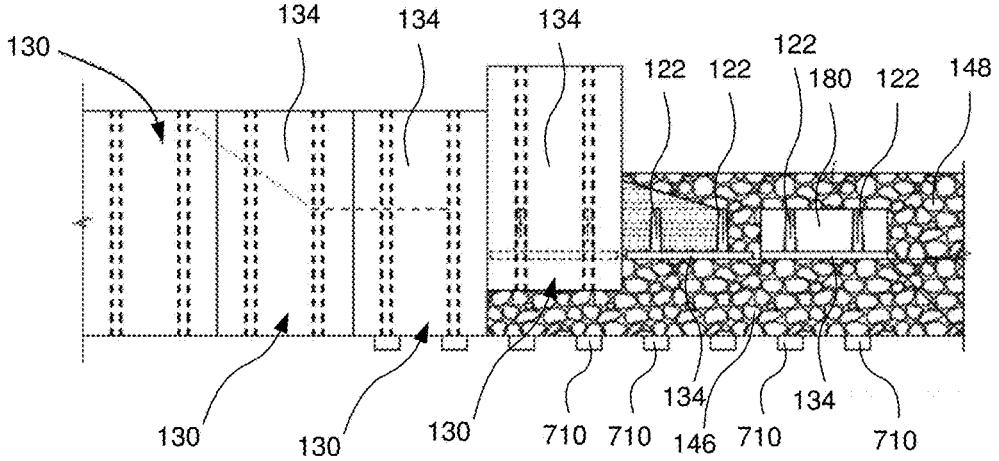
FIG. 59 is a front view of a wall system in accordance with some embodiments of the present invention.

Referring now to FIGS. 58 and 59, a top view and a front view of a wall system is shown (in a configuration similar to FIG. 54) without wall panels. The Figures depict a face joint member 130 that is in the process of being attached or coupled to counterfort beam. As depicted, the joint webs 132 align with the counterfort webs 122. That is, the face joint member 130 includes a number of joint webs 132 which is the same as the number of counterfort webs 122. The counterfort beams are connected to the face joint members 130 in any one of the manners contemplated herein.

Figure 60A:
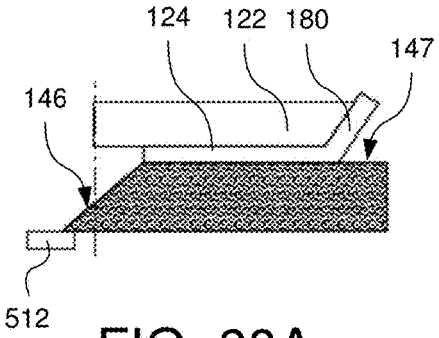
FIG. 60A-65B are side and front views depicting a process for erecting a wall system in accordance with some embodiments of the present invention.
Figure 61A:
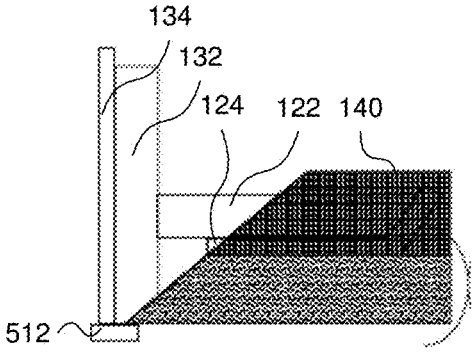

Referring now to FIGS. 60A-65B, one embodiment of a sequential process of how a wall system is constructed is depicted. FIGS. 60A-65A depict side views. FIGS. 60B-65B depict front views (with the face joint members removed for clarity). Referring to FIGS. 60A and 60B, the counterfort flange 124 of a counterfort beam is placed on a horizontal plane 147. Referring to FIGS. 61A and 61B, a face joint member 130 is coupled to the counterfort beam 120 with the joint webs 132 aligning with the counterfort webs 122. Backfill 140 is compacted above the counterfort flange 124 and inclined rear panel 180 as well.

Figure 62A:
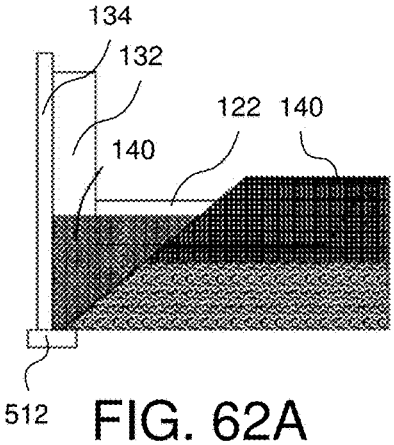
Figure 63A:
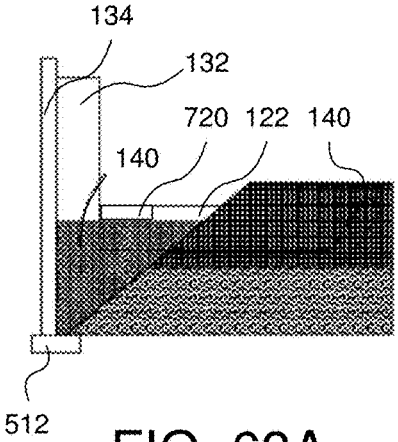
Figure 62B:
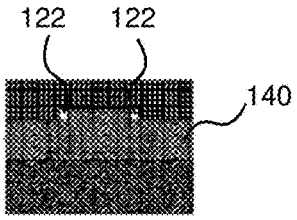
Figure 63B:
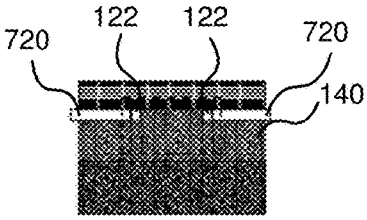

Referring now to FIGS. 62A and 62B, Backfill 140 is compacted near the face joint member and below the counterfort web 122 up to or near the top of the counterfort web 122. Referring now to FIGS. 63A and 63B, an intermediate slab 720 is placed between to separate counterfort beams 120 or, more particularly, between the counterfort web 122 of a first counterfort beam 120 and the counterfort web 122 of a second counterfort beam 120. This is depicted more clearly in FIG. 66. As shown, the intermediate slab 720 is positioned between two counterfort beams. The intermediate slab 720 rests on the compacted backfill 140. In some embodiments, the intermediate slab 720 may be directly or indirectly coupled to the counterfort webs 122.

Figure 64A:
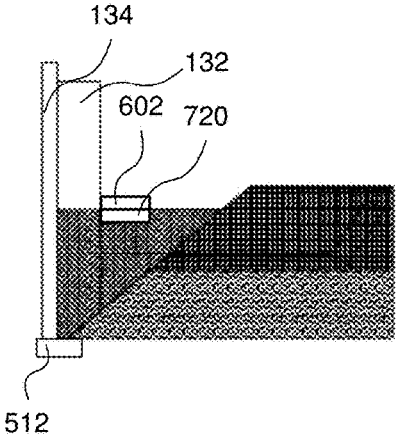
Figure 65A:
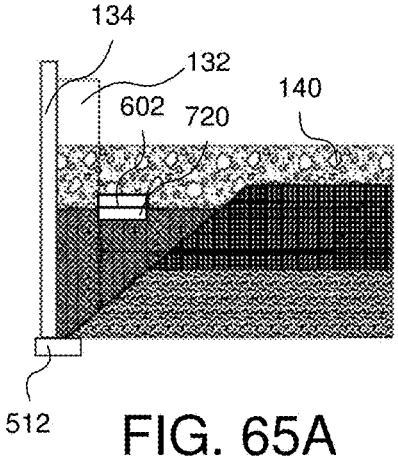
Figure 60B:
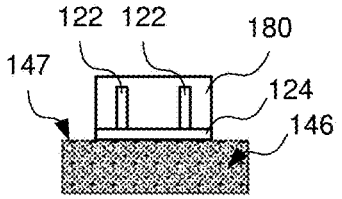
Figure 61B:
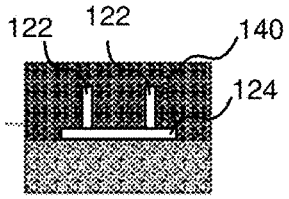
Figure 64B:
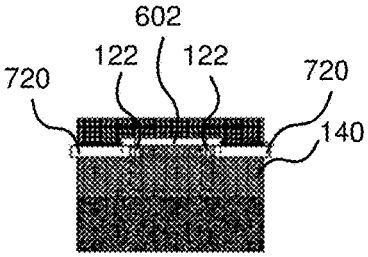
Figure 65B:
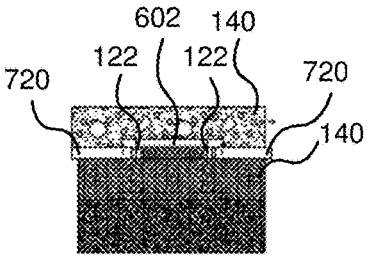

Referring now to FIGS. 64A and 64B, an upper support slab 602 is coupled to the counterfort webs. The upper support slab 602 spans between the two counterfort webs 122 and above a portion of the intermediate slabs 720 (see, for example, FIG. 66). The upper support slab 602 may be coupled to the counterfort webs 122 in a manner similar to the ways described in conjunction with other embodiments described herein. Referring now to FIGS. 65A and 65B, backfill is then placed over the intermediate slab 720, the upper support slab 602 and the counterfort beams 120.

Figure 68:
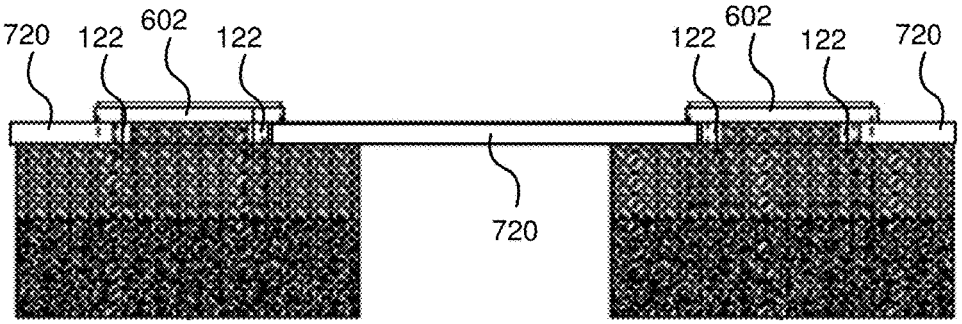
FIG. 68 is a front view of a wall system in accordance with some embodiments of the present invention.
Figure 69:
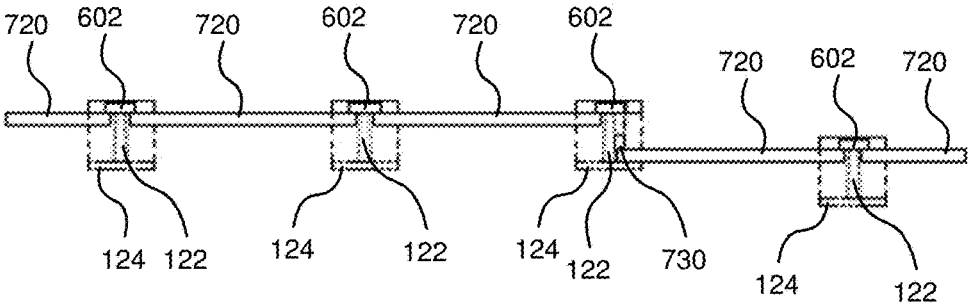
FIG. 69 is a front view of a wall system in accordance with some embodiments of the present invention.
Figure 70:
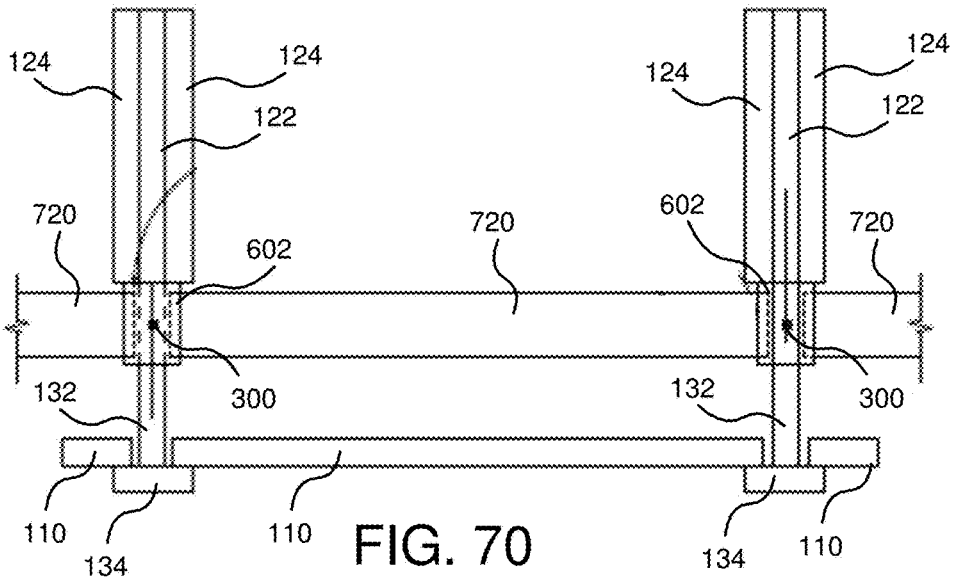
FIG. 70 is a top view of a wall system in accordance with some embodiments of the present invention.
Figure 71:
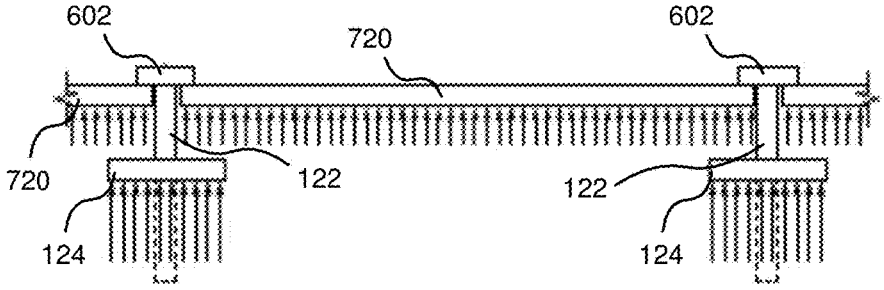
FIG. 71 is a front view of a wall system in accordance with some embodiments of the present invention.

Referring now to FIGS. 66-68, front views and a top views showing the spanning of intermediate slabs 720 between neighboring counterfort beams. Referring to FIGS. 69-71, it is shown that intermediate slabs 720 may be implemented in configurations with single web counterfort beams 120 as well. The intermediate slabs 720 allow for increased surface area of support as shown by FIG. 68.

Referring to FIG. 69, an embodiment demonstrating a wall system that accommodates grade changes. In the illustrated embodiment, the counterfort beams 120 are not all on the same horizontal plane. The counterfort beam 120 on the right of the Figure is positioned below the horizontal plane of the remainder of the counterfort beams 120. This may be done to facilitate a grade change in a wall system. As shown, the intermediate slab 720 is placed at the bottom of the counterfort web 122 (of the second counterfort beam from the right). A side shear curb 730 is attached to the counterfort web 122 to secure the intermediate slab 720 between the side shear curb 730 and the counterfort flange 124.

Figure 97:
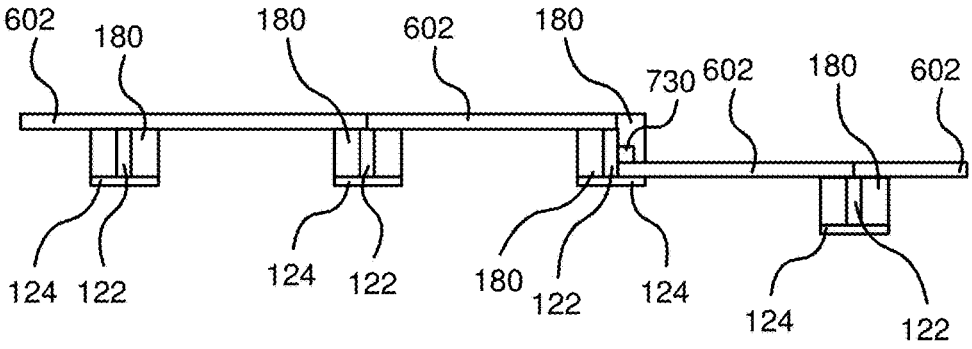
FIG. 97 is a front view of a wall system in accordance with some embodiments of the present invention.

Referring to FIG. 97, another embodiment including a side shear curb 730 is depicted. In FIG. 97, upper support slabs 602 span between counterfort webs 122 of neighboring counterfort beams 120. The side shear curb 730 allows for one upper support slab 602 to span between the counterfort flange 124 of one counterfort beam 120 to the counterfort web 122 of a neighboring counterfort beam 120. Upper support slabs 602 may be attached in a similar manner for multi-web counterfort beams with an upper support slab 602 spanning between one (of two) counterfort web 122 of a first counterfort beam 120 to another counterfort web 122 of a second counterfort beam 122. In other words, the upper support slabs 602 span between two different counterfort beams 122 instead of between the two counterfort webs 122 of a single counterfort beam 122.

Figure 72:
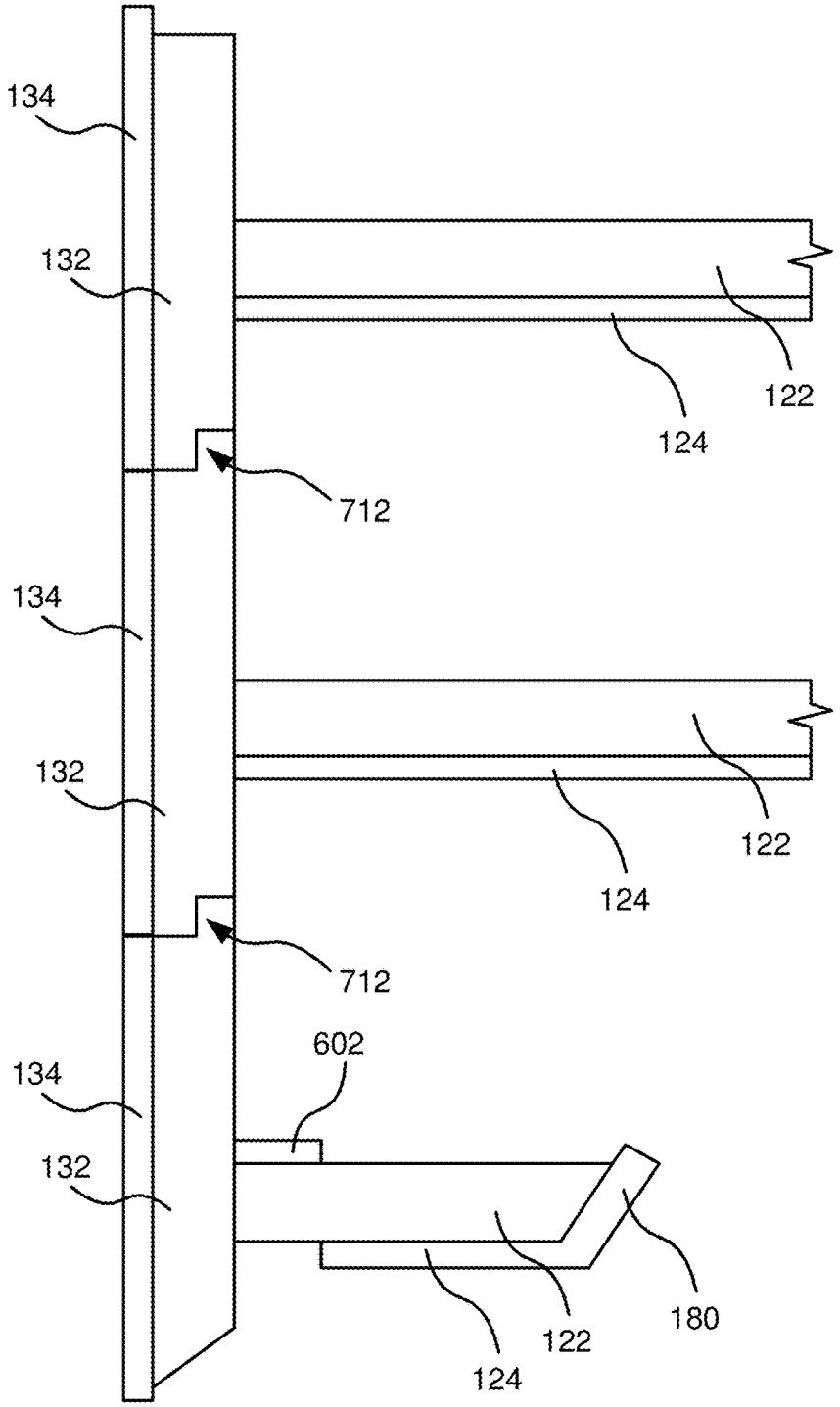
FIG. 72 is a side view of junctions of a wall system in accordance with some embodiments of the present invention.
Figure 73:
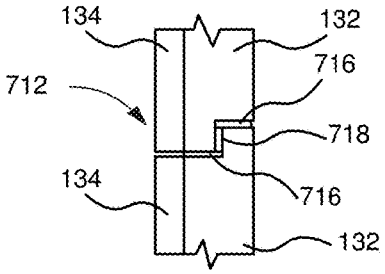
FIGS. 73-74 are side detail views of junctions of a wall system in accordance with some embodiments of the present invention.
Figure 74:
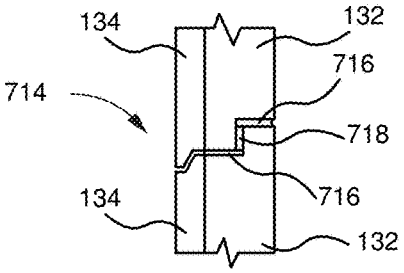

Referring now to FIGS. 72-74, various embodiments of junctions between tiers are depicted. Referring to FIG. 72, a side view of a multi-tier wall is shown with a junction 712 between tiers. The junction 712 includes complimentary jutting surfaces between the joint webs 132 of vertically neighboring face joint members 132. As shown in closer detail in FIG. 73, the junction 712 is formed by a jutting surface of a lower joint web 132 interfacing with a jutting surface of an upper joint web 132. As shown by FIG. 74, other types of complimentary jutting surfaces are contemplated including the shiplap junction 714 shown.

Further depicted in the closer detail, there is a gap between the upper and lower face joint members. In some embodiments, the gaps may be filled with a foam or low yield elastomeric 716 or other support member 718 that protects against impacts or contact upon settlement that may occur between tiers.

Figure 75:
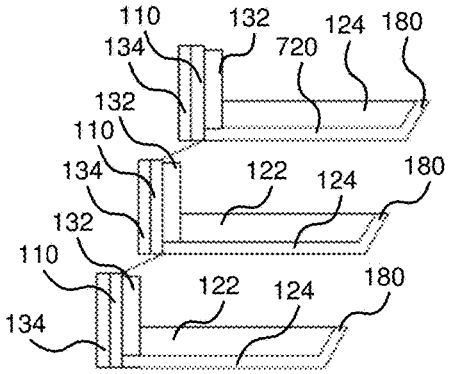
FIGS. 75-77 are side views of wall systems in accordance with some embodiments of the present invention.
Figure 77:
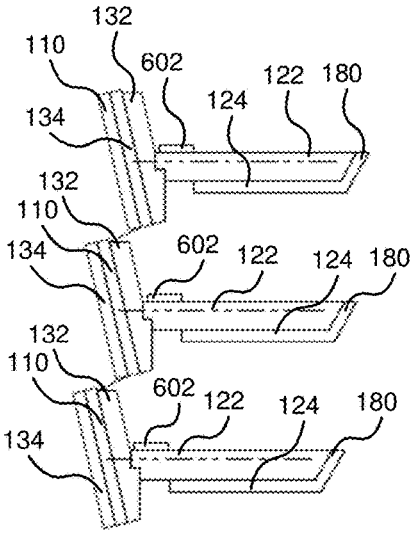
Figure 76:
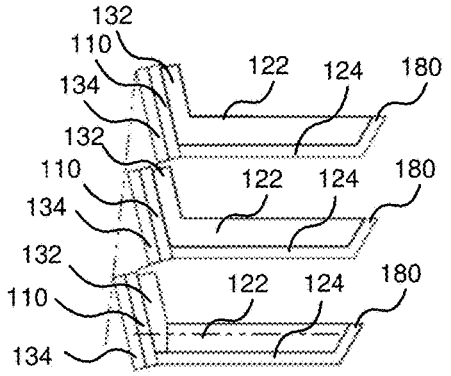

Referring now to FIG. 75, another embodiment of a tiered wall system is shown. As depicted, in some embodiments, the tiers of a wall system may be parallel to each other but not collinear or in the same plane. Referring to FIGS. 76 and 77, the tiers of a wall system may be inclined in which the counterfort beams 120 are not orthogonal to the face joint members 130. Various embodiments may include combinations of these various configurations which are implemented to support a particular application of the embodiments described herein.

Figure 78:
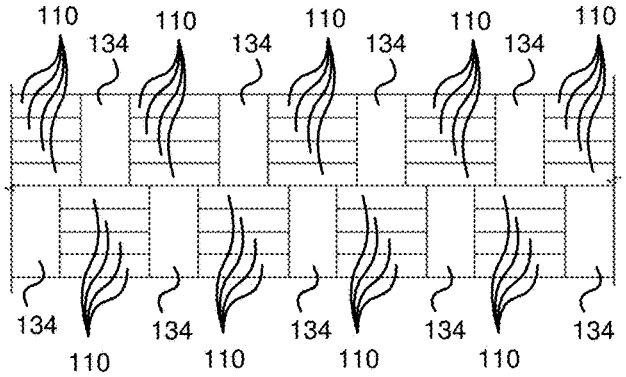
FIG. 78 is a front view of a wall system utilizing multi-web counterforts in accordance with some embodiments of the present invention.
Figure 79:
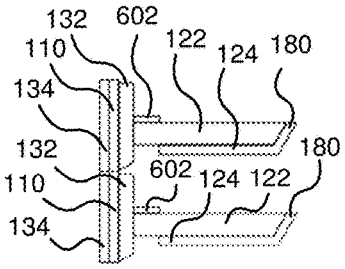
FIG. 79 is a side view of the wall system of FIG. 78 in accordance with some embodiments of the present invention.
Figure 80:
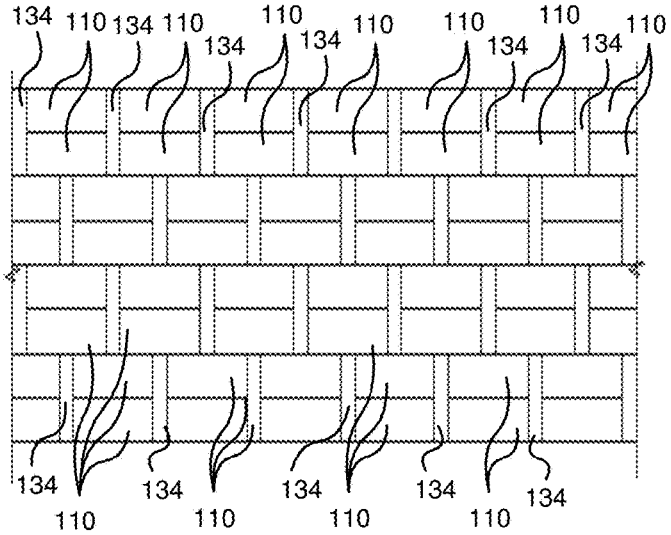
FIG. 80 is a front view of a wall system utilizing single-web counterforts in accordance with some embodiments of the present invention.
Figure 81:
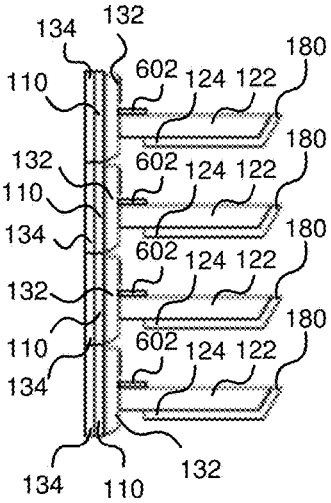
FIG. 81 is a side view of the wall system of FIG. 80 in accordance with some embodiments of the present invention.

Referring to FIGS. 78 and 79, a front and side view of a wall system is shown. As shown, in some embodiments, the face joint members 130 of one tier of a wall system may be misaligned with the face joint members 130 of a vertically neighboring tier. In similar fashion, with the multi-web counterfort beams of FIGS. 78 and 79, the single web counterfort beams of FIGS. 80 and 81 also may misalign the face joint members 130 in vertically neighboring tiers.

Figure 82:
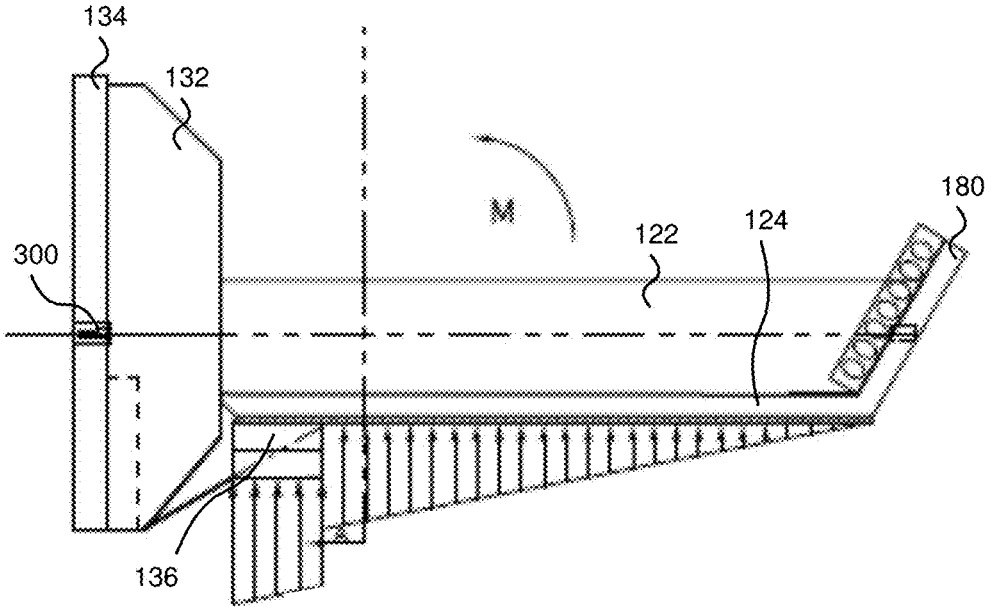
FIG. 82-83 are side views of a counterfort beam and face joint member in accordance with some embodiments of the present invention.
Figure 83:
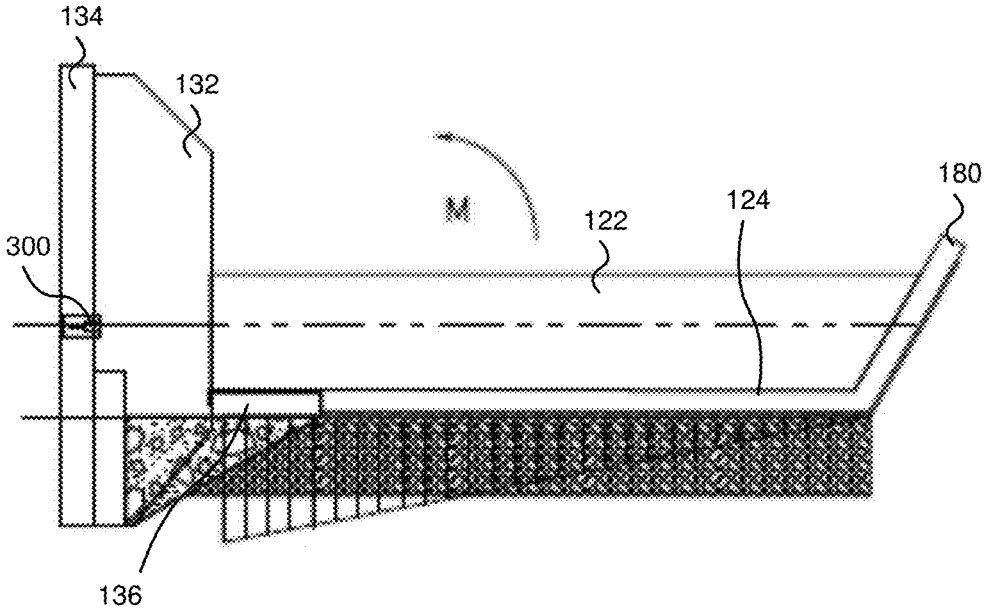

Referring now to FIGS. 82 and 83, a uniform load distribution (see FIG. 83) is contrasted with an induced concentrated load under void replacement member 136 that is placed before placement of the counterfort beam 120 (as is the case in FIG. 82). Both Figures also depict the moment (depicted by arrow M).

Figure 84:
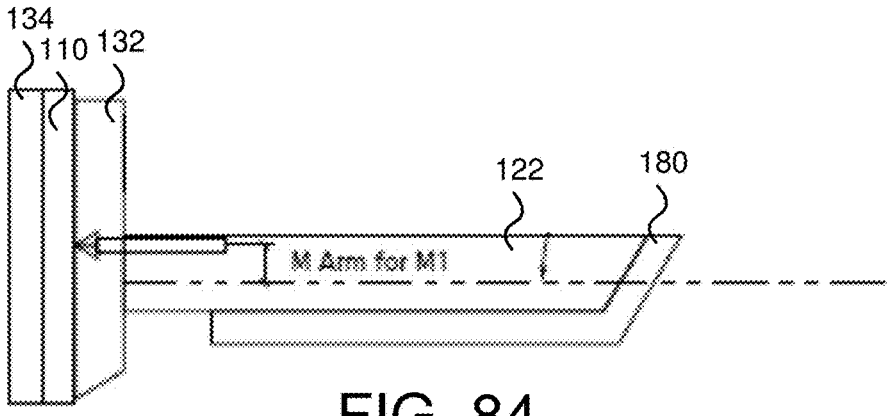
FIG. 84 is a side view of a counterfort beam and face joint member in accordance with some embodiments of the present invention.
Figure 85:
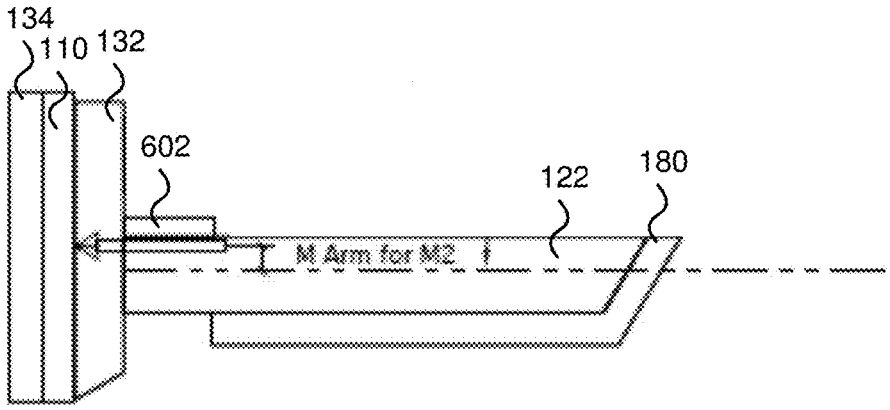
FIG. 85 is a side view of a counterfort beam and face joint member with an upper support slab in accordance with some embodiments of the present invention.
Figure 86:
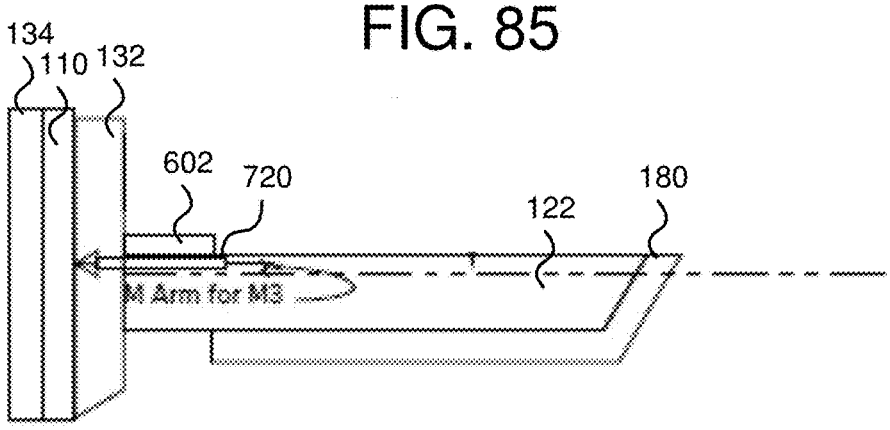
FIG. 86 is a side view of a counterfort beam and face joint member with an upper support slab and intermediate slab in accordance with some embodiments of the present invention.

Referring now to FIGS. 84-86, the moment arm of the overturning force is contrasted between a configuration without an upper support slab 602 or intermediate slab 720 (FIG. 84), a configuration with an upper support slab 602 and no intermediate slab 720 (FIG. 85), and a configuration with both an upper support slab 602 and an intermediate slab 720 (FIG. 86). As shown, the moment arm for the resultant force exerted on each configuration changes with the largest moment arm for the configuration of FIG. 84. A smaller moment arm is present for the configuration of FIG. 85 than that of the configuration of FIG. 84. The configuration of FIG. 86 has the smallest moment arm in comparison to the configurations of FIGS. 84 and 85. As can be appreciated the magnitude of the moment decreases as the center of gravity gets closer to the resultant load on the wall panels and face joint members.

Figure 87:
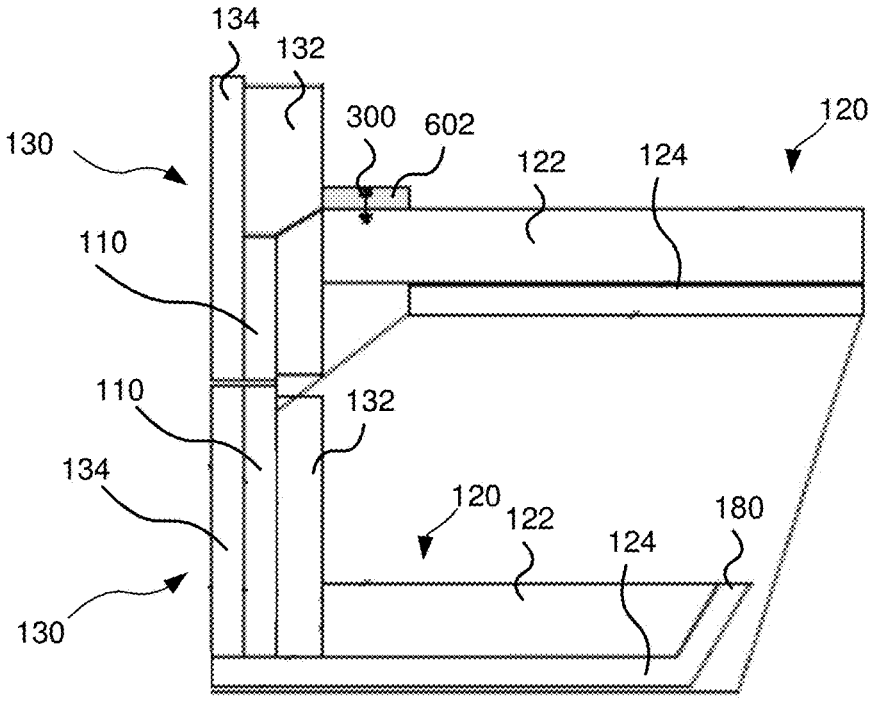
FIG. 87-90 are side views of a counterfort beam and face joint member in accordance with some embodiments of the present invention.
Figure 88:
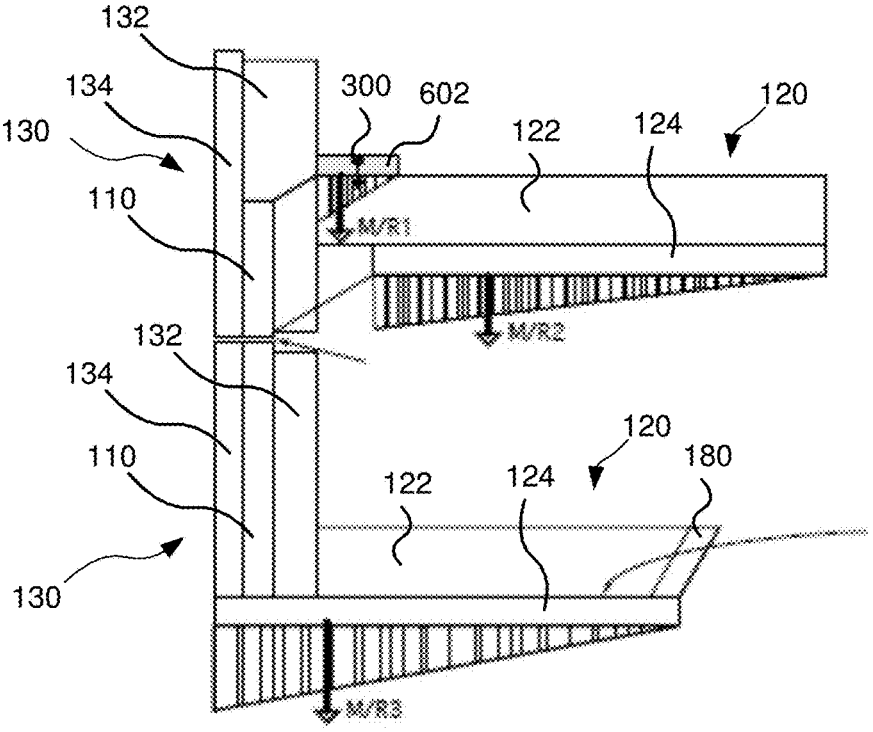

Referring now to FIGS. 87 and 88, another configuration of counterfort beam 120 and face joint member 130 is shown. As shown, the lower tier includes a counterfort beam 120 that is positioned at the bottom of face joint member 130. FIG. 88 depicts the loads imposed on the two configurations with the upper tier depicting the load distributed between the upper support panel 602 and the counterfort flange 124 and the lower tier depicting the load distributed on the counterfort flange 124 which extends all the way to the front of the face joint member 130.

Figure 89:
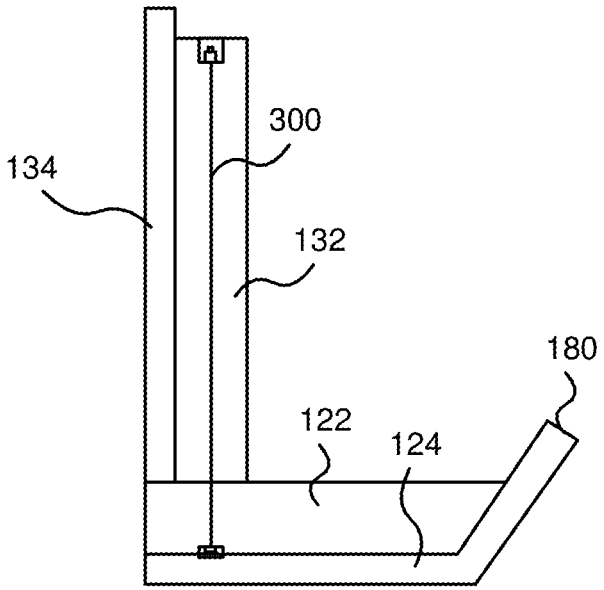
Figure 90:
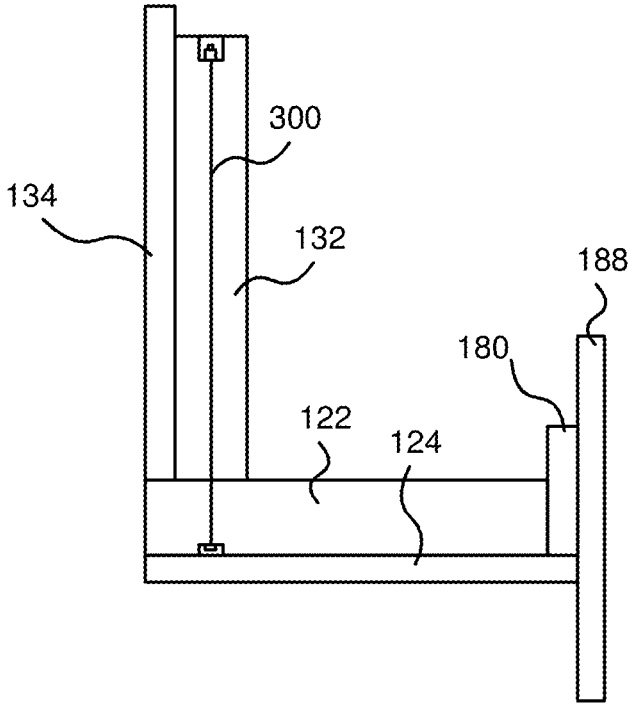

Referring to FIGS. 89-96, various other coupling configurations between counterfort beams 120 and face joint members 130 are shown. Referring to FIG. 89, the face joint member 130 is coupled to the counterfort beam 120 with the bottom of the joint web 132 adjacent and abutting the top of the counterfort web 122 of the counterfort beam 120. The face joint member 130 and the counterfort beam 120 are coupled together by a vertical connecting threadbar 300 that runs through the joint web 132 and into the top of the counterfort web 122. Referring to FIG. 90, another embodiment similar to FIG. 89 is shown with a vertical rear panel 180.

Figure 91:
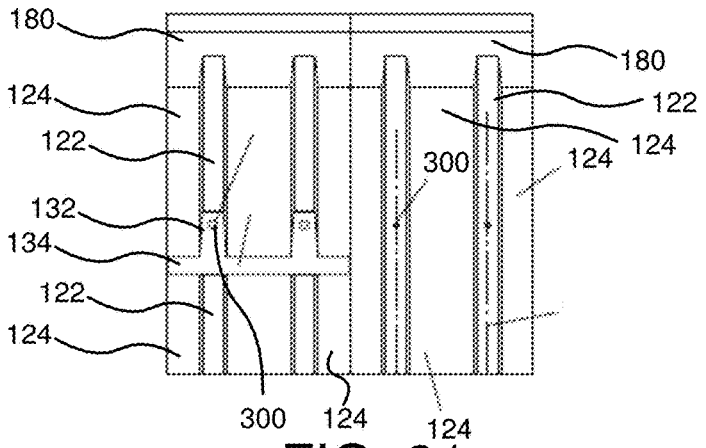
FIG. 91 is a top view of a counterfort beam and face joint member in accordance with some embodiments of the present invention.
Figure 92:
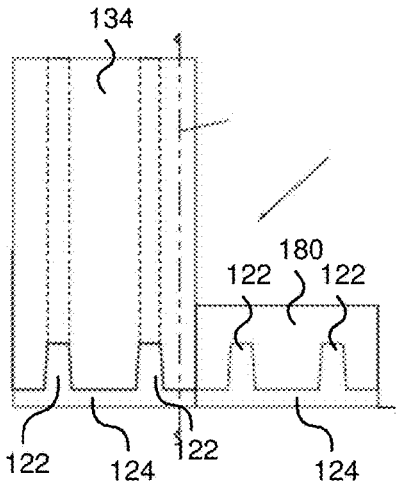
FIG. 92 is a front view of a counterfort beam and face joint member in accordance with some embodiments of the present invention.
Figure 93:
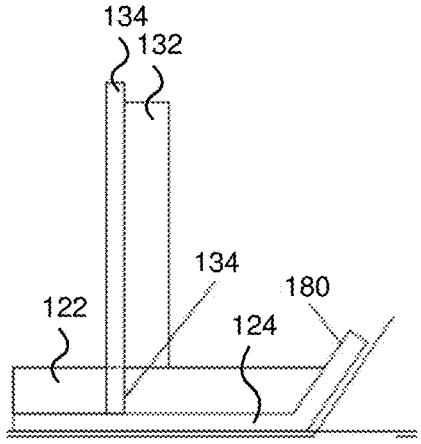
FIG. 93 is a side view of a counterfort beam and face joint member in accordance with some embodiments of the present invention.

Referring now to FIGS. 91-93, another configuration is shown with the face joint member 130 set back from the front of the counterfort beam 120. FIG. 91 is a top view showing the counterfort web 122 to run underneath the face joint member 130. FIG. 92 is a front view that shows the joint flange 134 with a bottom surface that compliments and interfaces with the counterfort webs 122. FIG. 93 is a side view of the configuration.

Figure 94:
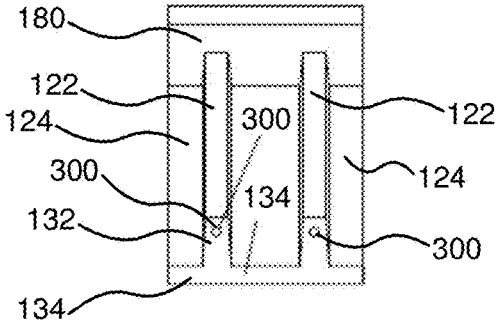
FIG. 94 is a top view of a counterfort beam and face joint member in accordance with some embodiments of the present invention.
Figure 95:
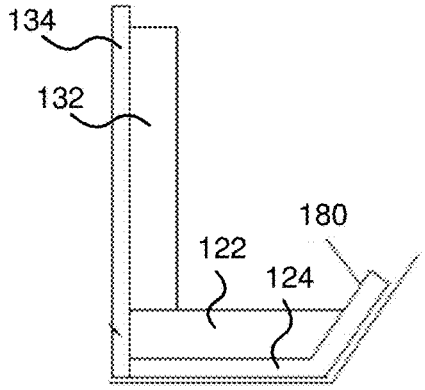
FIG. 95 is a side view of a counterfort beam and face joint member in accordance with some embodiments of the present invention.
Figure 96:
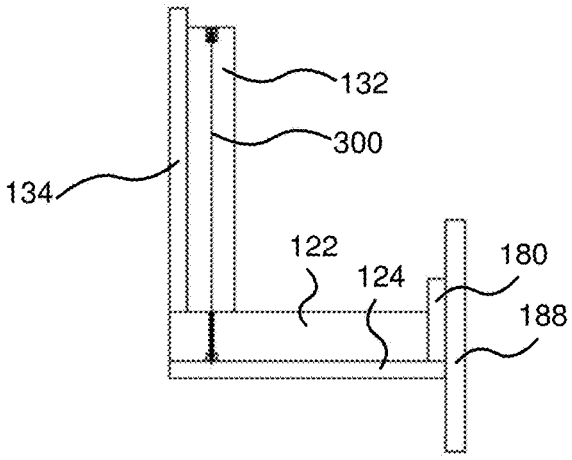
FIG. 96 is a side view of a counterfort beam and face joint member in accordance with some embodiments of the present invention.

Referring to FIGS. 94 and 95, another configuration is shown. In the illustrated embodiment, the joint flange 134 extends in front of the counterfort webs 122. The joint web 132, however, is positioned above the counterfort webs 122. Referring to FIG. 96, another configuration is shown. In the illustrated embodiment, the joint flange 134 stops above the counterfort webs 122 of the counterfort beam 120. For the sake of brevity, not all configurations contemplated are shown herein. It is contemplated that various coupling arrangements between a counterfort beam 120 and face joint member 130 that does not depart from the spirit of the embodiments described herein.

Figure 98:
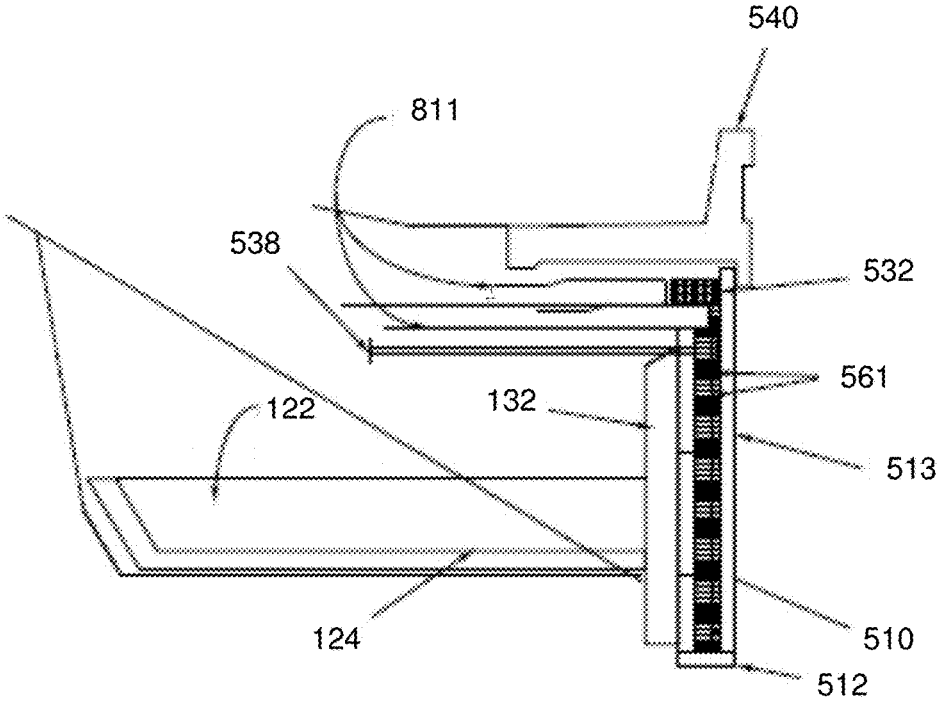
FIG. 98 is a side view of a wall system in accordance with some embodiments of the present invention.

Referring now to FIG. 98, another configuration of a wall system is shown. The wall system includes a counterfort wall (which may be similar to any counterfort wall described herein) and a fascia panel 510. The fascia panel 510 may be utilized with a counterfort wall and no MSE wall. The illustrated embodiment includes gabion 811 or another similar wirework container but some embodiments may not include gabion 811 or anything equivalent.

Figure 99:
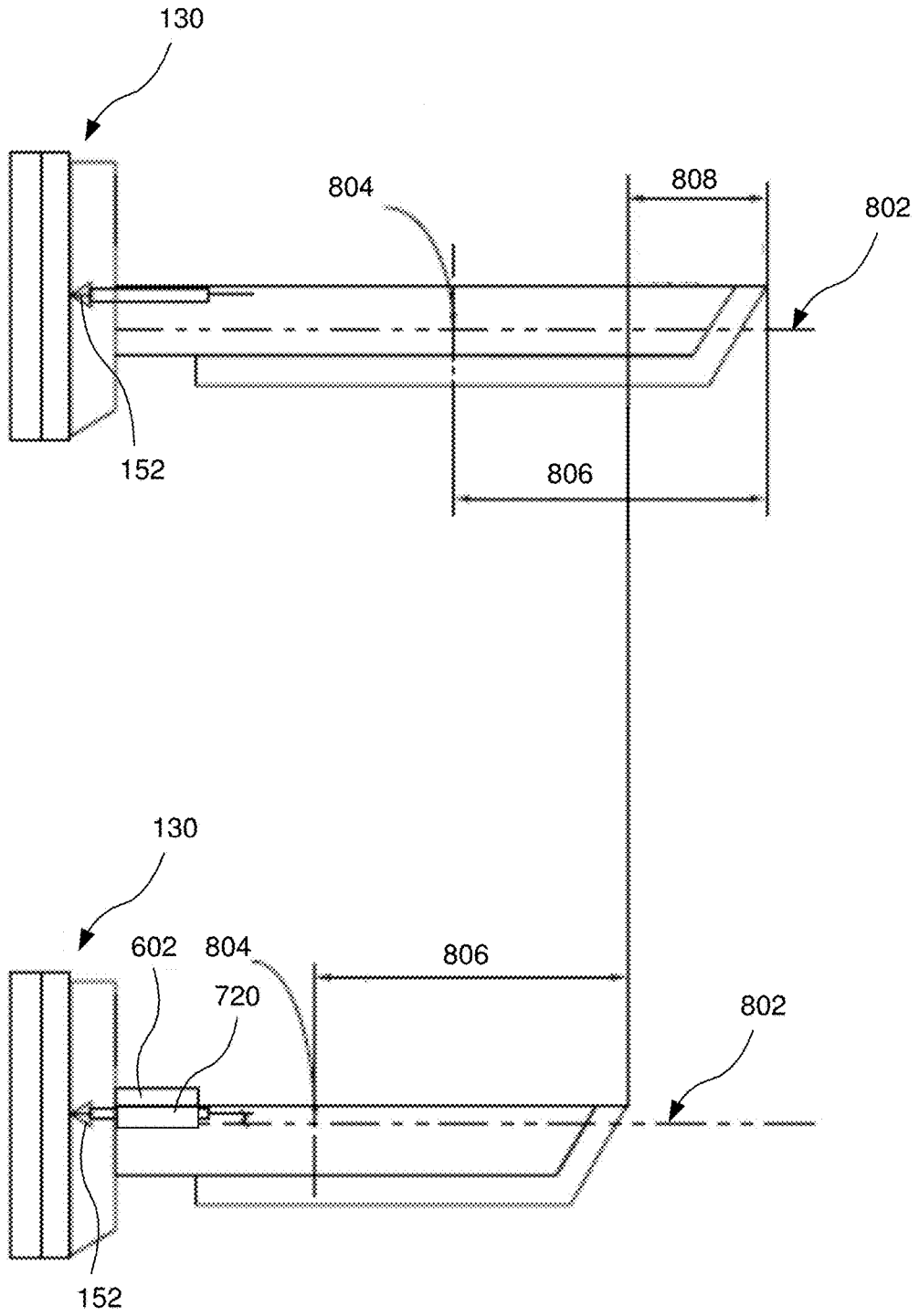
FIG. 99 is a side view of a wall system in accordance with some embodiments of the present invention.

Referring now to FIG. 99, a contrast between the length of a counterfort beam 120 in systems that utilize an upper support slab 602 and an intermediate slab 720 is contrasted to the length of a counterfort beam 120 that does not utilize an upper support slab 602 and an intermediate slab 720 each with an equivalent resultant load (depicted as arrows 152). In the illustrated embodiment, the location of the center of gravities is depicted by lines 802 and 804. The vertical center of gravity (depicted by line 802) is shifted up closer to the resultant load (depicted by arrow 152) in the counterfort beam that utilizes an upper support slab 602 and an intermediate slab 720. As such the difference in overturning moment (moment arm 806 is depicted for both counterfort systems) allows the length of the counterfort beam to be shortened by length 808. Embodiments that utilize an upper support slab 602 and/or an intermediate slab 720 may allow for a reduction in the length of counterfort beams 120 needed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A wall system, comprising: a face joint member comprising a substantially flat face and at least two webs extending orthogonally on an opposite side to the flat face; and a counterfort beam coupled to the face joint member, wherein the counterfort beam comprises at least two counterfort webs extending from a counterfort flange that extends between the at least two counterfort webs, wherein the counterfort beam is coupled to the face joint member by coupling the at least two counterfort webs to the at least two webs of the face joint member, and further comprising an intermediate slab that extends from a first web of a first counterfort beam to a second web of a second counterfort beam, wherein a rear face of the intermediate slab terminates in front of a front face of the counterfort flange.

2. The wall system of claim 1, wherein the counterfort beam is formed together with the face joint member using monolithic construction.

3. The wall system of claim 1, wherein the counterfort beam further comprises an inclined rear panel.

4. The wall system of claim 1, wherein the counterfort beam is coupled to the face joint member by a first connecting threadbar that extends through a first one of the counterfort webs of the counterfort beam and into a first one of the webs of the face joint member and further coupled by a second connecting threadbar that extends through a second one of the counterfort webs of the counterfort beam and into a second one of the webs of the face joint member.

5. The wall system of claim 4, wherein the connecting threadbars each comprise a grease layer between the inner metal threaded bar and the outer protective sleeve.

6. The wall system of claim 1, further comprising a plurality of face joint members and counterfort beams coupled together to form a wall.

7. The wall system of claim 6, wherein the plurality of face joint members are adjacent to one another to form a substantially flat wall.

8. The wall system of claim 6, wherein the plurality of face joint members are spaced apart, and wherein the wall system further comprises wall panels that extend between the face joint members.

9. The wall system of claim 6, further comprising an upper support slab coupled to the at least two counterfort webs of the counterfort beam.

10. The wall system of claim 9, wherein the intermediate slab is positioned directly below the upper support slab.

11. The wall system of claim 6, wherein the plurality of counterfort webs are adjacent to one another.

12. The wall system of claim 1, further comprising an upper support slab coupled to the at least two counterfort webs of the counterfort beam.

13. The wall system of claim 12, wherein the upper support slab is coupled to the at least two counterfort webs by a corresponding sleeved threadbar.

14. A wall system, comprising: a plurality of face joint members each comprising a substantially flat face and at least two webs extending orthogonally on an opposite side to the flat face; a plurality of counterfort beams respectively coupled to one of the plurality of face joint members, wherein a respective counterfort beam comprises at least two counterfort webs extending from a counterfort flange, the counterfort flange extending between the at least two counterfort webs, wherein the respective counterfort beam is coupled to the face joint member by coupling the at least two counterfort webs to the at least two webs of the face joint member and an intermediate slab that extend from a first web of a first counterfort beam of the plurality of counterfort beams to a second web of a second counterfort beam of the plurality of counterfort beams, wherein a rear face of the intermediate slab terminates in front of a front face of the counterfort flange.

15. The wall system of claim 14, further comprising an upper support slab coupled to the at least two counterfort webs of the counterfort beam.

16. The wall system of claim 14, wherein the intermediate slab is positioned directly below the upper support slab.

17. The wall system of claim 14, wherein the plurality of counterfort beams each further comprises an inclined rear panel.

18. A wall system, comprising: a plurality of face joint members each comprising a substantially flat face and at least two webs extending orthogonally on an opposite side to the flat face; a plurality of counterfort beams respectively coupled to one of the plurality of face joint members, wherein a respective counterfort beam comprises at least two counterfort webs extending from a counterfort flange, the counterfort flange extending between the at least two counterfort webs, and wherein the respective counterfort beam comprises an inclined rear panel, wherein the respective counterfort beam is coupled to the face joint member by coupling the at least two counterfort webs to the at least two webs of the face joint member; an upper support slab couple to the at least two counterfort webs of the respective counterfort beam; and an intermediate slab that extends from a first web of a first counterfort beam of the plurality of counterfort beams to a second web of a second counterfort beam of the plurality of counterfort beams, wherein the intermediate slab is positioned directly below the upper support slab, wherein a rear face of the intermediate slab terminates in front of a front face of the counterfort flange.

19. The wall system of claim 18, wherein the respective counterfort beam is coupled to the respective face joint member by a first connecting threadbar that extends through a first one of the counterfort webs of the counterfort beam and into a first one of the webs of the face joint member and further coupled by a second connecting threadbar that extends through a second one of the counterfort webs of the counterfort beam and into a second one of the webs of the face joint member, and wherein the connecting threadbar comprises a grease layer between the inner metal threaded bar and the outer protective sleeve.

* * * * *